US011421409B2

(12) United States Patent
Hayashi et al.

(10) Patent No.: US 11,421,409 B2
(45) Date of Patent: Aug. 23, 2022

(54) FLUSH WATER TANK APPARATUS AND FLUSH TOILET APPARATUS PROVIDED WITH THE SAME

(71) Applicant: TOTO LTD., Kitakyushu (JP)

(72) Inventors: Nobuhiro Hayashi, Kitakyushu (JP); Hidekazu Kitaura, Kitakyushu (JP); Akihiro Shimuta, Kitakyushu (JP); Masahiro Kuroishi, Kitakyushu (JP); Hiroshi Hashimoto, Kitakyushu (JP); Koki Shinohara, Kitakyushu (JP); Kenji Hatama, Kitakyushu (JP); Takashi Yoshioka, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 0 days.

(21) Appl. No.: 17/343,092

(22) Filed: Jun. 9, 2021

(65) Prior Publication Data

US 2021/0381214 A1 Dec. 9, 2021

(30) Foreign Application Priority Data

Jun. 9, 2020 (JP) ..... JP2020-099805
Jun. 9, 2020 (JP) ..... JP2020-099806
May 7, 2021 (JP) ..... JP2021-078916

(51) Int. Cl.
*E03D 1/34* (2006.01)
*E03D 5/10* (2006.01)

(52) U.S. Cl.
CPC ..... *E03D 1/34* (2013.01); *E03D 5/10* (2013.01)

(58) Field of Classification Search
CPC ..... E03D 1/34
USPC ..... 4/313
See application file for complete search history.

(56) References Cited

U.S. PATENT DOCUMENTS

2010/0212696 A1* 8/2010 Shirai ..... E03D 11/08 134/166 R

FOREIGN PATENT DOCUMENTS

CN 106870318 A * 6/2017 ..... E03B 7/075
CN 108643315 A * 10/2018
JP S63-86180 U 6/1988

OTHER PUBLICATIONS

CN 108643315-A English translation printed May 6, 2022 (Year: 2022).*
CN 106870318 A English translation printed May 6, 2022 (Year: 2022).*

* cited by examiner

*Primary Examiner* — Christine J Skubinna
(74) *Attorney, Agent, or Firm* — Studebaker & Brackett PC

(57) ABSTRACT

Provided are a flush water tank apparatus capable of restraining instability of an operation of a piston and restraining fluctuations in a water pressure of flush water discharged from a first discharge part provided separately from an inlet, and a flush toilet apparatus including the flush water tank apparatus. A discharge valve hydraulic drive portion of a flush water tank apparatus of the present invention includes a cylinder, a piston, and a rod extending from the piston through a through-hole portion formed in the cylinder, the cylinder including an inlet into which flush water flows, a first discharge part that is provided separately from the inlet to drain the flush water, and a second discharge part that is provided separately from the first discharge part and is formed between the rod and the through-hole portion and between the piston and the through-hole portion.

26 Claims, 27 Drawing Sheets

FLUSH WATER TANK APPARATUS AND FLUSH TOILET APPARATUS PROVIDED WITH THE SAME

TECHNICAL FIELD

The present invention relates to a flush water tank apparatus, and more particularly to a flush water tank apparatus configured to supply flush water to a flush toilet, and a flush toilet apparatus provided with the same.

BACKGROUND ART

An automatic washing apparatus for a toilet is disclosed in Japanese Utility Model Laid-Open No. 63-86180. The automatic washing apparatus includes a hydraulic cylinder that is operated by a pressure of water being supplied, an electromagnetic valve that communicates and shuts off the supply of tap water to the hydraulic cylinder, and a float valve configured to open and close a valve seat. Based on the operation of the electromagnetic valve, a pressure fluid flows into the hydraulic cylinder, a piston in the hydraulic cylinder ascends, a coupling rod and a coupling chain coupled to the piston ascend, and thus the float valve is pulled up and the float valve is opened. The piston in the hydraulic cylinder is provided with a sealing member that seals a space between the piston and an inner wall of the hydraulic cylinder. A small hole 23*a* for relief is bored on a lower side of the hydraulic cylinder.

SUMMARY OF THE INVENTION

Technical Problem

However, in a flush water tank apparatus disclosed in Japanese Utility Model Laid-Open No. 63-86180, when a water supply pressure suddenly fluctuates, for example, suddenly rises during the supply of tap water to the hydraulic cylinder, since only the small hole 23*a* for relief is provided in the hydraulic cylinder, the operation of the piston may become unstable due to an impact of sudden fluctuations in the pressure of the flush water. Therefore, malfunction of the piston may occur or the toilet may be poorly washed.

Accordingly, an object of the present invention is to provide a flush water tank apparatus capable of restraining an unstable operation of the piston and restraining the fluctuations in the pressure of the flush water drained from a first discharge part provided separately from an inlet, and a flush toilet apparatus including the flush water tank apparatus.

Solution to Problem

In order to solve the above problems, an embodiment of the present invention is a flush water tank apparatus configured to supply flush water to a flush toilet, the flush water tank apparatus including: a reservoir tank configured to store flush water to be supplied to the flush toilet and includes a water discharge opening formed thereon, the water discharge opening being for draining the stored flush water to the flush toilet; a discharge valve configured to open and close the water discharge opening to supply the flush water to the flush toilet and to stop the supply of the flush water; and a discharge valve hydraulic drive portion configured to drive the discharge valve using a water supply pressure of tap water being supplied, the discharge valve hydraulic drive portion including: a cylinder to which the tap water is supplied as flush water; a piston that is slidably disposed in the cylinder and moves from a first position to a second position by the flush water flowing into the cylinder; a rod that extends from the piston through a through-hole portion formed in the cylinder to connect the piston and the discharge valve; an elastic member that is provided on the piston and has a sealing function between the piston and an inner wall of the cylinder; an inlet that is formed in the cylinder and into which the flush water flows; a first discharge part that is provided separately from the inlet to drain the flush water from an inside of the cylinder; and a second discharge part that is provided separately from the first discharge part and is formed between the rod and the through-hole portion and between the piston and the through-hole portion.

According to the embodiment of the present invention configured in this way, the cylinder includes the inlet into which the flush water flows, the first discharge part provided separately from the inlet to cause the flush water to drain, and the second discharge part provided separately from the first discharge part and formed between the rod and the through-hole portion. Thereby, when the water supply pressure of the flush water to the cylinder suddenly fluctuates, for example, suddenly rises in the state where the flow channel is not communicated or is communicated from the inlet to the first discharge part in the cylinder, the second discharge part can soften the impact of the sudden fluctuation in the pressure of the flush water, the piston can buffer the impact applied from the flush water, and the unstable operation of the piston can be restrained.

Advantageous Effect of the Invention

According to the present invention, it is possible to provide a flush water tank apparatus capable of reducing the possibility of the operation malfunction of the discharge valve hydraulic drive portion, and a flush toilet apparatus including the flush water tank apparatus.

DETAILED DESCRIPTION OF EMBODIMENTS

A flush toilet apparatus according to a first embodiment of the present invention will be described below with reference to the accompanying drawings. From the following description, many improvements and other embodiments will be apparent to those skilled in the art. Accordingly, the following description should be construed as an example only and is provided for the purpose of teaching those skilled in the art the best mode of carrying out the present invention. The details of the structure and/or function can be substantially modified and rearranged without departing from the spirit of the present invention.

Figure 1:
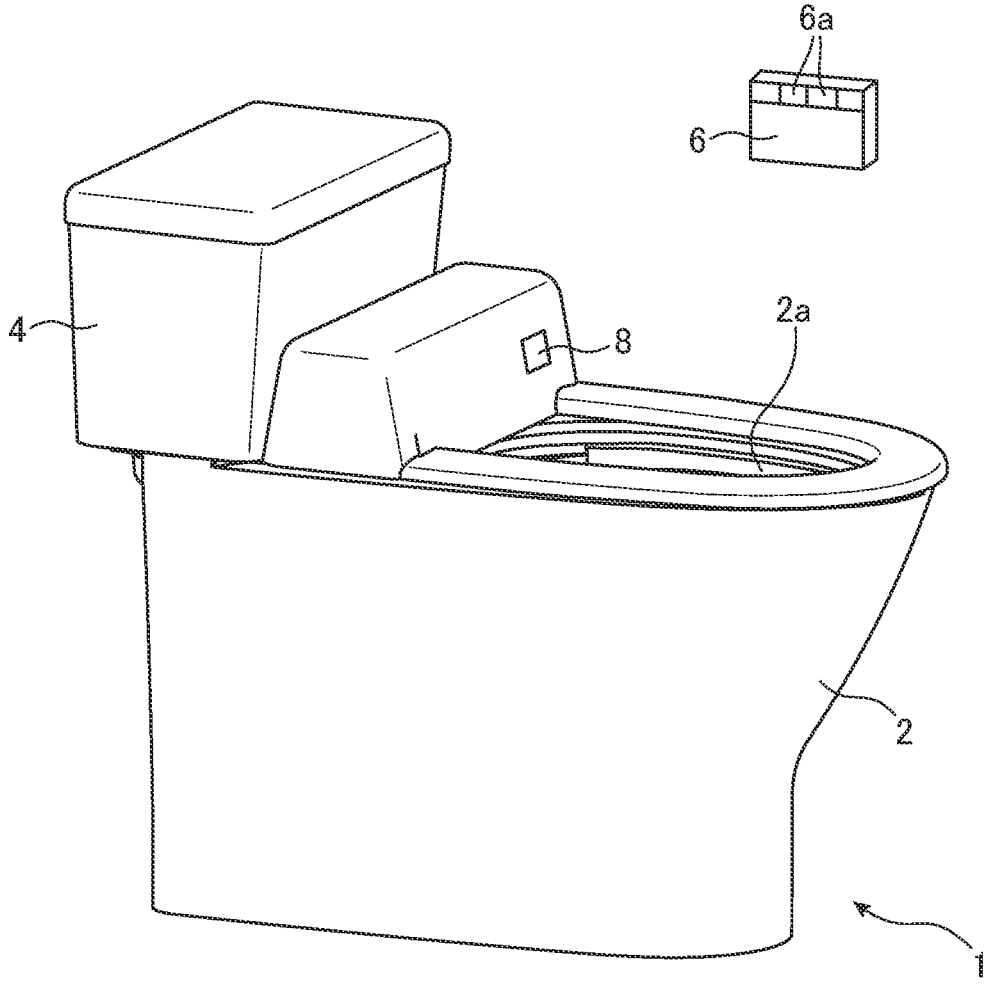
FIG. 1 is a perspective view showing an entire flush toilet apparatus including a flush water tank apparatus according to a first embodiment of the present invention.
Figure 2:
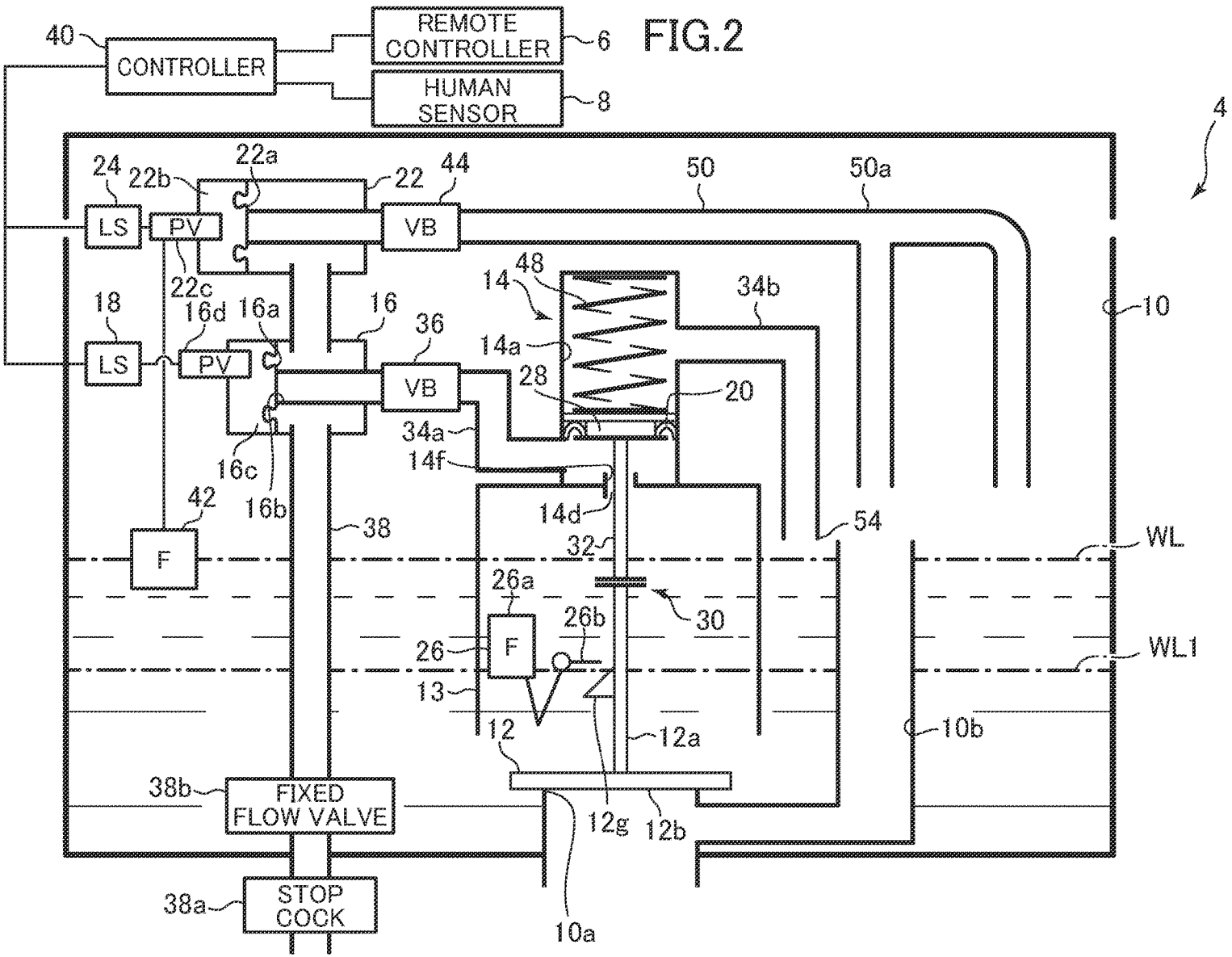
FIG. 2 is a cross-sectional view showing a schematic configuration of the flush water tank apparatus according to the first embodiment of the present invention.
Figure 3:
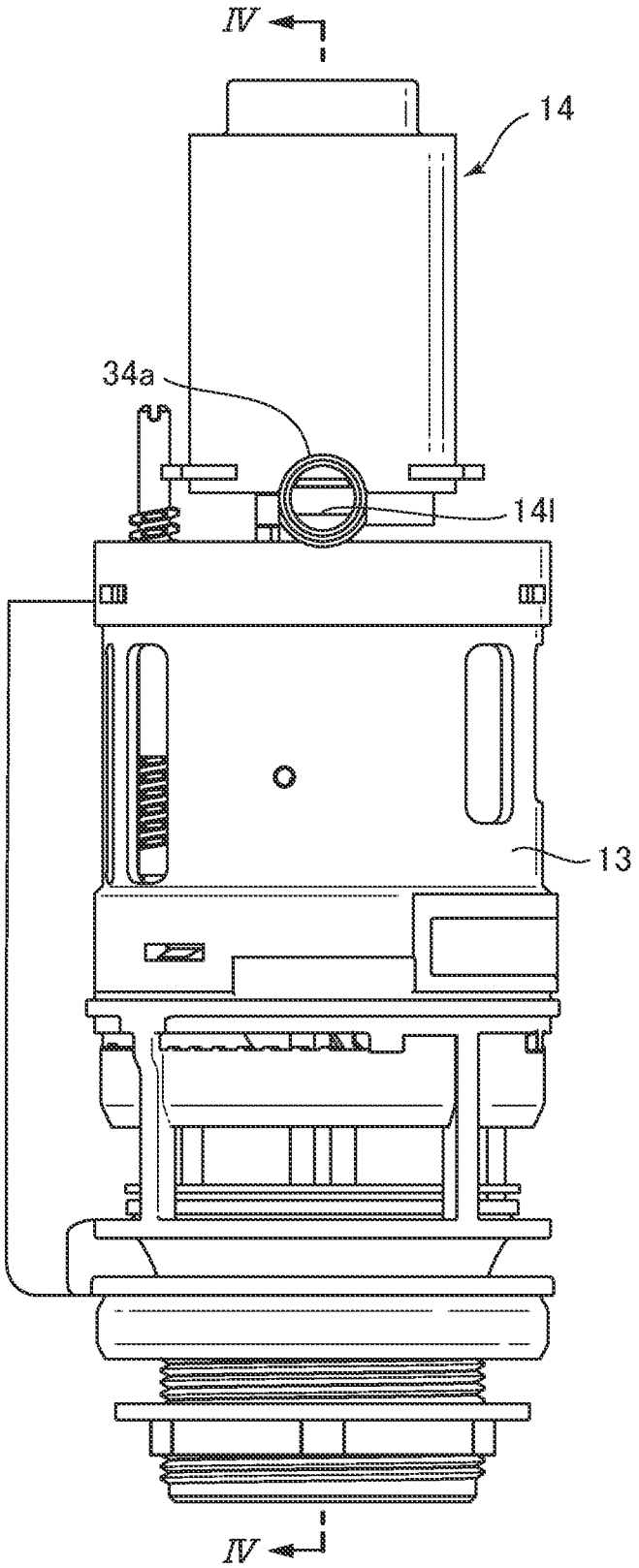
FIG. 3 is a side view showing a state where a discharge valve hydraulic drive portion, a clutch mechanism, and a discharge valve of the flush water tank apparatus according to the first embodiment of the present invention are disposed in a reservoir tank in a standby state.

FIG. 1 is a perspective view showing an entire flush toilet apparatus including a flush water tank apparatus according to the first embodiment of the present invention. FIG. 2 is a cross-sectional view showing a schematic configuration of the flush water tank apparatus according to the first embodiment of the present invention.

As shown in FIG. 1, a flush toilet apparatus 1 according to the first embodiment of the present invention includes a flush toilet main body 2 which is a flush toilet and a flush water tank apparatus 4 according to the first embodiment of the present invention which is mounted on a rear portion of the flush toilet main body 2. The flush toilet main body 2 is washed with flush water supplied from the flush water tank apparatus 4. The flush toilet apparatus 1 according to the present embodiment is configured to wash a bowl 2*a* of the flush toilet main body 2 by an operation of a remote controller 6 attached to a wall surface or to wash it after a lapse of a predetermined time from a detection of a user's departure by a human sensor 8 provided on a toilet seat, after use. The flush water tank apparatus 4 according to the present embodiment is configured to drain flush water stored therein to the flush toilet main body 2 based on an instruction signal from the remote controller 6 or the human sensor 8 and to wash the bowl 2*a* with the flush water.

Further, when a user pushes a button 6*a* of the remote controller 6, a toilet washing operation is executed to wash the bowl 2*a*. In the present embodiment, although the human sensor 8 is provided on the toilet seat, the present invention is not limited thereto. For example, the human sensor 8 may be provided at a detectable position of user's sitting, leaving or approaching, withdrawing, and holding out his/her hand, and may be provided on the flush toilet main body 2 or the flush water tank apparatus 4. In addition, as long as it can detect the user's sitting, leaving or approaching, withdrawing, and holding his/her hand, an infrared sensor or a microwave sensor can be used as the human sensor 8, for example. The remote controller 6 may be replaced with an operation lever apparatus or an operation button apparatus having a structure capable of mechanically controlling opening and closing of a first control valve 16 and a second control valve 22 which will be described below.

As shown in FIG. 2, the flush water tank apparatus 4 includes a reservoir tank 10 configured to store flush water to be supplied to the flush toilet main body 2, a discharge valve 12 configured to open and close a water discharge opening 10*a* provided in the reservoir tank 10, and a discharge valve hydraulic drive portion (discharge valve hydraulic drive unit) 14 that is a discharge valve pull-up part configured to pull up the discharge valve 12. Further, the flush water tank apparatus 4 includes therein a first control valve 16 that is a water supply controller configured to control water supply to the discharge valve hydraulic drive portion 14 from tap water and an electromagnetic valve 18 attached to the first control valve 16. Further, the flush water tank apparatus 4 includes therein a second control valve 22 configured to supply flush water to the reservoir tank 10 and an electromagnetic valve 24 attached to the second control valve 22. The flush water tank apparatus 4 includes a float apparatus 26 that is a valve controller and a timing control mechanism configured to hold the pulled-up discharge valve 12 at a predetermined position.

Further, the flush water tank apparatus 4 includes a clutch mechanism 30, and the clutch mechanism 30 connects the discharge valve 12 and a rod 32 extending from the discharge valve hydraulic drive portion 14 to pull up the discharge valve 12 by an operation of the rod 32 of the discharge valve hydraulic drive portion 14, and is disengaged at a predetermined timing so that the discharge valve 12 descends. A casing 13 is formed above the discharge valve 12, and the casing 13 is formed in a cylindrical shape with an opening on a lower side. The casing 13 is connected and fixed to the discharge valve hydraulic drive portion 14.

The reservoir tank 10 is a tank configured to store flush water to be supplied to the flush toilet main body 2, and includes a water discharge opening 10*a* formed thereon, which is for draining the stored flush water to the flush toilet main body 2, at a bottom portion thereof. Further, an overflow pipe 10*b* is connected to a downstream side of the water discharge opening 10*a* in the reservoir tank 10. The overflow pipe 10*b* rises vertically from the vicinity of the water discharge opening 10*a*, and extends upward from a full water level WL which is stopped water level of the flush water stored in the reservoir tank 10. The stopped water level is a water level of the flush water stored in the reservoir tank 10 in a standby state, and is distinguished from a dead water level which is a lower limit of the flush water in the reservoir tank 10 at the time of washing the toilet. Therefore, flush water flowing in from an upper end of the overflow pipe 10*b* bypasses the water discharge opening 10*a* and directly flows out to the flush toilet main body 2.

The discharge valve 12 is a valve main body apparatus disposed to open and close the water discharge opening 10*a*, and the discharge valve 12 is opened by being pulled up upward, so that the flush water in the reservoir tank 10 is discharged to the flush toilet main body 2 and the bowl 2*a* is washed. In addition, the discharge valve 12 closes the water discharge opening 10*a* to stop the supply of the flush water to the flush toilet main body 2. The discharge valve 12 includes a valve main body 12*b* having a circular outer shape and configured to open and close the water discharge opening 10*a*, a valve shaft frame body 12*a* extending upward from the valve main body 12*b* and interlocking with the valve main body 12*b*, and a support portion 12*d* (see FIG. 8) formed in a C-shape and receiving the rotary shaft 66. The discharge valve 12 is a direct-acting discharge valve apparatus in which the valve shaft frame body 12*a* is moved up and down in a vertical direction to move the valve main body 12*b* up and down in the vertical direction and to open and close the water discharge opening 10*a*. Further, the discharge valve 12 is pulled up by a driving force of the discharge valve hydraulic drive portion 14, the clutch mechanism 30 is disengaged at a predetermined timing when the discharge valve 12 is pulled up to a predetermined height, and the discharge valve 12 descends by its own weight. When the discharge valve 12 descends, the discharge valve 12 is held by the float apparatus 26 for a predetermined time, and a time until the discharge valve 12 is seated on the water discharge opening 10*a* is adjusted.

The discharge valve hydraulic drive portion 14 will be described below with reference to FIGS. 2 to 7.

Figure 4:
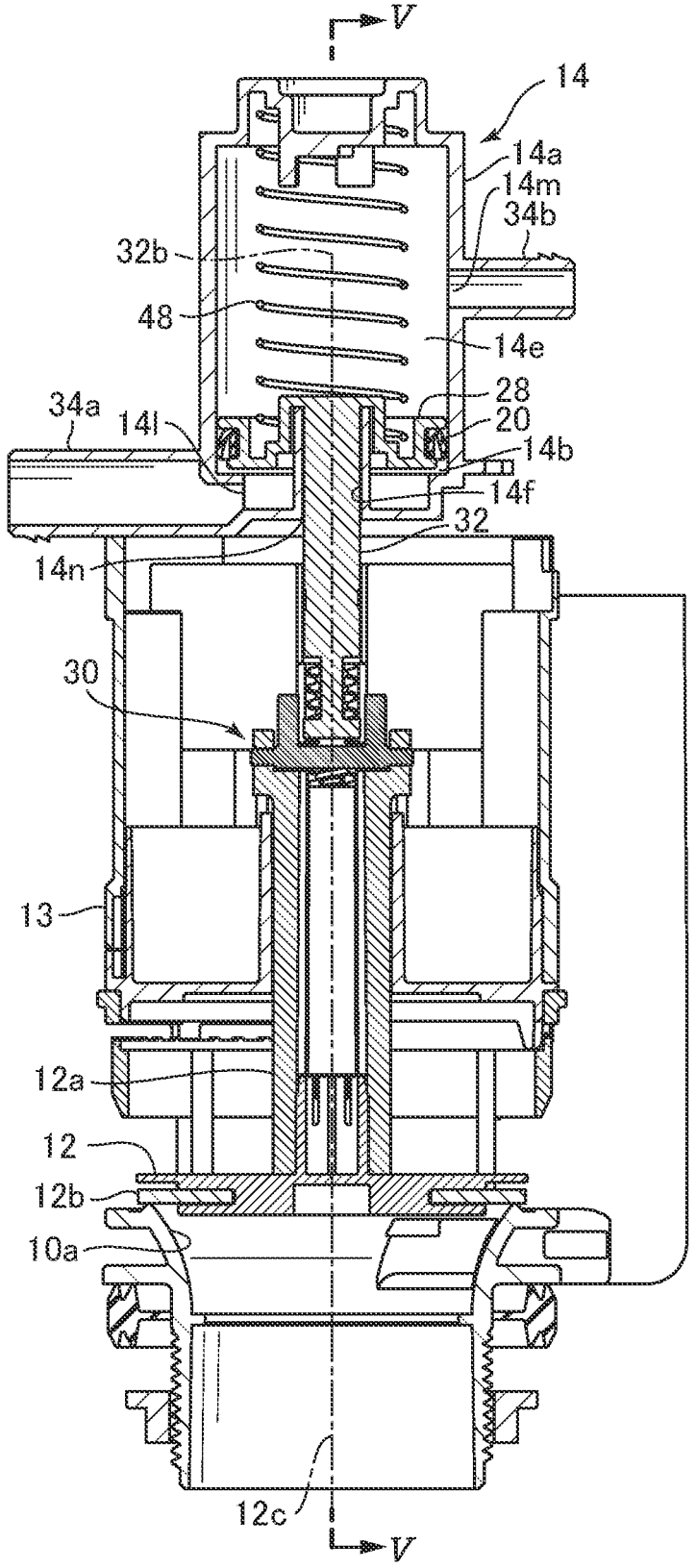
FIG. 4 is a front cross-sectional view taken along a line IV-IV in FIG. 3.
Figure 5:
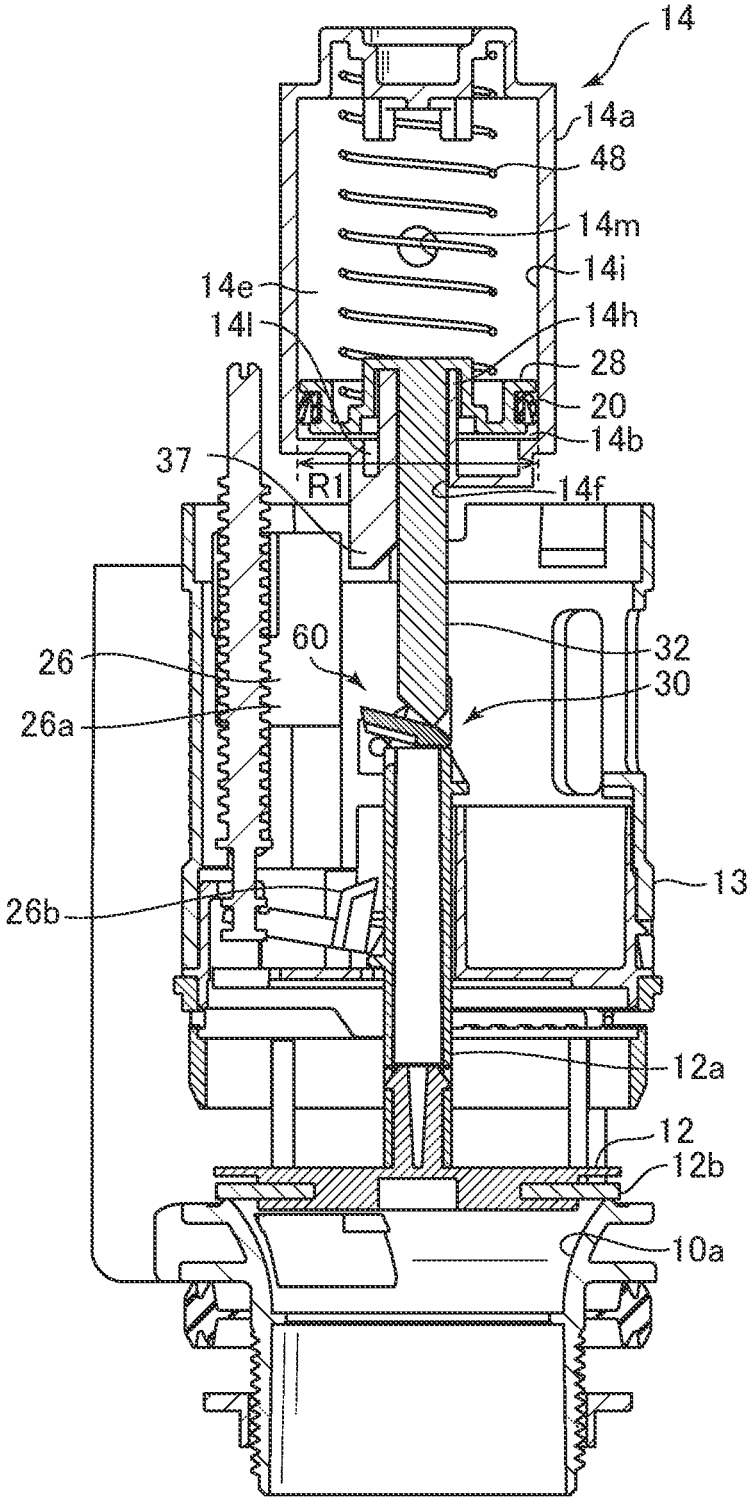
FIG. 5 is a cross-sectional view taken in a front-rear direction along a line V-V in FIG. 4.

As shown in FIGS. 2, 4, and 5, the discharge valve hydraulic drive portion 14 is configured to drive the discharge valve 12 using a water supply pressure of the flush water supplied from the tap water. Specifically, the discharge valve hydraulic drive portion 14 includes a cylinder 14*a* to which the tap water supplied from the first control valve 16 is supplied as flush water, a piston 28 slidably disposed in the cylinder 14*a*, a rod 32 protruding from a lower end of the cylinder 14*a* to drive the discharge valve 12, a packing 20 provided on the piston 28 and being a sealing member having a sealing function between the piston 28 and an inner wall of the cylinder 14*a*, and a spring 48 provided in the cylinder 14*a* and being an urging member that urges the piston 28 toward the side of a first position H1 (see FIG. 6).

Further, the spring 48 is disposed inside the cylinder 14*a* to urge the piston 28 downward. The clutch mechanism 30 is provided at a lower end of the rod 32, the rod 32 and the valve shaft frame body 12*a* of the discharge valve 12 are coupled and released to and from each other by the clutch mechanism 30.

The cylinder 14*a* has an axis disposed to be directed in the vertical direction, and the piston 28 is received inside the cylinder 14*a* to be slidable in an up-down direction. Further, a drive part water supply passage 34*a* is connected to a lower end of the cylinder 14*a* such that the flush water flowing out from the first control valve 16 flows into the cylinder 14*a*. The flush water flows into the cylinder 14*a* using the water supply pressure of the tap water. Therefore, the piston 28 in the cylinder 14*a* is pushed up against an urging force of the spring 48 by the flush water flowing into the cylinder 14*a*. Only the tap water is supplied to the cylinder 14*a* as flush water, and the flush water once supplied to the reservoir tank 10 does not flow into the cylinder 14*a*. Not only the piston 28 moves up and down in the cylinder 14*a*, but also the piston 28 may move in another direction (for example, an oblique direction or a left-right direction) in the cylinder 14*a*.

On the other hand, a first discharge part 14*m* is provided in an upper center of the cylinder 14*a* in a height direction to form an outflow hole to the drive part drain passage 34*b*, and the drive part drain passage 34*b* communicates with the inside of the cylinder 14*a* via the first discharge part 14*m*. Therefore, when the flush water flows into the cylinder 14*a* from the drive part water supply passage 34*a* connected to the lower portion of the cylinder 14*a*, the piston 28 is pushed upward from the lower portion of the cylinder 14*a* which is the first position H1 (see FIG. 6). Then, when the piston 28 is moved so as to be pushed up to a second position H2 (see FIG. 11) higher than the first discharge part 14*m*, the water flowing into the cylinder 14*a* flows out through the drive part drain passage 34*b* from the first discharge part 14*m*. In other words, the drive part water supply passage 34*a* and the drive part drain passage 34*b* communicate with each other via the inside of the cylinder 14*a* when the piston 28 is moved to the second position H2. A discharge part 54 is formed at a front end of the drive part drain passage 34*b* extending from the cylinder 14*a*. In this way, the drive part drain passage 34*b* forms a flow channel extending up to the discharge part 54.

Figure 6:
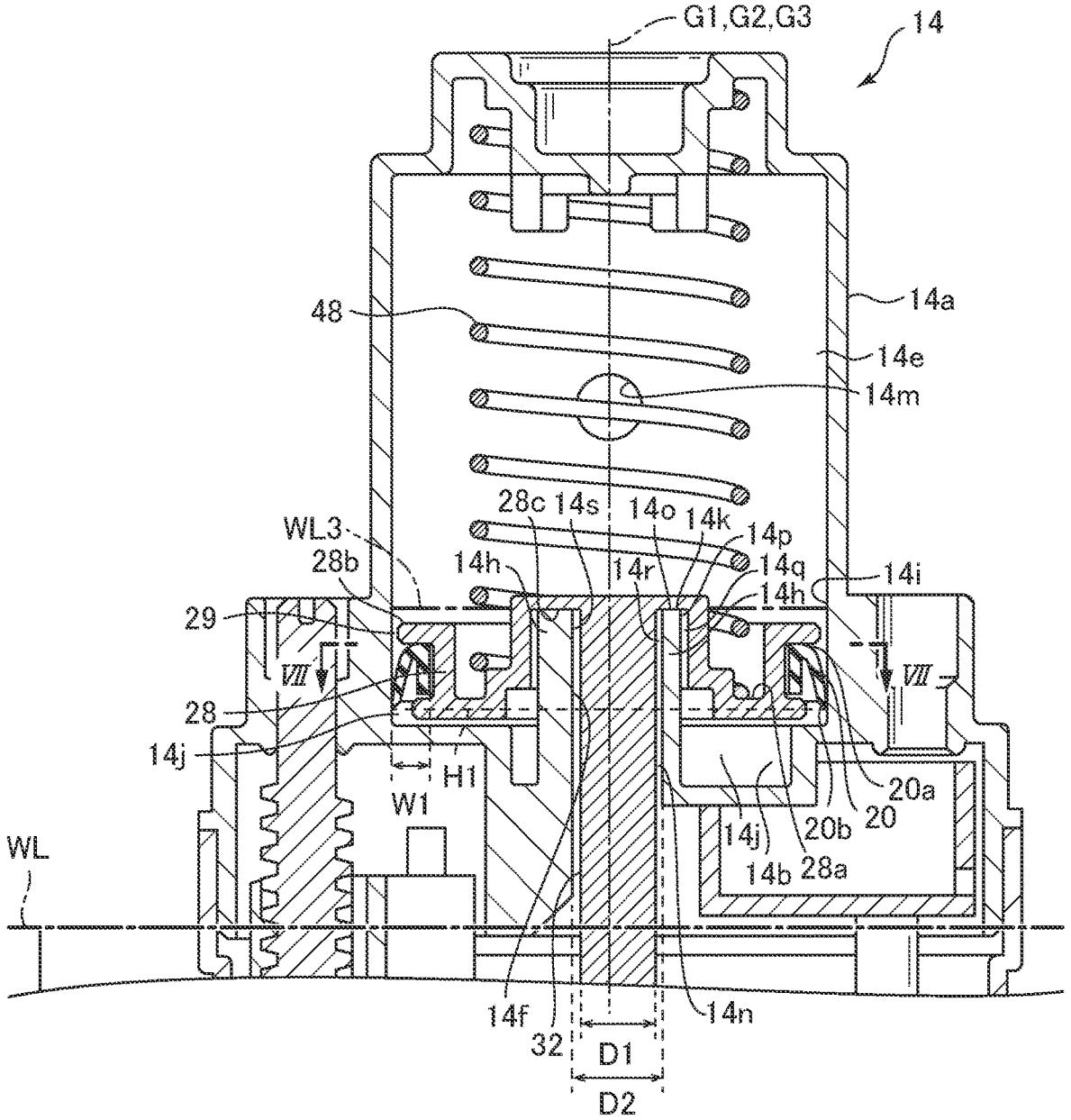
FIG. 6 is a partially enlarged view of a vicinity of the discharge valve hydraulic drive portion of the flush water tank apparatus in FIG. 5.
Figure 7:
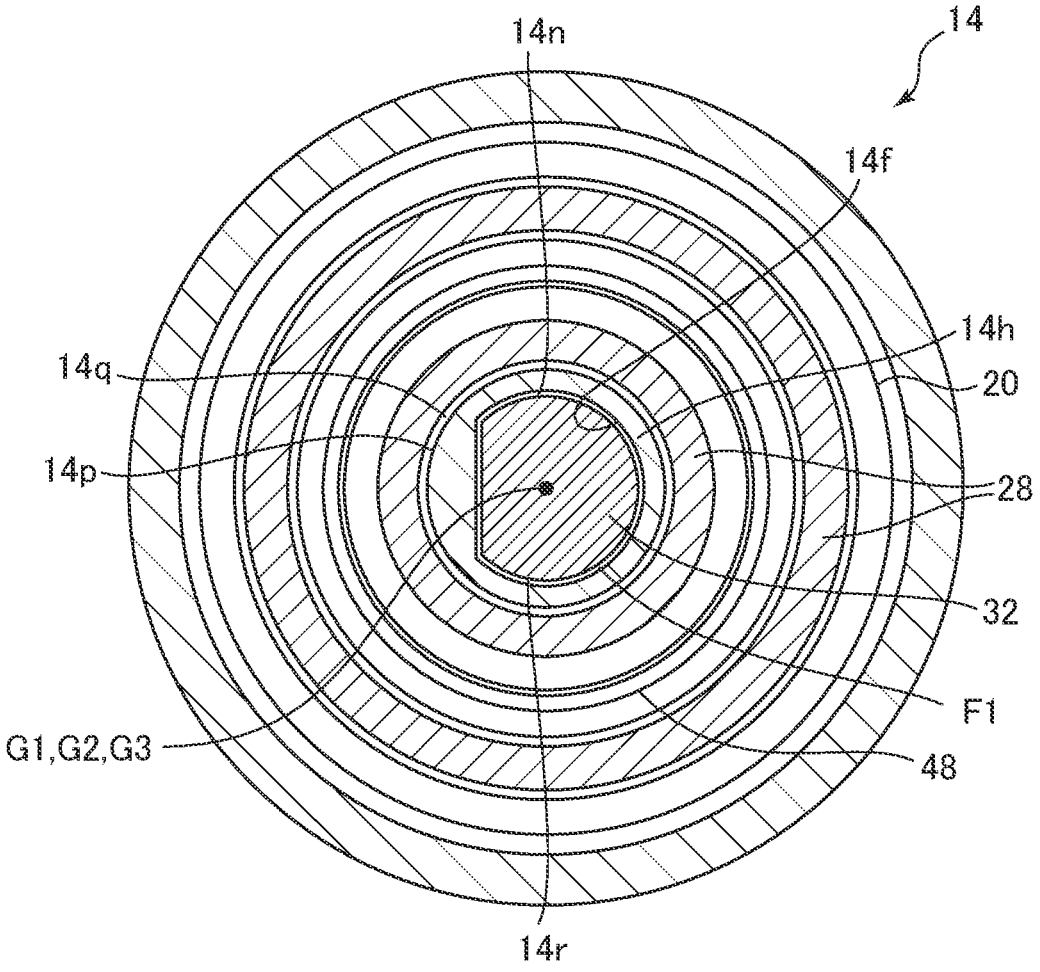
FIG. 7 is a cross-sectional view taken along a line VII-VII in FIG. 6.

As shown in FIG. 6, the cylinder 14*a* further includes a through-hole portion 14*f* formed in the bottom portion on the first position of the cylinder 14*a* and a water storage part 14*j* capable of storing the flush water remaining between a bank portion 14*h* (which will be described below) of the through-hole portion 14*f* and an inner wall 14*i* of the cylinder 14*a*.

The through-hole portion 14*f* includes a bank portion 14*h* that rises upward from a peripheral portion of a through hole formed at the bottom portion of the cylinder 14*a* and a flow straightening portion 14*s* formed such that a diameter of an inner wall at a top portion is substantially constant in a moving direction (a height direction in the present embodiment) of the rod 32. The bank portion 14*h* of the cylinder 14*a* is formed in an annular shape around the rod 32 in a top view. The flow straightening portion 14*s* is formed extending below from a top portion of the bank portion 14*h* by a predetermined distance. The flow straightening portion 14*s* forms a vertical wall extending in the vertical direction. The flow straightening portion 14*s* extends substantially parallel to an outer wall of the rod 32, and forms a flow channel having a substantially constant width between the flow straightening portion 14*s* and the rod 32. Thereby, it is possible to restrain turbulence of the flow of the flush water passing between the flow straightening portion 14*s* and the rod 32.

The water storage part 14*j* forms a water storage portion in the cylinder 14*a* at a position lower than the top portion of the bank portion 14*h*. The water storage part 14*j* is formed in an annular shape. The cylinder 14*a* is configured such that the packing 20 is immersed in the flush water remaining in the water storage part 14*j* in the cylinder 14*a* after the toilet is washed in a state where the lower end of the packing 20 is in a standby position being the first position H1. Here, the flush water remaining in the cylinder 14*a* means flush water (indicated by a residual water level WL3 in FIG. 6) remaining in the cylinder 14*a* in a state where the flush water in the cylinder 14*a* gradually flows out from the through-hole portion 14*f* after each washing operation and the outflow has been completed. The residual water level WL3 of the remaining flush water is defined by a top portion 14*k* (which will be described below) of the bank portion 14*h*. The drive part water supply passage 34*a* is formed to be higher than the height of the residual water level WL3 in a path from the discharge valve hydraulic drive portion 14 to a vacuum breaker 36. Therefore, the flush water is stored in the cylinder 14*a* up to the residual water level WL3 in the state where the outflow of the flush water from the cylinder 14*a* is completed. An upper end 20*a* of the packing 20 is located at a position lower than the top portion 14*k* of the bank portion 14*h* such that the packing 20 is located in the water storage part 14*j* in the state where the piston 28 is in the first position H1. When the piston 28 (the lower end of the piston 28) is in the first position, the packing 20 (the lower end of the packing 20) is also in the first position, so that when the piston 28 is in the first position, the packing 20 is described as being also in the first position.

As shown in FIG. 6, the cylinder 14*a* includes an inlet 14*l* (see FIG. 4) into which the flush water flows, a first discharge part 14*m* provided separately from the inlet 14*l* to cause the flush water to drain, and a second discharge part 14*n* provided separately from the first discharge part 14*m* and formed between the rod 32 and the through-hole portion 14*f* and between the piston 28 and the through-hole portion 14*f*.

The inlet 14*l* is connected to the drive part water supply passage 34*a*. The inlet 14*l* is connected to a lower portion of the water storage part 14*j* of the cylinder 14*a*. The inlet 14*l* forms a flow channel communicating with a lower side of the piston 28. The first discharge part 14*m* is connected to the drive part drain passage 34*b* and forms an outflow hole to the drive part drain passage 34*b*. The second discharge part 14*n* communicates with a space in the reservoir tank 10 on the lower side of the discharge valve hydraulic drive portion 14. The second discharge part 14*n* is formed between the rod 32 and the through-hole portion 14*f* and between the piston 28 and the through-hole portion 14*f*. The second discharge part 14*n* forms a second outflow channel from the cylinder 14*a*. A minimum cross-sectional area value of the flow channel of the second discharge part 14*n* is smaller than that of the flow channel of the first discharge part 14*m*. The minimum cross-sectional area value of the flow channel of the second discharge part 14*n* is equal to or less than half of the minimum cross-sectional area value of the flow channel of the first discharge part 14*m*, and the second discharge part 14*n* forms an auxiliary drain flow channel relative to the first discharge part 14*m*.

In the state where the piston 28 is in the first position H1, the second discharge part 14*n* includes a first flow channel 14*o* extending laterally between the top portion 14*k* of the bank portion 14*h* and a lower surface portion 28*c*, a second flow channel 14*q* formed between an outer wall portion 14*p* of the bank portion 14*h* and the piston 28 and bending downward and extending from the first flow channel 14*o*, and a third flow channel 14*r* extending downward between the rod 32 and the inner wall of the through-hole portion 14*f* in the state where the piston 28 is in the first position H1. The first flow channel 14*o* forms a flow channel with a relatively small gap because the top portion 14*k* and the lower surface portion 28*c* are substantially in contact with each other when the piston 28 is in the first position H1. The second flow channel 14*q* and the first flow channel 14*o* form a flow channel that bends in an L shape in a cross-sectional view. Further, the second flow channel 14*q*, the first flow channel 14*o*, and the third flow channel 14*r* form a flow channel that bends in a Π shape in a cross-sectional view. The piston 28 and the cylinder 14*a* may be configured such that the top portion 14*k* and the lower surface portion 28*c* do not come in contact with each other and the first flow channel 14*o* of the flow channel with a relatively small gap is formed in the state where the piston 28 is in the first position H1.

The shape of the second discharge part 14*n* changes with the movement of the piston 28 in the up-down direction. Therefore, the total cross-sectional area value and the minimum cross-sectional area value of the flow channel in the second discharge part 14*n* change with the movement of the piston 28. The second discharge part 14*n* is formed such that as the piston 28 moves from the first position H1 to the second position H2, the total cross-sectional area value and the minimum cross-sectional area value of the flow channel in the second discharge part 14*n* increase and pressure loss of the second discharge part 14*n* is reduced. For example, as the piston 28 moves from the first position H1 to the second position H2, the cross-sectional area of the minimum flow channel in the second discharge part 14*n* increases. For example, the cross-sectional area of the minimum flow channel is the minimum cross-sectional area value of the flow channel of the first flow channel 14*o* between the top portion 14*k* of the bank portion 14*h* and the lower surface portion 28*c* of the piston 28, and the minimum cross-sectional area value of the flow channel of the first flow channel 14*o* increases as the piston 28 ascends. As the piston 28 moves from the first position H1 to the second position H2, the minimum cross-sectional area value of the flow channel of the second flow channel 14*q* also increases. When the piston 28 moves from the first position H1 to the second position H2, the minimum cross-sectional area value of the flow channel of the third flow channel 14*r* is constant.

As will be described below, when an outer diameter of the lower portion of the rod 32 is formed smaller than an outer diameter of the upper portion of the rod 32, the second discharge part 14*n* is formed such that as piston 28 and the rod 32 ascend, the cross-sectional area of the flow channel of the third flow channel 14*r* between the rod 32 and the inner wall of the through-hole portion 14*f*, for example, the total cross-sectional area value and the minimum cross-sectional area value increase and the pressure loss of the second discharge part 14*n* is reduced. At this time, the minimum cross-sectional area value (a cross-sectional F1 of the flow channel of the second discharge part 14*n* between the rod 32 and the inner wall of the through-hole portion 14*f* shown in FIG. 7) of the flow channel of the third flow channel 14*r* when the piston 28 is in the first position H1 is smaller than the minimum cross-sectional area value of the flow channel between the rod 32 and the inner wall of the through-hole portion 14*f* when the piston 28 is in the second position H2. Further, as the piston 28 ascends, the minimum cross-sectional area value of the flow channel of the first flow channel 14*o* increases. As the piston 28 ascends, the minimum cross-sectional area value of the flow channel of the second flow channel 14*q* increases.

The cylinder 14*a* is a substantially tubular member, and is formed in a conical shape in which the inner diameter of the inner wall 14*i* of the cylinder 14*a* gradually becomes smaller downward. An inner diameter R1 (see FIG. 5) of the cylinder 14*a* at a portion corresponding to the first position H1 of the piston 28 is the minimum inner diameter of the cylinder. The inner diameter R1 of the cylinder 14*a* is smaller than an inner diameter R2 (see FIG. 11) of the cylinder 14*a* at a portion corresponding to the second position H2 of the piston 28. The inner diameter of the cylinder 14*a* gradually becomes smaller from the inner diameter R2 of the second position to inner diameter R1 of the first position.

The rod 32 is a rod-shaped member connected to the lower surface of the piston 28, extends downward from the piston 28 so as to couple the piston 28 and the discharge valve 12, and extends to protrude downward from the inside of the cylinder 14*a* by passing through the through-hole portion 14*f* formed in the bottom portion of the cylinder 14*a*. Some of the flush water flowing into the cylinder 14*a* flows out from the second discharge part 14*n* that forms a gap between the rod 32 and the through-hole portion 14*f*. The flush water flowing out from the second discharge part 14*n* flows into the reservoir tank 10. Since the second discharge part 14*n* is relatively narrow and has a large flow channel resistance, even when the flush water flows out from the second discharge part 14*n*, the pressure in the cylinder 14*a* rises due to the flush water flowing into the cylinder 14*a* from the drive part water supply passage 34*a*, and the piston 28 is pushed up against the urging force of the spring 48.

As shown in FIG. 6, a center axis G1 of the rod 32 and a center axis G2 of the through-hole portion 14*f* are located on the same axis as a center axis G3 of the cylinder 14*a*. A maximum outer diameter D1 out of outer diameters of the entire rod 32 is smaller than a minimum inner diameter D2 out of inner diameters of the entire through-hole portion 14*f*. In the present embodiment, the outer diameter of the rod 32 is formed to be substantially constant from an upper portion to a lower portion. The outer diameter of the lower portion of the rod 32 may be smaller than the outer diameter of the upper portion of the rod 32.

In the present embodiment, the piston 28 is configured to move up and down in the cylinder 14*a*. The first position H1 (see FIGS. 5 and 6) of the piston 28 is located below the second position H2 (see FIG. 11). The second position H2 is located above the first discharge part 14*m* near the center of the cylinder 14*a*, and is a position near or above the center of the cylinder 14*a*, for example. The piston 28 includes a force receiving part 28*a* that receives the urging force from the spring 48 and an upper outer circumference part 28*b* formed on the upper side of the packing 20.

The force receiving part 28*a* is formed outside the bank portion 14*h* in a top view. The force receiving part 28*a* is formed from a concave portion having an annular shape. The force receiving part 28*a* is in contact with the lower end of the spring 48. The force receiving part 28*a* is located below the top portion 14*k* of the bank portion 14*h* in the state where the piston 28 and the packing 20 are in the first position H1. A water passageway gap 29, through which the flush water passes, is formed between the upper outer circumference part 28*b* and the inner wall 14*i* of the cylinder 14*a*. The water passageway gap 29 is formed in an annular shape with a substantially uniform width over the entire circumference. Since the cylinder 14*a* is formed in the conical shape, the water passageway gap 29 gradually becomes smaller from the upper side to the lower side of the cylinder 14*a* as the piston 28 moves from the upper side to the lower side of the cylinder 14*a*.

As shown in FIG. 6, the packing 20 is attached to the piston 28 and has a function of ensuring watertightness of the seal between the inner wall surface of the cylinder 14*a* and the piston 28. The packing 20 is a so-called U packing having a U-shaped cross section. The packing 20 is disposed such that an open side having a U shape is directed downward and the cross section is an inverted U shape. When the piston 28 is in the standby position of the first position, the lower end 20*b* of the packing 20 is located above the full water level WL of the reservoir tank 10. The packing 20 is an elastic member formed of rubber. Since the packing 20 slides with respect to the inner wall surface of the cylinder 14*a* together with the piston 28, as long as the packing 20 has a certain degree of sealing function capable of restraining the flush water from leaking, it is no matter the flush water slightly leaks between the packing 20 and the inner wall surface of the cylinder 14*a*. The packing 20 may be a lip packing (for example, L packing or V packing among the lip packing) having a sealing portion formed in a lip shape, or a squeeze packing (for example, O-ring or X-ring among the squeeze packing) for sealing by giving a squeeze.

The first control valve 16 and the second control valve 22 will be described below with reference to FIG. 2.

The first control valve 16 is configured to control water supply to the discharge valve hydraulic drive portion 14 and to supply and stop the water supply to the discharge part 54 based on the operation of the electromagnetic valve 18. In other words, the first control valve 16 includes a main valve body 16*a*, a main valve port 16*b* opened and closed by the main valve body 16*a*, a pressure chamber 16*c* configured to move the main valve body 16*a*, and a pilot valve 16*d* configured to switch the pressure in the pressure chamber 16*c*.

The main valve body 16*a* is configured to open and close the main valve port 16*b* of the first control valve 16. When the main valve port 16*b* is opened, the tap water supplied from the water supply pipe 38 flows into the discharge valve hydraulic drive portion 14. The pressure chamber 16*c* is provided in a housing of the first control valve 16 to be adjacent to the main valve body 16*a*. The pressure chamber 16*c* is configured such that some of the tap water supplied from the water supply pipe 38 flows into and the internal pressure rises. When the pressure in the pressure chamber 16*c* rises, the main valve body 16*a* moves toward the main valve port 16*b* and the main valve port 16*b* is closed.

The pilot valve 16*d* is configured to open and close a pilot valve port (not shown) provided in the pressure chamber 16*c*. When the pilot valve port (not shown) is opened by the pilot valve, the water in the pressure chamber 16*c* flows out and the internal pressure drops. When the pressure in the pressure chamber 16*c* drops, the main valve body 16*a* is separated from the main valve port 16*b*, and the first control valve 16 is opened. Further, when the pilot valve 16*d* is closed, the pressure in the pressure chamber 16*c* rises, and the first control valve 16 is closed.

The pilot valve 16*d* is moved by the electromagnetic valve 18 attached to the pilot valve 16*d* to open and close the pilot valve port (not shown). The electromagnetic valve 18 is electrically connected to a controller 40, and causes the pilot valve 16*d* to move based on a command signal from the controller 40. Specifically, the controller 40 receives signals from the remote controller 6 and the human sensor 8, and the controller 40 sends an electric signal to the electromagnetic valve 18 and causes the electromagnetic valve 18 to be operated.

In addition, the vacuum breaker 36 is provided in the drive part water supply passage 34*a* located between the first control valve 16 and the discharge valve hydraulic drive portion 14. When the pressure on the first control valve 16 becomes negative, the vacuum breaker 36 restrains backflow of water to the first control valve 16.

Next, the second control valve 22 is configured to supply and stop the water supply to the reservoir tank 10 based on the operation of the electromagnetic valve 24. The second control valve 22 is connected to the water supply pipe 38 via the first control valve 16, but the tap water supplied from the water supply pipe 38 always flows into the second control valve 22 in spite of opening and closing of the first control valve 16. Further, the second control valve 22 includes a main valve body 22*a*, a pressure chamber 22*b*, and a pilot valve 22*c*, and the pilot valve 22*c* is opened and closed by the electromagnetic valve 24. When the pilot valve 22*c* is opened by the electromagnetic valve 24, the main valve body 22*a* of the second control valve 22 is opened, and the tap water flowing in from the water supply pipe 38 is supplied to the reservoir tank 10 or the overflow pipe 10*b*. The electromagnetic valve 24 is electrically connected to the controller 40, and the pilot valve 22*c* moves based on the command signal from the controller 40. Specifically, based on the operation of the remote controller 6, the controller 40 sends an electric signal to the electromagnetic valve 24 and causes the electromagnetic valve 24 to be operated. The electromagnetic valve 24 may not be provided. When the electromagnetic valve 24 is not provided, the pilot valve 22*c* is controlled by a float switch 42 as will be described below.

On the other hand, the float switch 42 is connected to the pilot valve 22*c*. The float switch 42 is configured to control the pilot valve 22*c* based on the water level in the reservoir tank 10 and to open and close a pilot valve port (not shown). In other words, the float switch 42 sends a signal to the pilot valve 22*c* to close the pilot valve port (not shown) when the water level in the reservoir tank 10 reaches a predetermined water level. In other words, the float switch 42 is configured to set the water storage level in the reservoir tank 10 to a predetermined full water level WL which is a stopped water level. The float switch 42 is disposed in the reservoir tank 10 and is configured to stop the water supply from the first control valve 16 to the discharge valve hydraulic drive portion 14 when the water level of the reservoir tank 10 rises to the full water level WL. The float switch 42 can be replaced with a ball tap mechanism. The ball tap mechanism includes a float for ball tap that moves up and down according to the water level and a support arm connected to the float for ball tap and acting on the pilot valve 22*c*. In the ball tap mechanism, when the water level of the reservoir tank 10 rises to the full water level WL, the float for ball tap rises and the support arm connected to the float for ball tap rotates upward to mechanically close the pilot valve port (not shown) of the pilot valve 22*c*. In the ball tap mechanism, when the water level of the reservoir tank 10 drops below the full water level WL, the float for ball tap descends and the support arm connected to the float for ball tap rotates downward to mechanically open the pilot valve port (not shown) of the pilot valve 22*c*.

In addition, a water supply passage 50 extending from the second control valve 22 is provided with a water supply passage branch portion 50*a*. One water supply passage 50 branched at the water supply passage branch portion 50*a* allows the water to flow out into the reservoir tank 10, and the other water supply passage 50 allows the water to flow out into the overflow pipe 10*b*. Therefore, some of the flush water supplied from the second control valve 22 is discharged to the flush toilet main body 2 through the overflow pipe 10*b*, and the remaining flush water is stored in the reservoir tank 10.

Further, a vacuum breaker 44 is provided in the water supply passage 50. When the pressure on the second control valve 22 becomes negative, the vacuum breaker 44 restrains backflow of the water to the second control valve 22.

The water supplied from the tap water is supplied to the first control valve 16 and the second control valve 22 via a stop cock 38*a* disposed outside the reservoir tank 10 and a fixed flow valve 38*b* disposed in the reservoir tank 10 on the downstream side of the stop cock 38*a*. The stop cock 38*a* is provided to stop the supply of water to the flush water tank apparatus 4 at the time of maintenance, and is usually used in an opened state. The fixed flow valve 38*b* is provided to allow the water supplied from the tap water to flow into the first control valve 16 and the second control valve 22 at a predetermined flow rate, and is configured to be supplied with the water at a constant flow rate regardless of the installation environment of the flush toilet apparatus 1.

The controller 40 has a built-in CPU and a memory, and controls connected apparatus so as to execute a large washing mode and a small washing mode, which will be described below, based on a predetermined control program recorded in the memory. The controller 40 is electrically connected to the remote controller 6, the human sensor 8, the electromagnetic valve 18, and the electromagnetic valve 24.

The float apparatus 26 will be described below. The float apparatus 26 is provided near the discharge valve 12. The float apparatus 26 is configured such that the valve shaft frame body 12*a* is lifted by a predetermined distance and the valve shaft frame body 12*a* of the discharge valve 12 descends after the valve shaft frame body 12*a* is detached by the clutch mechanism 30 to delay the closing of the water discharge opening 10*a*. Specifically, the float apparatus 26 includes a float part 26*a* and an engaging part 26*b* interlocking with the float part 26*a*. On the other hand, a holding claw 12*g* is formed at a proximal end of the valve shaft frame body 12*a* of the discharge valve 12 to engage with the engaging part 26*b*.

The engaging part 26*b* is configured to engage with the holding claw 12*g* of the valve shaft frame body 12*a* that descends after being detached by the clutch mechanism 30 and to restrain the valve shaft frame body 12*a* and the discharge valve 12 from being seated on the water discharge opening 10*a* by descending. Next, when the float part 26*a* descends as the water level in the reservoir tank 10 drops and the water level in the reservoir tank 10 drops to a predetermined water level, the float part 26*a* rotates the engaging part 26*b* and the engagement of the engaging part 26*b* and the holding claw 12*g* is released. When the engagement is released, the valve shaft frame body 12*a* and the discharge valve 12 descend, and are seated on the water discharge opening 10*a*. Thus, the closing of the discharge valve 12 is delayed, and an appropriate amount of flush water is discharged from the water discharge opening 10*a*.

A configuration and an operation of the clutch mechanism 30 will be described below with reference to FIGS. 8 to 13.

Figure 8:
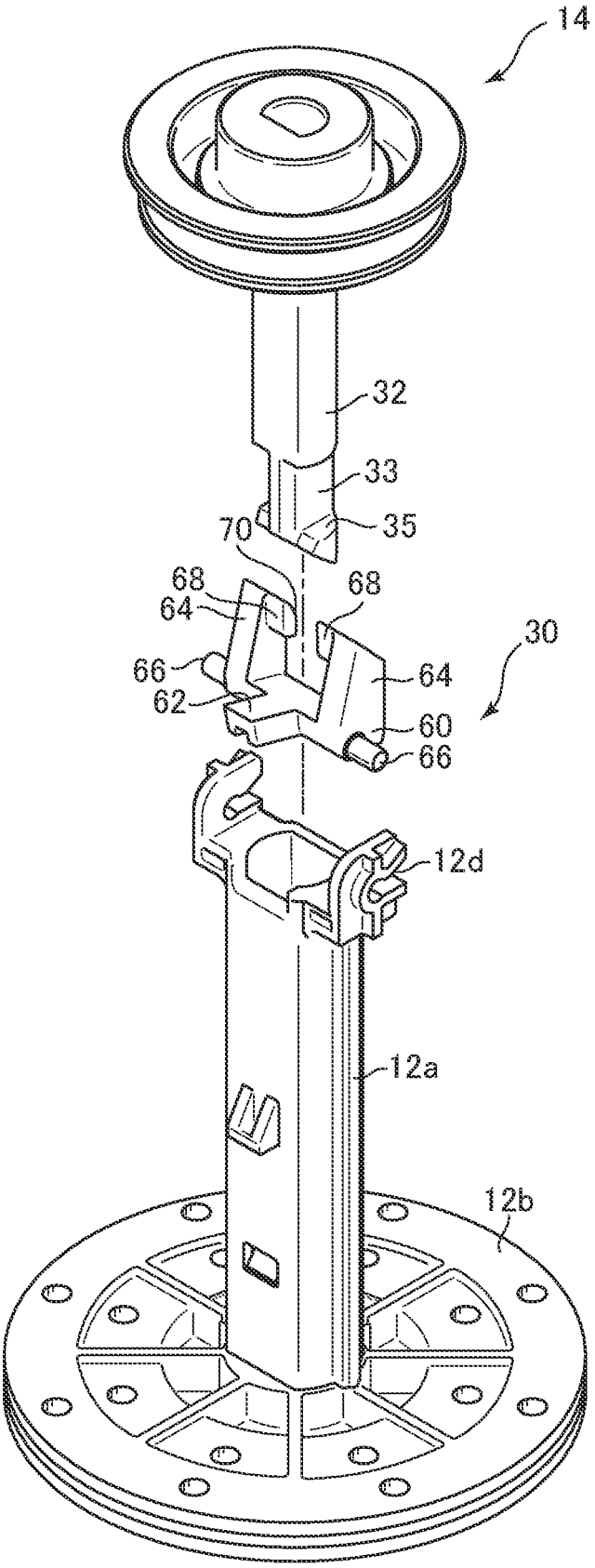
FIG. 8 is an exploded perspective view of the clutch mechanism of the flush water tank apparatus according to the first embodiment of the present invention.
Figure 9:
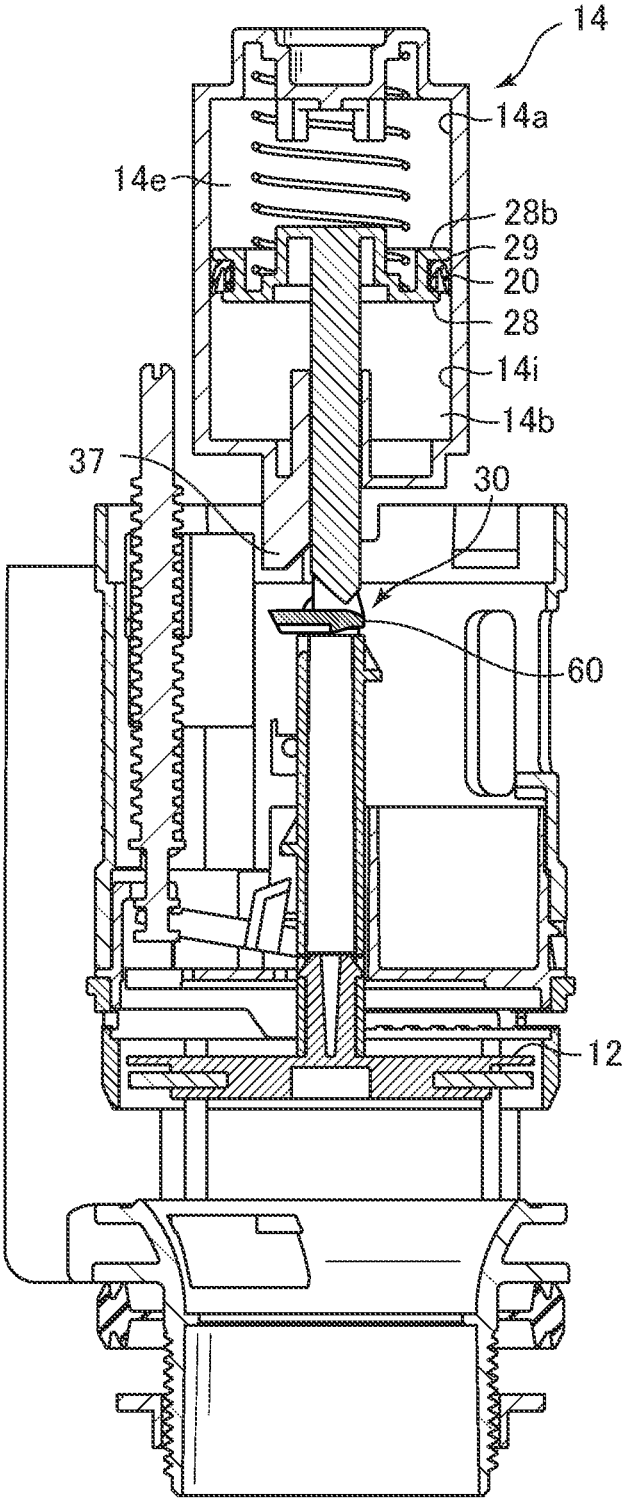
FIG. 9 is a view showing a state where a piston of the discharge valve hydraulic drive portion is ascending in a cross section of the discharge valve hydraulic drive portion of the flush water tank apparatus shown in FIG. 5.

As shown in FIG. 8, the clutch mechanism 30 is provided at the lower end of the rod 32 extending downward from the discharge valve hydraulic drive portion 14 and is configured to couple and release the lower end of the rod 32 and the upper end of the valve shaft frame body 12*a* of the discharge valve 12. The clutch mechanism 30 includes a movable body 60 to uncouple the discharge valve 12 and the discharge valve hydraulic drive portion 14, a thin portion 33 that has an outer shape of the rod 32 formed thinner than the upper portion on the distal end of the rod 32, a pull-up part 35 whose diameter expands again at the lower end of the thin portion 33 of the rod 32, and a regulation part 37 (see FIG. 5) that hangs downward from the bottom surface of the cylinder 14*a* on the outside of the rod 32.

The movable body 60 is provided on the valve shaft frame body 12*a* of the discharge valve 12. The movable body 60 is rotatably attached to the support portion 12*d* of the valve shaft frame body 12*a*. The movable body 60 forms a movable mechanism that operates on the discharge valve side in the state of being attached to the support portion 12*d*. The movable body 60 is configured to switch between an engaging side posture and a non-engaging side posture, which will be described below, by a rotational operation.

The movable body 60 includes a base plate 62 extending laterally, an arm 64 rising vertically from both sides of the base plate, a rotary shaft 66 that is a center of the rotational operation of the movable body 60, and a contact portion 68 coming in contact with the rod 32 of the discharge valve hydraulic drive portion 14 when the rod 32 of the discharge valve hydraulic drive portion 14 attempts to pull up the discharge valve 12.

Figure 10:
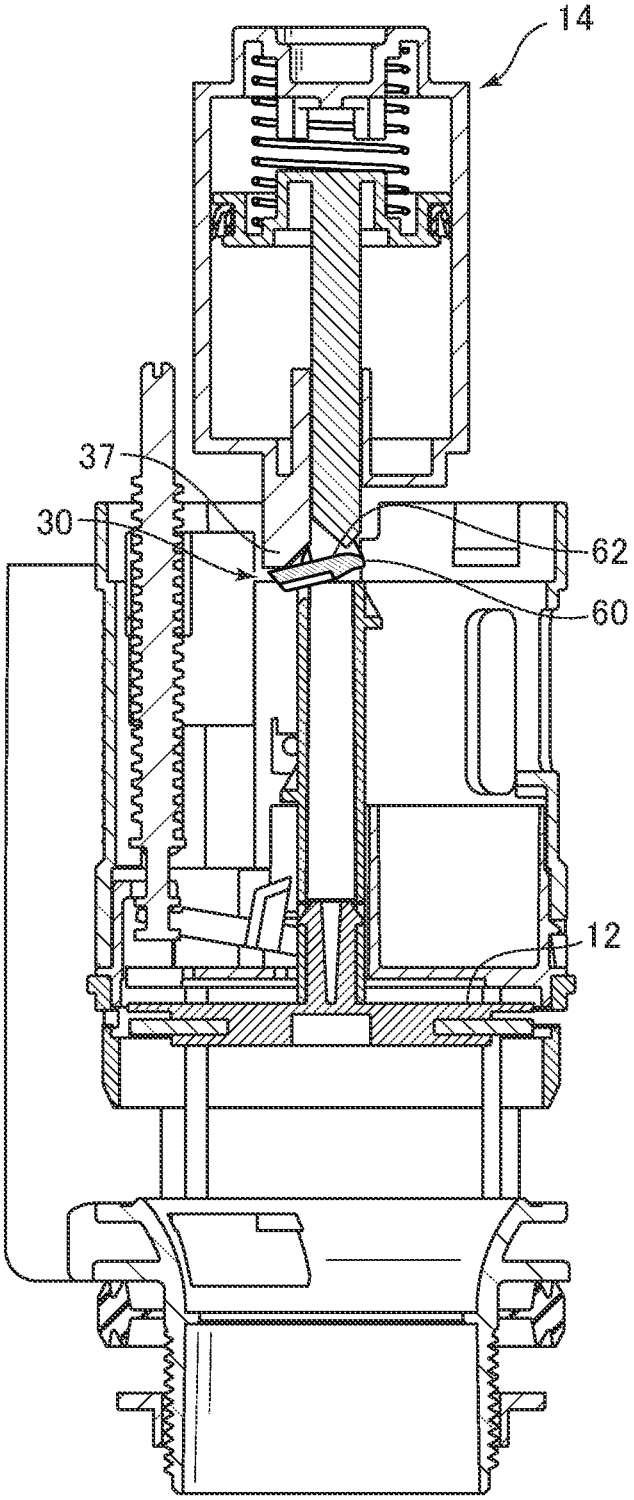
FIG. 10 is a view showing s state when the clutch mechanism is disengaged in the cross section of the discharge valve hydraulic drive portion of the flush water tank apparatus shown in FIG. 5.
Figure 12:
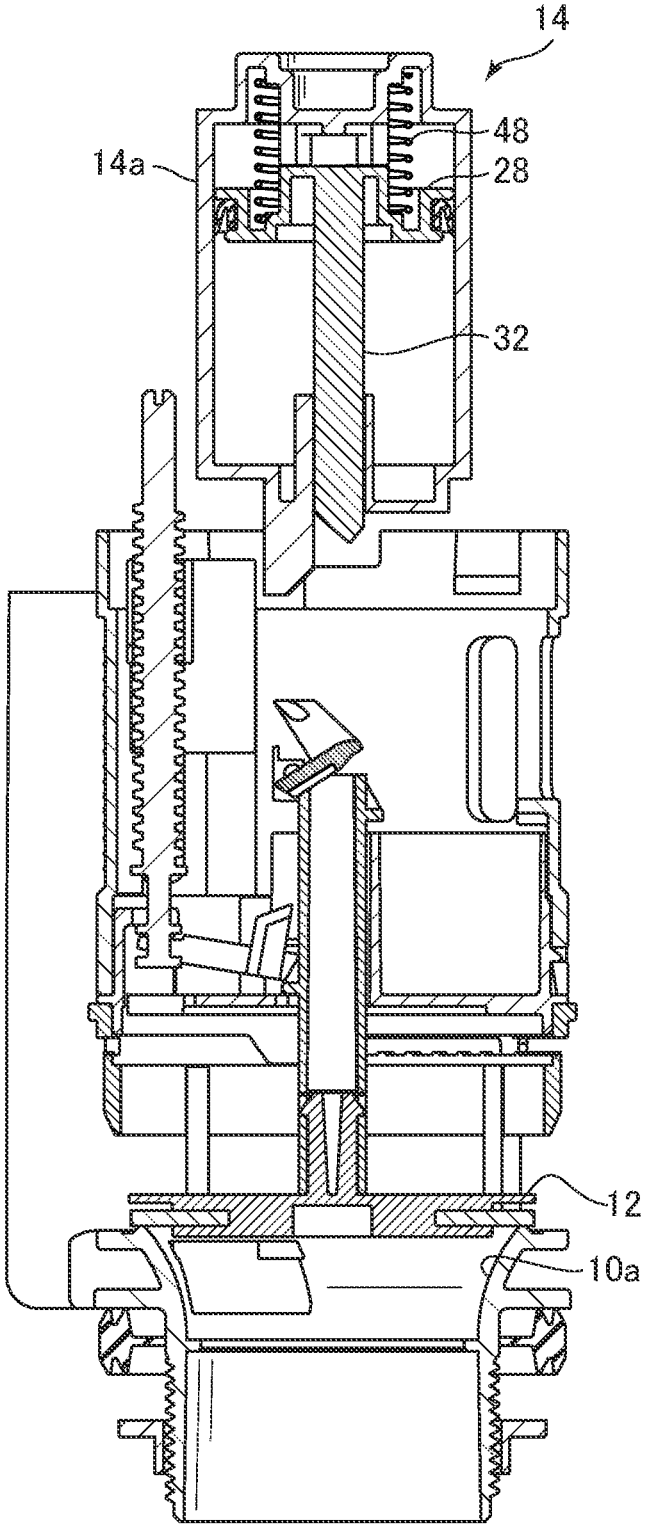
FIG. 12 is a view showing a state where the discharge valve descends and the water discharge opening is closed in the cross section of the discharge valve hydraulic drive portion of the flush water tank apparatus shown in FIG. 5.
Figure 13:
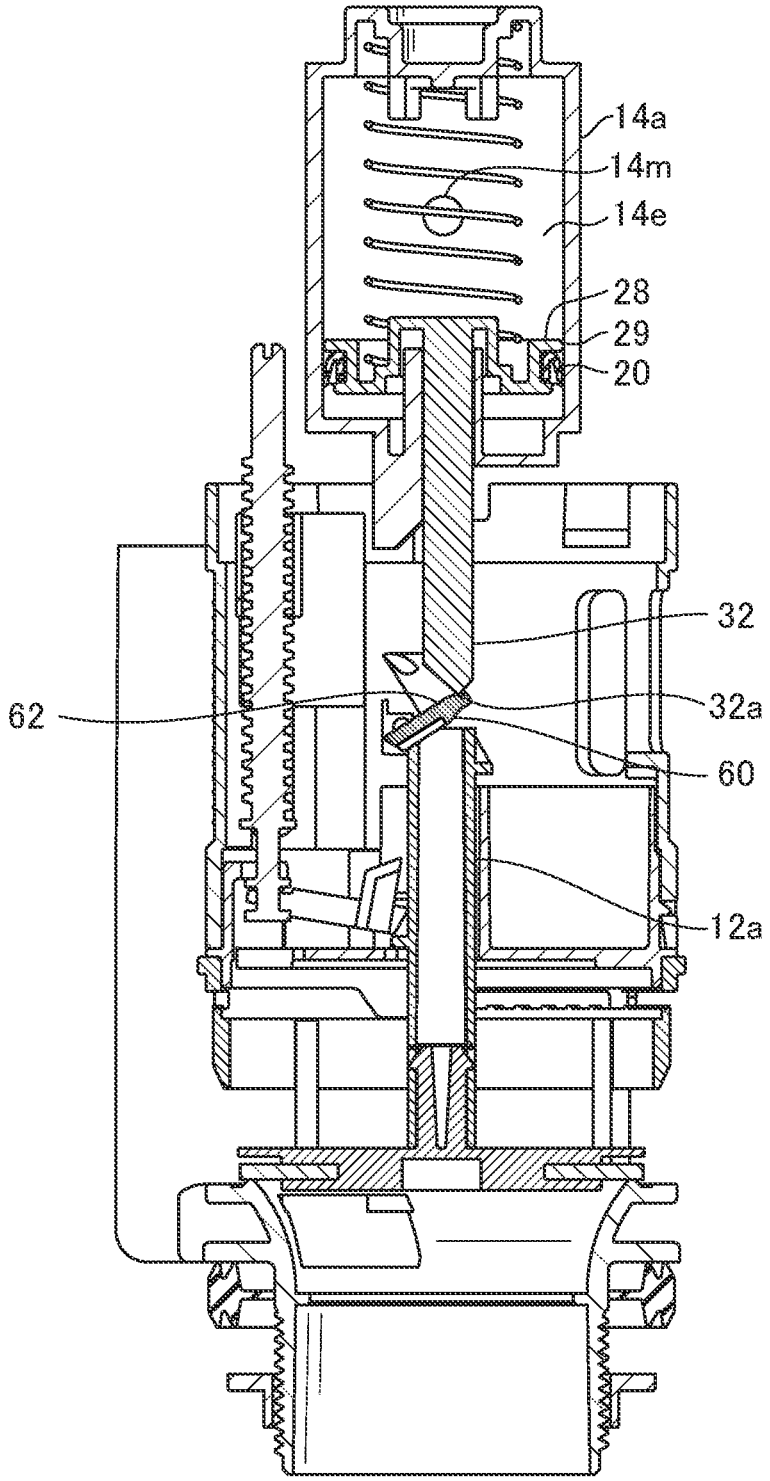
FIG. 13 is a view showing a state where the piston descends and a rod and a movable body attached to the discharge valve come into contact with each other again in the cross section of the discharge valve hydraulic drive portion of the flush water tank apparatus shown in FIG. 5.

The clutch mechanism 30 is configured in which the pull-up part 35 of the rod 32 is located below the contact portion 68 of the movable body 60 in the standby state. The clutch mechanism 30 is configured in which the movable body 60 comes in contact with the pull-up part 35 of the rod 32 and pulls up the valve shaft frame body 12*a* of the discharge valve 12 when the rod 32 is pulled up from the standby state. Further, as shown in FIG. 10, when the rod 32 is pulled up to a predetermined height, the base plate 62 of the clutch mechanism 30 hits the regulation part 37, the movable body 60 rotates, and the clutch mechanism 30 is disengaged. As shown in FIGS. 12 and 13, after the movable body 60 and the discharge valve 12 descend, the rod 32 also descends to return to the standby state of the clutch mechanism 30.

A description will be given below with reference to FIGS. 2 and 6 with respect to the flush water tank apparatus 4 according to the first embodiment of the present invention and a series washing operations of the flush toilet apparatus 1 including the flush water tank apparatus 4.

First, in the standby state of toilet washing shown in FIG. 2, the water level in the reservoir tank 10 is at a predetermined full water level WL, and in this state, both the first control valve 16 and the second control valve 22 are closed. Further, the float apparatus 26 is in a standby state. Next, when a user pushes a washing button of the remote controller 6, the remote controller 6 transmits an instruction signal for the toilet washing to the controller 40. In the flush toilet apparatus 1 of the present embodiment, even when a predetermined time elapses without pushing the washing button of the remote controller 6 after the human sensor 8 detects that the user leaves from the toilet, the instruction signal for the toilet washing is transmitted to the controller 40.

As shown in FIG. 6, in the standby state, the piston 28 of the discharge valve hydraulic drive portion 14 is at the first position H1 in the cylinder 14*a*. The first position H1 of the piston 28 is a lower limit position in a movable range. The piston 28 is stopped in the cylinder 14*a*. At this time, the lower end 20*b* of the packing 20 is located above the full water level WL of the reservoir tank 10. Therefore, the packing 20 is disposed in a region to be directly supplied with the flush water from the tap water so as not to be immersed in the flush water stored in the reservoir tank 10 in which what chemical for the toilet washing such as chlorine is charged by the user is unknown. Therefore, it is possible to restrain the packing 20 from being deteriorated by being immersed in such a chemical.

On the other hand, in the standby state, the residual water level WL3 indicating the remaining flush water is formed in the water storage part 14*j* in the cylinder 14*a*. In the state where the piston 28 is in the standby position being the first position, the packing 20 is immersed and submerged in the flush water remaining in the water storage part 14*j* in the cylinder 14*a*. Thus, it is possible to restrain the packing 20 from drying until being mostly dried, and to restrain the formation of scale (precipitate) in the packing 20 from the tap water by repetition of wetting and drying with the flush water.

In addition, the packing 20 is immersed in the flush water directly supplied from the tap water, unlike the flush water stored in the reservoir tank 10 in which what washing agent for the toilet washing is charged by the user is unknown, thereby the deterioration of the packing 20 due to chlorine such as a toilet washing agent can also be restrained.

A deformation amount of the packing 20 in the state where the piston 28 is at the first position H1 is a maximum deformation amount in deformation amounts of the elastic member at respective positions while the piston 28 moves from the first position H1 to the second position H2. The deformation amount of the packing 20 is determined by an opening width of the U-shaped packing. For example, an opening width W1 (see FIG. 6) of the packing 20 in the state where the piston 28 is at the first position H1 is smaller than an opening width W2 (see FIG. 11) of the packing 20 in the state where the piston 28 is at the second position H2. The opening width W2 of the packing 20 is smaller than an opening width W3 (not shown) of the packing 20 in an initial state where the packing 20 is not housed in the cylinder 14*a*. Further, as the piston 28 moves from the first position H1 to the second position H2, the opening width of the packing 20 gradually increases. As described above, the deformation amount (W3−W1) of the packing 20 in the state where the piston 28 is at the first position H1 is larger than the deformation amount (W3−W2) of the packing 20 in the state where the piston 28 is at the second position H2.

In the standby state where the piston 28 is at the first position H1, the spring 48 is in the most extended state, and the top portion 14*k* of the bank portion 14*h* is in contact with the lower surface portion 28*c*. The piston 28 is urged toward the side of the first position by the spring 48, and is stopped in a state of being in contact with the top portion 14*k*.

In the standby state where the piston 28 is at the first position H1, the cross-sectional area of the flow channel in the second discharge part 14*n* is determined by the cross-sectional area of the flow channel between the rod 32 and the through-hole portion 14*f* and the cross-sectional area of the flow channel between the piston 28 and the through-hole portion 14*f*. The cross-sectional area of the minimum flow channel in the second discharge part 14*n* is the cross-sectional area of the first flow channel 14*o*, and since the top portion 14*k* and the lower surface portion 28*c* are substantially in contact with each other, the pressure loss of the second discharge part 14*n* becomes larger.

Next, upon receiving the instruction signal for the toilet washing, the controller 40 allows the electromagnetic valve 18 (FIG. 2) provided in the first control valve 16 to operate, and allows the pilot valve 16*d* on the electromagnetic valve side to be separated from the pilot valve port. Thus, the pressure in the pressure chamber 16*c* drops, the main valve body 16*a* is separated from the main valve port 16*b*, and the main valve port 16*b* is opened. When the first control valve 16 is opened, the flush water flowing in from the water supply pipe 38 is supplied to the discharge valve hydraulic drive portion 14 via the first control valve 16. Thereby, the piston 28 of the discharge valve hydraulic drive portion 14 is pushed up, the discharge valve 12 is pulled up via the rod 32, and the flush water in the reservoir tank 10 is discharged from the water discharge opening 10*a* to the flush toilet main body 2.

When the discharge valve 12 is pulled up, the holding claw 12*g* provided on the valve shaft frame body 12*a* of the discharge valve 12 pushes up and rotates the engaging part 26*b* of the float apparatus 26, and the holding claw 12*g* ascends beyond the engaging part 26*b*.

After the standby state of the piston 28, for example, when the piston 28 ascends, the flush water flowing into a lower chamber 14*b*, which is located below the piston 28, of the cylinder 14*a* is retained in the lower chamber 14*b* by the packing 20 having a sealing function to generate a force that raises the piston 28. On the other hand, since the piston 28 and the packing 20 move up and down in the cylinder 14*a*, some of the flush water flowing into the lower chamber 14*b* passes through a space between the packing 20 and the inner wall 14*i* of the cylinder 14*a* and leaks into an upper chamber 14*e* located above the piston 28. At this time, since the water passageway gap 29 is formed between the upper outer circumference part 28*b* and the inner wall 14*i*, the upper side of the packing 20 can be more easily immersed in the flush water. Further, the entire upper side of the packing 20 can be easily immersed in the flush water. Therefore, the entire packing 20 including the upper side of the packing 20 is immersed in the flush water. As will be described below, even at the time of descending of the piston 28 after the clutch mechanism 30 is disengaged and in the standby state, the upper side of the packing 20 is easily immersed, by the water passageway gap 29, in the flush water flowing into the upper chamber 14*e*.

Next, as shown in FIG. 10, when the discharge valve 12 is further pulled up, the clutch mechanism 30 is disengaged. In other words, when the discharge valve 12 reaches a predetermined height, the base plate 62 of the clutch mechanism 30 hits the regulation part 37, and the clutch mechanism 30 is disengaged.

Figure 11:
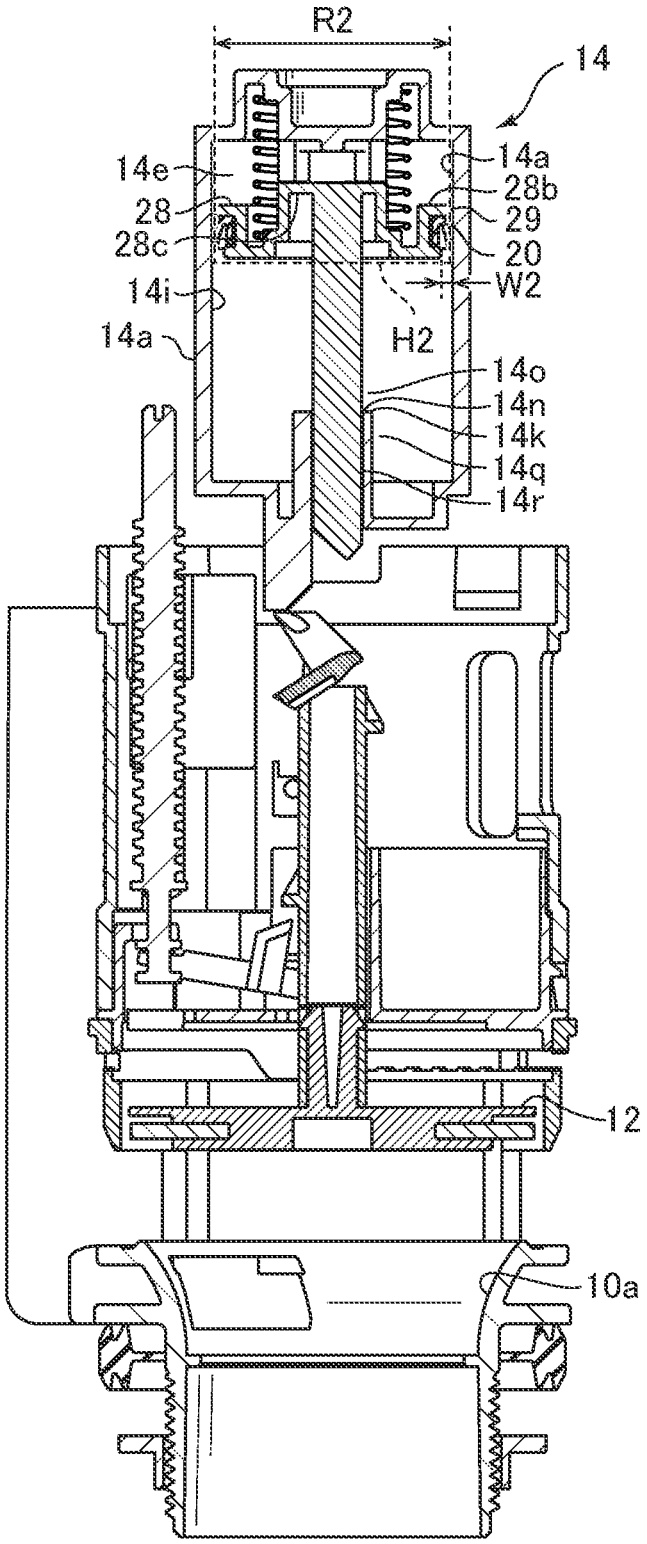
FIG. 11 is a view showing a state where the piston of the discharge valve hydraulic drive portion ascends to a second position in the cross section of the discharge valve hydraulic drive portion of the flush water tank apparatus shown in FIG. 5.

Next, as shown in FIG. 11, when the clutch mechanism 30 is disengaged, the discharge valve 12 starts to descend toward the water discharge opening 10*a* due to its own weight. The holding claw 12*g* of the descending discharge valve 12 engages with the engaging part 26*b* of the float apparatus 26, and the discharge valve 12 is held at a predetermined height by the engaging part 26*b*. When the discharge valve 12 is held by the engaging part 26*b*, the water discharge opening 10*a* is maintained in an open state, and flush water in the reservoir tank 10 is maintained to be discharged to the flush toilet main body 2. At this time, the pilot valve 16*d* is still in the open state, and the flush water flowing in from the water supply pipe 38 is supplied to the discharge valve hydraulic drive portion 14 via the first control valve 16.

When the piston 28 ascends up to the second position higher than the first discharge part 14*m*, the drive part water supply passage 34*a* and the drive part drain passage 34*b* communicate with each other via the inside of the cylinder 14*a*, and the flush water is discharged into the reservoir tank 10 from the discharge part 54.

At this time, the water passageway gap 29 between the upper outer circumference part 28*b* and the inner wall 14*i* is formed to become smaller from the upper side to the lower side of the cylinder 14*a*. In other words, the water passageway gap 29 is formed relatively large above the cylinder 14*a*.

In addition, when the piston 28 is located above the cylinder 14*a*, the flush water is more likely to leak from the space between the packing 20 and the inner wall 14*i* to the upper chamber 14*e*, as compared with the case where the piston 28 is located below the cylinder 14*a*. Thus, some of the flush water leaks from the lower chamber 14*b* to the upper chamber 14*e* on the upper side of the packing 20. Therefore, the entire packing 20 including the upper side of the packing 20 is immersed in the flush water. Further, the opening width of the packing 20 in the state where the piston 28 is at the second position H2 is the opening width W2.

In the second discharge part 14*n* in the state where the piston 28 is at the second position H2, the top portion 14*k* and the lower surface portion 28*c* are separated from each other, the minimum cross-sectional area value of the flow channel of the first flow channel 14*o* increases, and the minimum cross-sectional area value of the flow channel of the second flow channel 14*q* also increases. On the other hand, the minimum cross-sectional area value of the flow channel of the third flow channel 14*r* remains constant. In this way, as the piston 28 ascends toward the second position H2, the top portion 14*k* and the lower surface portion 28*c* are separated from each other, the cross-sectional areas of the flow channels of the first flow channel 14*o* and the second flow channel 14*q* increase, the total cross-sectional area value and the minimum cross-sectional area value of the flow channel in the second discharge part 14*n* increase, and the pressure loss of the second discharge part 14*n* is reduced. In the state where the piston 28 is at the second position H2, the clutch mechanism 30 is disengaged. When the clutch mechanism 30 is disengaged as described above, the minimum cross-sectional area value of the flow channel of the second discharge part 14*n* is a maximum cross-sectional area value of the flow channel within the range of change from the first position H1 to the second position H2 of the piston 28. Therefore, when the clutch mechanism 30 is disengaged, the pressure loss of the second discharge part 14*n* is a minimum pressure loss in the range of change in corresponding pressure loss from the first position H1 to the second position H2 of the piston 28.

Next, when the water level in the reservoir tank 10 drops, the float switch 42 for detecting the water level in the reservoir tank 10 is turned off. When the float switch 42 is turned off, the pilot valve 22*c* provided in the second control valve 22 is opened. Therefore, the flush water is supplied from the second control valve 22 into the reservoir tank 10 via the water supply passage 50. The controller 40 allows the electromagnetic valve 18 to be closed when a predetermined time has elapsed from the opening of the electromagnetic valve 18, and allows the pilot valve 16*d* on the electromagnetic valve side to be closed. The main valve body 16*a* of the first control valve 16 is closed when the pilot valve 16*d* is closed. Even after the pilot valve 16*d* on the electromagnetic valve side is closed, the open state of the second control valve 22 is maintained and the water supply to the reservoir tank 10 is continued. Since the first control valve 16 is closed, the supply of the flush water to the discharge valve hydraulic drive portion 14 and the discharge part 54 is stopped.

In addition, when the water level in the reservoir tank 10 drops up to the predetermined water level WL1, the float part 26*a* of the float apparatus 26 descends, which moves the engaging part 26*b*. Thus, the engagement between the valve shaft frame body 12*a* and the engaging part 26*b* is released, and the valve shaft frame body 12*a* and the discharge valve 12 start to descend again.

Thereby, the discharge valve 12 is seated on the water discharge opening 10*a*, and the water discharge opening 10*a* is closed. After the first control valve 16 is closed and the water supply to the discharge valve hydraulic drive portion 14 is stopped, the flush water in the cylinder 14*a* of the discharge valve hydraulic drive portion 14 gradually flows out from the second discharge part 14*n*, the piston 28 is pushed down by the urging force of the spring 48, and the rod 32 is lowered at the same time.

Thus, as shown in FIG. 13, the distal end 32*a* of the rod 32 comes into contact with the base plate 62, and the movable body 60 is sandwiched and stopped between the valve shaft frame body 12*a* and the rod 32 and returns to the standby state (see FIG. 5) before the start of the toilet washing. In the state where the piston 28 returns to the standby state of the first position H1 again, some of the flush water leaks into the upper chamber 14*e* on the upper side of the piston 28. Since the water passageway gap 29 is formed to become smaller from the upper side to the lower side of the cylinder 14*a*, when the piston 28 is at the first position H1, the flush water on the upper side of the packing 20 hardly passes downward from the water passageway gap 29. Thus, the flush water can be easily maintained in upper chamber 14*e*, and the upper side of the packing 20 can be more easily immersed in the flush water. Therefore, the entire packing 20 including the upper side of the packing 20 is immersed in the flush water.

Since the float switch 42 is still in the off state, the open state of the second control valve 22 is maintained, and the water supply to the reservoir tank 10 is continued. The flush water supplied through the water supply passage 50 reaches the water supply passage branch portion 50*a*, some of the flush water branched at the water supply passage branch portion 50*a* flows into the overflow pipe 10*b*, and the remaining flush water is stored in the reservoir tank 10. The flush water flowing into the overflow pipe 10*b* flows into the flush toilet main body 2, and is used to refill the bowl 2*a*. On the other hand, the water level in the reservoir tank 10 rises due to the flush water flowing into the reservoir tank 10 in the state where the discharge valve 12 is closed.

When the water level in the reservoir tank 10 rises to the predetermined full water level WL, the float switch 42 is turned on. When the float switch 42 is turned on, the pilot valve 22*c* on the float switch side is closed. Thereby, since the pilot valve 22*c* is closed, the pressure in the pressure chamber 22*b* increases, the main valve body 22*a* of the second control valve 22 is closed, and the water supply is stopped. Therefore, as shown in FIG. 2, the apparatus in the reservoir tank 10 returns to the standby state.

According to the flush water tank apparatus 4 of the first embodiment of the present invention described above, the cylinder 14*a* includes the inlet 14*l* into which the flush water flows, the first discharge part 14*m* provided separately from the inlet 14*l* to cause the flush water to drain, and the second discharge part 14*n* provided separately from the first discharge part 14*m* and formed between the rod 32 and the through-hole portion 14*f*. Thereby, when the water supply pressure of the flush water to the cylinder 14*a* suddenly fluctuates, for example, suddenly rises in the state where the flow channel is not communicated or is communicated from the inlet 14*l* to the first discharge part 14*m* in the cylinder 14*a*, the second discharge part 14*n* can soften the impact of the sudden fluctuation in the pressure of the flush water, the piston 28 can buffer the impact applied from the flush water, and the unstable operation of the piston 28 can be restrained. Further, when the water supply pressure of the flush water to the cylinder 14*a* suddenly fluctuates, for example, suddenly rises in the state where the flow channel is communicated from the inlet 14*l* to the first discharge part 14*m* in the cylinder 14*a*, the second discharge part 14*n* can soften the impact of the sudden fluctuation in the pressure of the flush water, and thus can restrain the fluctuation in the pressure of the flush water drained from the first discharge part 14*m*. Thereby, it is possible to restrain the flush water drained to the downstream side of the first discharge part 14*m* from becoming unstable. For example, even when the flush water is used on the downstream side of the first discharge part 14*m*, it is possible to restrain the supply of the flush water from becoming unstable.

Further, according to the flush water tank apparatus 4 of the first embodiment of the present invention, the deformation amount of the packing 20 in the state where the piston 28 is at the first position H1 is the maximum deformation amount in deformation amounts of the packing 20 at respective positions while the piston 28 moves from the first position H1 to the second position H2. Thereby, when the piston 28 is located at the first position H1, which is the position at the start of the water supply that is most susceptible to fluctuations in the water supply pressure of the flush water due to the water supply, the deformation amount of the packing 20 is the maximum deformation amount, and the force supporting the piston 28 is also maximum. Thus, it is possible to restrain the piston 28 from tilting due to the fluctuation of the water supply pressure and to restrain the operation of the piston 28 from becoming unstable.

Further, according to the flush water tank apparatus 4 of the first embodiment of the present invention, the inner diameter of the cylinder 14*a* at the portion corresponding to the first position H1 of the piston 28 is the minimum inner diameter of the cylinder 14*a*. Thereby, when the piston 28 is located at the first position H1, the deformation amount of the packing 20 is the maximum deformation amount, and the force supporting the piston 28 is also the maximum supporting force among supporting forces at respective positions, so that it is possible to restrain the piston 28 from tilting due to the fluctuations of the water supply pressure and to restrain the operation of the piston 28 from becoming unstable with a relatively simple configuration.

Further, according to the flush water tank apparatus 4 of the first embodiment of the present invention, the discharge valve hydraulic drive portion 14 further includes the spring 48 provided in the cylinder 14*a* and urging the piston 28 toward the side of the first position H1. Thereby, the spring 48 enables the buffering operation of the piston 28 and can restrain the unstable operation of the piston 28. Further, even when the force stabilizing the piston 28 is reduced in the state where the piston 28 is at the first position H1 and the spring 48 is stretched, the deformation amount of the packing 20 is the maximum deformation amount among the deformation amounts at respective positions, and the force supporting the piston 28 is also the maximum supporting force among supporting forces at respective positions, so that the reduction in the stabilizing force of the spring 48 can be compensated by the supporting force of the packing 20 and the operation of the piston 28 can be stabilized.

Further, according to the flush water tank apparatus 4 of the first embodiment of the present invention, as the piston 28 moves from the first position H1 to the second position H2, the cross-sectional area of the flow channel in the second discharge part 14*n* increases and the pressure loss of the second discharge part 14*n* is reduced. Thereby, the pressure loss of the second discharge part 14*n* is set to the maximum in the initial stage when the supply of the flush water into the cylinder 14*a* is started, the water supply pressure of the flush water is difficult to escape toward the side of the second discharge part 14*n*, and the water supply pressure of the flush water can be effectively used to raise the piston 28.

Further, according to the flush water tank apparatus 4 of the first embodiment of the present invention, the second discharge part 14*n* is formed such that as the piston 28 moves from the first position H1 to the second position H2, the cross-sectional area of the flow channel of the second discharge part 14*n* between the rod 32 and the inner wall of the through-hole portion 14*f* increases and the pressure loss of the second discharge part 14*n* is reduced. Thereby, the pressure loss of the second discharge part 14*n* is set to the maximum in the initial stage when the supply of the flush water into the cylinder 14*a*, in which the piston 28 is at the first position H1, is started, the water supply pressure of the flush water is difficult to escape toward the side of the second discharge part 14*n*, and the water supply pressure of the flush water can be effectively used to raise the piston 28. Further, when the piston 28 reaches the second position H2, the pressure loss of the second discharge part 14*n* is set to be relatively low, the flush water in the cylinder 14*a* can easily flow out from the second discharge part 14*n*, and the impact generated in the flush water in the cylinder 14*a* can be softened.

Further, according to the flush water tank apparatus 4 of the first embodiment of the present invention, in the state where the piston 28 is in the first position H1, the second discharge part 14*n* includes the first flow channel 14*o* extending laterally between the top portion 14*k* of the bank portion 14*h* and the piston 28, and the second flow channel 14*q* formed between an outer wall portion 14*p* of the bank portion 14*h* and the piston 28 and bending downward and extending from the first flow channel 14*o*. Thereby, the pressure loss of the second discharge part 14*n* is set to the maximum in the initial stage when the supply of the flush water into the cylinder 14*a*, in which the piston 28 is at the first position H1, is started, the water supply pressure of the flush water is difficult to escape toward the side of the second discharge part 14*n*, and the water supply pressure of the flush water can be effectively used to raise the piston 28.

Further, according to the flush water tank apparatus 4 of the first embodiment of the present invention, the impact is transmitted to the piston 28 through the rod 32 from the clutch mechanism 30 when the clutch mechanism 30 is disengaged. At this time, the cross-sectional area of the flow channel of the second discharge part 14*n* is the maximum cross-sectional area among the cross-sectional areas of the flow channel of the second discharge part 14*n* at respective positions while the piston 28 moves from the first position H1 to the second position H2, and the piston 28 is easy to move. Thus, the impact transmitted to the piston 28 can be easily released, the operation of the piston 28 can be stabilized, and the generation of abnormal noise due to the impact transmitted to the piston 28 can be restrained.

Further, according to the flush water tank apparatus 4 of the first embodiment of the present invention, the center axis G1 of the rod 32 and the center axis G2 of the through-hole portion 14*f* are located on the same axis as the center axis G3 of the cylinder 14*a*. Thereby, a force is applied to the piston 28 in the cylinder 14*a* relatively uniformly in a circumferential direction, and the rod 32 can be restrained from tilting with respect to the center axis G3 of the cylinder 14*a* when the rod 32 moves up and down. At the same time, even when the piston 28 buffers the impact applied from the flush water, the tilting of the rod 32 can be restrained.

Further, according to the flush water tank apparatus 4 of the first embodiment of the present invention, the through-hole portion 14*f* further includes the flow straightening portion 14*s* formed such that the diameter of the inner wall at the top portion 14*k* is constant in the moving direction of the rod 32. Thus, the turbulence of the flow of the flush water passing through the flow straightening portion 14*s* can be restrained, the flush water can be drained relatively uniformly in the circumferential direction, and the rod 32 can be restrained from tilting.

Further, according to the flush water tank apparatus 4 of the first embodiment of the present invention, the maximum outer diameter of the rod 32 is smaller than the minimum inner diameter of the through-hole portion 14*f*. Thereby, the rod 32 can be inserted into the through-hole portion 14*f* from the upper side of the through-hole portion 14*f* to assemble the discharge valve hydraulic drive portion 14. Further, it is possible to restrain the flush water flowing out from the second discharge part 14*n* formed between the rod 32 and the through-hole portion 14*f* from colliding with the outside of the rod 32 after the outflow and to restrain the rod 32 from deviating from the originally planned center axis. At the same time, it is possible to restrain the flush water from colliding with other apparatus and destabilizing the operation of the other apparatus due to the scattering of the flush water colliding with the outside of the rod 32.

Further, the first embodiment of the present invention relates to the flush toilet apparatus 1 including the flush toilet main body 2 and the flush water tank apparatus 4 which can restrain the operation of the piston 28 from becoming unstable and can restrain the fluctuations in the pressure of the flush water drained from the first discharge part 14*m* provided separately from the inlet 14*l*.

According to the flush water tank apparatus 4 of the first embodiment of the present invention described above, when the piston 28 is at the first position, the lower end of the packing 20 is located above the full water level WL of the reservoir tank 10. Thereby, it is possible to restrain the packing 20 from being immersed in the flush water stored in the reservoir tank 10 in which what chemical for the toilet washing such as chlorine is charged by the user is unknown, and to restrain the packing 20 from being deteriorated by the immersion. Therefore, it is possible to reduce the possibility that the discharge valve hydraulic drive portion 14 malfunctions.

Further, according to the flush water tank apparatus 4 of the first embodiment of the present invention, the cylinder 14*a* of the discharge valve hydraulic drive portion 14 is configured such that the packing 20 is immersed in the flush water remaining in the cylinder 14*a* in the state where the piston 28 is at the first position H1. Thereby, it is possible to restrain the formation of scale (precipitate) in the packing 20 from the tap water by repetition of wetting and drying with the flush water and to restrain the deterioration of the packing 20 by the immersion in the flush water stored in the reservoir tank 10. Therefore, the deterioration of the packing 20 can be restrained while the formation of the scale on the packing 20 can be restrained. On the other hand, when the packing 20 is to be submerged in the flush water in the reservoir tank 10 in order to restrain the formation of the scale, it is necessary to dispose the packing 20 on the bottom surface side below the dead water level which is the lower limit of the water level of the reservoir tank 10 in order to submerge the packing 20 regardless of the change in the water level of the flush water in the reservoir tank 10, and the degree of freedom in arrangement of the piston 28 and the cylinder 14*a* accompanied by the arrangement of the packing 20. Thereby, according to the first embodiment of the present invention, it is possible to restrain the occurrence of such a problem that the degree of freedom in arrangement is impaired while restraining the formation of the scale, and the packing 20 can be disposed relatively freely.

Further, according to the flush water tank apparatus 4 of the first embodiment of the present invention, the upper end of the packing 20 is located at the position lower than the top portion 14*k* of the bank portion 14*h* such that the packing 20 is located in the water storage part 14*j* in the state where the piston 28 is at the first position H1. Therefore, with a relatively simple configuration, it is possible to restrain the formation of scale (precipitate) in the packing 20 from the tap water by repetition of wetting and drying with the flush water and to restrain the deterioration of the packing 20 by the immersion in the flush water stored in the reservoir tank 10. Therefore, the deterioration of the packing 20 can be restrained while the formation of the scale on the packing 20 can be restrained.

Further, according to the flush water tank apparatus 4 of the first embodiment of the present invention, the top portion 14*k* of the bank portion 14*h* is in contact with the lower surface portion 28*c* of the piston 28 in the state where the piston 28 is at the first position H1. Thereby, the outflow of the flush water in the water storage part 14*j* can be restrained, and the state where the packing 20 is immersed in the flush water can be easily maintained.

Further, according to the flush water tank apparatus 4 of the first embodiment of the present invention, the bank portion 14*h* of the cylinder 14*a* is formed in the annular shape around the rod 32 in a top view and the top portion 14*k* of the bank portion 14*h* is in contact with the lower surface portion 28*c* of the piston 28 in the state where the piston 28 is at the first position H1. Thereby, the outflow of the flush water in the water storage part 14*j* can be further restrained, and the state where the packing 20 is immersed in the flush water can be more easily maintained.

Further, according to the flush water tank apparatus 4 of the first embodiment of the present invention, the discharge valve hydraulic drive portion 14 further includes the spring 48 that is provided in the cylinder 14*a* and urges the piston 28 toward the side of the first position H1. In the state where the piston 28 is at the first position H1, the contact between the top portion 14*k* of the bank portion 14*h* and the lower surface portion 28*c* of the piston 28 can be more easily maintained. Thereby, it is possible to further restrain the outflow of the flush water in the water storage part 14*j* and to maintain the state where the packing 20 is immersed in the flush water more easily. In addition, the piston 28 of the discharge valve hydraulic drive portion 14 includes the force receiving part 28*a* that receives the urging force from the spring 48, and the force receiving part 28*a* is formed outside the bank portion 14*h* in a top view. Thereby, the force receiving part 28*a* of the piston 28 can more reliably receive the urging force from the spring 48, the outflow of the flush water in the water storage part 14*j* can be further restrained, and the state where the packing 20 is immersed in the flush water can be more easily maintained.

Further, according to the flush water tank apparatus 4 of the first embodiment of the present invention, the force receiving part 28*a* of the piston 28 in the discharge valve hydraulic drive portion 14 is located below the top portion 14*k* of the bank portion 14*h* in the state where the piston 28 is at the first position H1. Thereby, when the piston 28 receives the urging force from the spring 48, the force receiving part 28*a* receiving the urging force as a force point is located below the top portion 14*k* of the bank portion 14*h* that functions as a fulcrum. Therefore, when the force receiving part 28*a* of the piston 28 receives the urging force, the piston 28 is less likely to tilt in a biased direction with respect to the top portion 14*k* of the bank portion 14*h*, and the operation of the piston 28 can be made more stable. Accordingly, the outflow of the flush water in the water storage part 14*j* can be stably restrained, and the state where the packing 20 is immersed in the flush water can be stably maintained.

Further, according to the flush water tank apparatus 4 of the first embodiment of the present invention, the piston 28 of the discharge valve hydraulic drive portion 14 further includes the upper outer circumference part 28*b* formed on the upper side of the packing 20, and the water passageway gap 29 is formed between the upper outer circumference part 28*b* and the inner wall of the cylinder 14*a*, the flush water passing through the water passageway gap. Thereby, the upper side of the packing 20 can be more easily immersed in the flush water.

Further, according to the flush water tank apparatus 4 of the first embodiment of the present invention, the water passageway gap 29 is formed between the upper outer circumference part 28*b* and the inner wall of the cylinder 14*a* to be gradually smaller from the upper side to the lower side of the cylinder 14*a*. Thereby, as the piston 28 moves from the upper side to the lower side of the cylinder 14*a*, the water passageway gap 29 formed between the upper outer circumference part 28*b* and the inner wall of the cylinder 14*a* becomes smaller, the flush water on the upper side of the packing 20 can hardly exit from the water passageway gap 29, and the upper side of the packing 20 can be more easily immersed in the flush water.

Further, the first embodiment of the present invention relates to the flush toilet apparatus 1 including the flush toilet main body 2 and the flush water tank apparatus 4 that can reduce the possibility that the operation of the discharge valve hydraulic drive portion 14 malfunctions.

A flush toilet apparatus according to a second embodiment of the present invention will be described below with reference to FIGS. 14 to 20.

Since a flush toilet apparatus 101 according to the second embodiment has substantially the same structure as the flush toilet apparatus according to the first embodiment described above, differences between the second embodiment and the first embodiment of the present invention will be mainly described, and similar parts will be described using the same reference numerals in the drawings or the specification, or will not be described.

The flush toilet apparatus 101 according to the second embodiment of the present invention includes a flush water tank apparatus 104, which is mounted on the rear portion of the flush toilet main body 2, according to the second embodiment of the present invention. The flush water tank apparatus 104 according to the second embodiment of the present invention is configured to drain flush water stored therein to the flush toilet main body 2 based on an instruction signal from the remote controller 6 or the human sensor 8 and to wash the bowl 2*a* with the flush water.

The flush water tank apparatus 104 includes a discharge valve hydraulic drive portion 114 that is a discharge valve pull-up part configured to pull up the discharge valve 12. Further, the flush water tank apparatus 104 includes therein a first control valve 16 that is a water supply controller configured to control water supply to the discharge valve hydraulic drive portion 114 from tap water and an electromagnetic valve 18 attached to the first control valve 16. Further, the flush water tank apparatus 104 includes a float apparatus 26 that is a valve controller and a timing control mechanism configured to hold the pulled-up discharge valve 12 at a predetermined position.

The flush water tank apparatus 104 further includes a clutch mechanism 130 that connects the discharge valve 12 and discharge valve hydraulic drive portion 114 to pull up the discharge valve 12 using a driving force of the discharge valve hydraulic drive portion 114 and is disengaged at a predetermined timing so that the discharge valve 12 descends. The clutch mechanism 130 is provided in front in a moving direction of a second rod 133 extending laterally from the discharge valve hydraulic drive portion 114 and is configured to couple and release an operating part 133*a* of the second rod 133 to/from a passive part 176 of the clutch mechanism 130 coupled to the discharge valve 12. The clutch mechanism 130 is formed separately from a casing 113 of the discharge valve 12 and is disposed apart from the outside of the casing 113.

The clutch mechanism 130 includes the operating part 133*a* located at a distal end of the second rod 133, the passive part 176 provided on an extension line in the moving direction of the second rod 133 extending laterally from the discharge valve hydraulic drive portion 114, an elastic member 178 for the passive part connected to the passive part 176, a first support body 180 that supports the passive part 176 and the elastic member 178 for the passive part, an elastic member 182 for the support body connected to the first support body 180, a second support body 184 that supports the elastic member 182 for the support body, and a regulation part 186 that regulates movement of the passive part 176 in the moving direction of the second rod 133 and moves the passive part 176 toward the side of the elastic member 178 for the passive part.

The operating part 133*a* is formed to come into contact with a first flat surface 176*a* of the passive part 176. The first flat surface 176*a* extends in a direction orthogonal to the moving direction of the second rod 133. Therefore, the first flat surface 176*a* is located in front of the operating part 133*a* in a state where the elastic member 178 for the passive part has a natural length. Accordingly, when the second rod 133 moves toward the passive part 176, the operating part 133*a* of the second rod 133 presses the first flat surface 176*a*, and both the second rod 133 and the passive part 176 move laterally. As the passive part 176 and the first support body 180 move, the discharge valve 12 is pulled up by a couple member 188 as will be described below. An expansion direction of the elastic member 182 for the support body is a lateral direction, for example, the moving direction of the second rod 133. The first support body 180 is connected to the elastic member 182 for the support body and moves in the expansion direction of the elastic member 182 for the support body.

The passive part 176 forms an inclined surface 176*b* on an opposite side of the first flat surface 176*a*. When the passive part 176 moves toward the regulation part 186, the inclined surface 176*b* comes into contact with the regulation part 186, so that the inclined surface 176*b* is pressed and moved toward the side of the elastic member 178 for the passive part. Therefore, the contact between the second rod 133 and the passive part 176 is released and the clutch mechanism 130 is released from the coupling. The passive part 176 is movable to disengage the coupling of the clutch mechanism 130. At this time, the elastic member 178 for the passive part is in a state of being contracted from its natural length. The expansion direction of the elastic member 178 for the passive part is a vertical direction, for example, a direction orthogonal to the moving direction of the second rod 133. The elastic member 178 for the passive part is formed of an elastic member such as a spring.

The first support body 180 and the passive part 176 move toward the side of the discharge valve hydraulic drive portion 114 (toward the side of the discharge valve 12) to return to the original natural length position by the elastic member 182 for the support body. Therefore, when the contact between the second rod 133 and the passive part 176 is released, the discharge valve 12 is in a free fall state. The elastic member 182 for the support body is formed of an elastic member such as a spring.

The second support body 184 is fixed to the reservoir tank 10. The second support body 184 is connected to the regulation part 186. The regulation part 186 is formed to be in contact with the inclined surface 176*b* of the passive part 176. The regulation part 186 is disposed in the moving direction of the passive part 176. The regulation part 186 is formed to move the passive part 176 so as to deviate from the second rod 133 such that the contact between the first flat surface 176*a* and the second rod 133 is released.

The first support body 180 and the upper end of the valve shaft frame body 12*a* of the discharge valve 12 are connected to each other by a couple member 188. The couple member 188 is a wire or a bead chain, for example. Therefore, when the first support body 180 is pressed by the second rod 133 and separated from the discharge valve 12, the discharge valve 12 is physically pulled up by the couple member 188. The couple member 188 has flexibility. The couple member 188 is disposed in a couple member conduit 189 curved between the first support body 180 and the discharge valve 12. The couple member conduit 189 forms a pipe-shaped passage that guides the couple member 188.

The casing 113 is formed above the discharge valve 12 to house the discharge valve 12 therein and is formed in a cylindrical shape with an opening on a lower side. The casing 113 is formed separately from the discharge valve hydraulic drive portion 114 and the clutch mechanism 130, and is also disposed separately from the discharge valve hydraulic drive portion 114. The casing 113 is fixed to the reservoir tank 10. The casing 113 is an independently disposed casing that is disposed independently of the discharge valve hydraulic drive portion 114.

The discharge valve 12 is pulled up by a driving force of the discharge valve hydraulic drive portion 114, the clutch mechanism 130 is disengaged at a predetermined timing when the discharge valve 12 is pulled up to a predetermined height, and the discharge valve 12 descends by its own weight. When the discharge valve 12 descends, the discharge valve 12 is held by the float apparatus 26 for a predetermined time, and a time until the discharge valve 12 is seated on the water discharge opening 10*a* is adjusted.

The discharge valve hydraulic drive portion 114 will be described below with reference to FIGS. 14 to 20.

Figure 14:
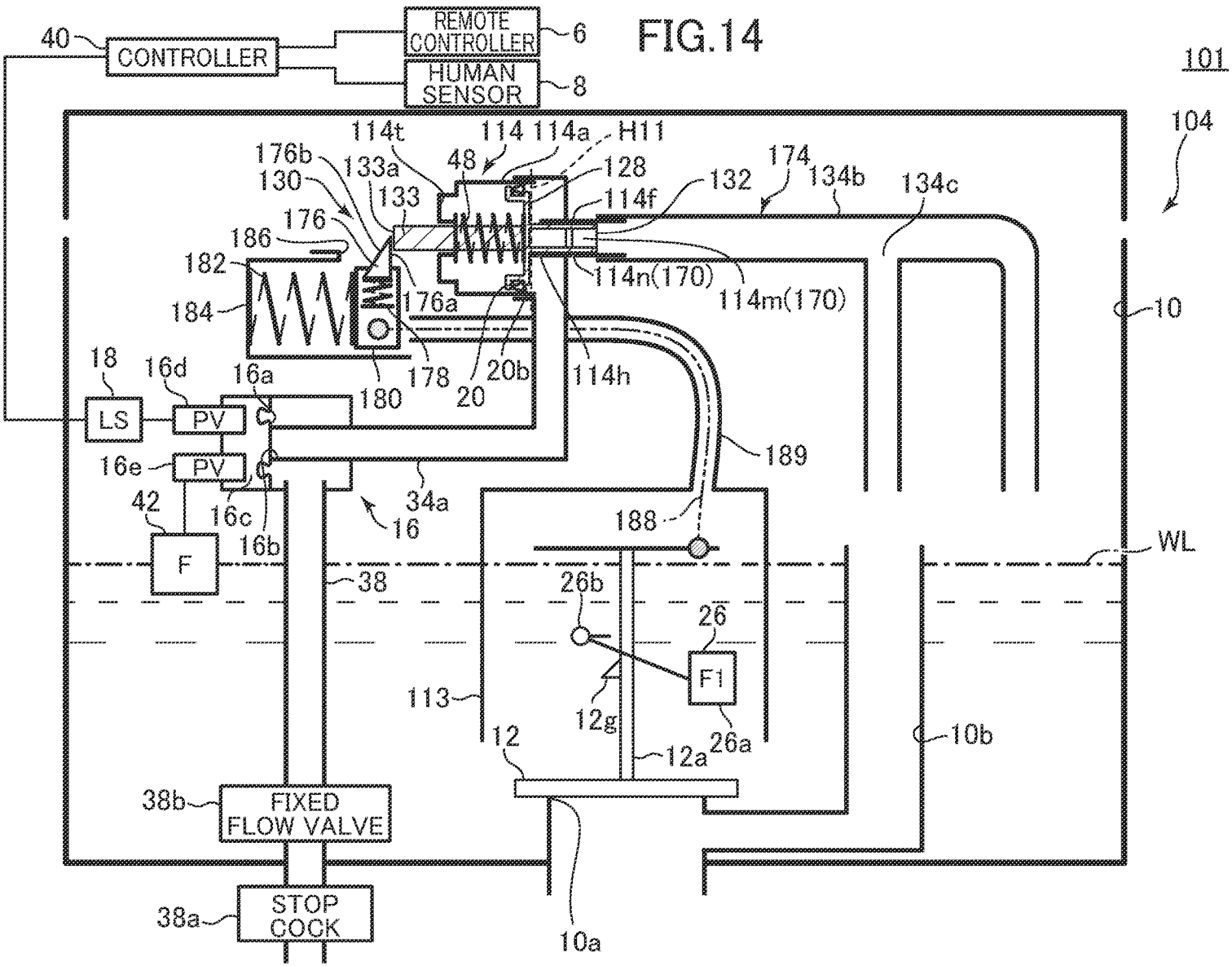
FIG. 14 is a cross-sectional view showing a schematic configuration of a flush water tank apparatus according to a second embodiment of the present invention.
Figure 15:
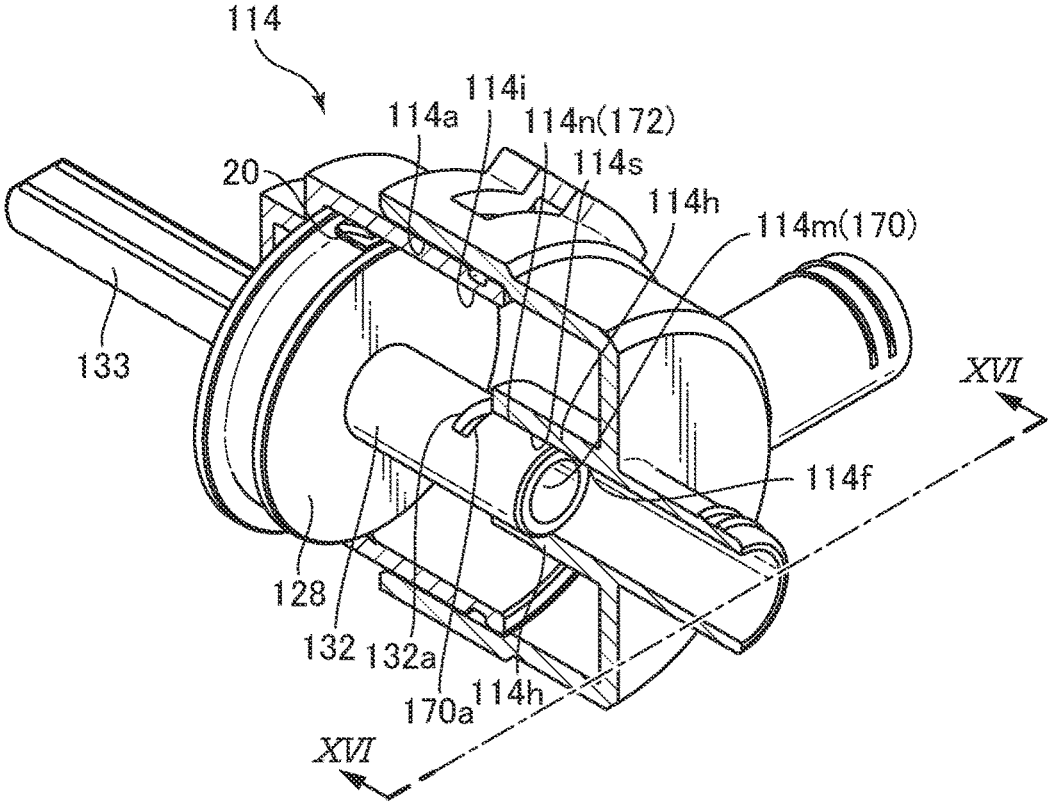
FIG. 15 is a partially enlarged perspective view of a discharge valve hydraulic drive portion of the flush water tank apparatus shown in FIG. 14.

As shown in FIG. 14 and the like, the discharge valve hydraulic drive portion 114 is configured to drive the discharge valve 12 using a water supply pressure of the flush water supplied from the tap water. The discharge valve hydraulic drive portion 114 includes a cylinder 114*a* to which the tap water supplied from the first control valve 16 is supplied as flush water, a piston 128 slidably disposed in the cylinder 114*a*, a first rod 132 extending through a first through-hole portion 114*f*, which is formed in the cylinder 114*a*, from the piston 128, and a second rod 133 extending through a second through-hole portion 114*q*, which is formed in the cylinder 114*a*, from the piston 128. The discharge valve hydraulic drive portion 114 is formed of resin.

A spring 48, which is an urging member, is disposed inside the cylinder 114*a* to urge the piston 128 toward the side of a first position H11.

The cylinder 114*a* forms a horizontal cylinder that is oriented in a horizontal direction. The cylinder 114*a* accepts the piston 128 in a slidable manner in a lateral direction. An axis of the cylinder 114*a* extends in the horizontal direction.

The first through-hole portion 114*f* is formed on a side wall of the cylinder 114*a* on a first position side. The first through-hole portion 114*f* includes a bank portion 114*h* that rises toward the inside of the cylinder from a peripheral portion of a through hole formed in the side wall of the cylinder 114*a*, and a flow straightening portion 114*s* formed such that a diameter of an inner wall at a top portion is substantially constant in the moving direction of the first rod 132. The bank portion 114*h* is formed in an annular shape around the first rod 132 in a top view. The flow straightening portion 114*s* is formed from the top portion of the bank portion 114*h* to a downstream side by a predetermined distance. The flow straightening portion 114*s* forms a horizontal wall extending in the horizontal direction. The flow straightening portion 114*s* extends substantially parallel to an outer wall of the first rod 132, and forms a flow channel having a substantially constant width between the flow straightening portion 114*s* and the first rod 132. Thereby, it is possible to restrain turbulence of the flow of the flush water passing between the flow straightening portion 114*s* and the first rod 132.

The discharge valve hydraulic drive portion 114 further includes an inlet 114*l* that is formed in the cylinder 114*a* and into which the flush water flows, a first discharge part 114*m* provided separately from the inlet 114*l* to cause the flush water to drain from the inside of the cylinder 114*a*, and a second discharge part 114*n* provided separately from the first discharge part 114*m* and formed between the first rod 132 and the first through-hole portion 114*f* and between the piston 128 and the first through-hole portion 114*f*.

The inlet 114*l* is connected to the drive part water supply passage 34*a*. The inlet 114*l* is connected to a portion of the cylinder 114*a* on an upstream side of the first position H11. The inlet 114*l* forms a flow channel communicating with an upstream side of the piston 128. The flush water flowing out from the first control valve 16 flows into the cylinder 114*a* from the inlet 114*l*. The flush water flows into the cylinder 114*a* using the water supply pressure of the tap water. Therefore, the piston 128 in the cylinder 114*a* is pushed up against an urging force of the spring 48 by the flush water flowing into the cylinder 114*a*. Only the tap water is supplied to the cylinder 114*a* as flush water, and the flush water once supplied to the reservoir tank 10 does not flow into the cylinder 114*a*. Not only the piston 128 moves in the lateral direction in the cylinder 114*a*, but also the piston 128 may move in another direction (for example, an oblique direction or an up-down direction) in the cylinder 114*a* which may be disposed in the oblique direction or the up-down direction.

The first through-hole portion 114*f* is connected to a drive part drain passage 134*b*, and the first discharge part 114*m* extends into the drive part drain passage 134*b*. A distal end of the first discharge part 114*m* forms an outflow hole to the drive part drain passage 134*b*. The drive part drain passage 134*b* is a drain pipe. The first discharge part 114*m* is formed to open and close a first discharge passageway inlet 170*a* of a first discharge passageway 170 through which the flush water is drained from the inside of the cylinder 114*a* to the outside of the cylinder 114*a* by the first rod 132 and the first through-hole portion 114*f*. The first discharge part 114*m* is configured such that when the piston 128 is located at the first position H11, the first discharge passageway inlet 170*a* of the first discharge passageway 170 is closed by the first rod 132 and the first through-hole portion 114*f* and the first discharge passageway 170 is closed. Further, the first discharge part 114*m* is configured such that when piston 128 reaches a communication position (for example, a predetermined position on a further back side from a disengagement position of the clutch mechanism)among from the first position H11 to a second position H12 and is located on a further back side after reaching, the first discharge passageway inlet 170*a* of the first discharge passageway 170 is opened by the first rod 132 and the first through-hole portion 114*f* and the first discharge passageway 170 is in an open state. The first discharge part 114*m* has a switching function such as a switching valve between a closed state and an open state of the first discharge passageway 170. The first discharge part 114*m* has a function of forming a main discharge passageway of the flush water from the cylinder 114*a*. In addition, the first discharge part 114*m* has a function of forming a main water supply passageway of the flush water to the reservoir tank 10.

The first discharge passageway 170 of the first discharge part 114*m* is formed by a passage extending to the inside of the first rod 132. The first discharge passageway 170 is formed by a hollow internal passage of the first rod 132. The first discharge passageway inlet 170*a* of the first discharge passageway 170 is opened on a side surface of the first rod 132. When the piston 128 moves to be pushed forward up to the second position H12 located on the back side from the first position H11, the water flowing into the cylinder 114*a* flows out by passing from the first discharge part 114*m* through the drive part drain passage 134*b*. In other words, the drive part water supply passage 34*a* and the drive part drain passage 134*b* communicate with each other via the inside of the cylinder 114*a* when the piston 128 moves up to the second position H12.

The second discharge part 114*n* is formed between the first rod 132 and the first through-hole portion 114*f* and between the piston 128 and the first through-hole portion 114*f*. The second discharge part 114*n* communicates a pressure chamber on the inlet side of the discharge valve hydraulic drive portion 114 with a space inside the reservoir tank 10. The second discharge part 114*n* forms a second discharge passageway 172 from the cylinder 114*a*. When the piston 128 is located at the first position H11, the second discharge part 114*n* keeps the second discharge passageway 172 open. The second discharge passageway 172 is always in an open state regardless of the position of the piston 128. The second discharge passageway 172 is formed from, for example, a slight gap between an outer surface of the first rod 132 and the first through-hole portion 114*f*, but a water passageway for the second discharge passageway 172 may be provided in the first rod 132 as a modification. Some of the flush water flowing into the cylinder 114*a* flows out from the second discharge part 114*n* in the gap between the first rod 132 and the first through-hole portion 114*f*. The flush water flowing out from the second discharge part 114*n* flows into the reservoir tank 10. Since the second discharge part 114*n* is relatively narrow and has a large flow channel resistance, even when the flush water flows out from the second discharge part 114*n*, the pressure in the cylinder 114*a* rises due to the flush water flowing into the cylinder 114*a* from the drive part water supply passage 34*a*, and the piston 128 is pushed up against the urging force of the spring 48.

A minimum cross-sectional area value of the second discharge passageway 172 of the second discharge part 114*n* is smaller than that of the first discharge passageway 170 of the first discharge part 114*m*. The minimum cross-sectional area value of the second discharge passageway 172 of the second discharge part 114*n* is equal to or less than half of the minimum cross-sectional area value of the first discharge passageway 170 of the first discharge part 114*m*, and the second discharge part 114*n* forms an auxiliary drain flow channel relative to the first discharge part 114*m*. The second discharge part 114*n* has a function of forming an auxiliary discharge passageway of the flush water from the cylinder 114*a*.

The second discharge passageway 172 of the second discharge part 114*n* includes a first flow channel 114*o* extending along a lower surface portion 128*c* between the top portion 114*k* of the bank portion 114*h* and a lower surface portion 128*c* in the state where the piston 128 is at the first position H11, and a third flow channel 114*r* extending laterally between the first rod 132 and the inner wall of the first through-hole portion 114*f* in the state where the piston 128 is at the first position H11. The first flow channel 114*o* forms a flow channel with a relatively small gap because the top portion 114*k* and the lower surface portion 128*c* are substantially in contact with each other when the piston 128 is at the first position H11. The first flow channel 114*o* and the third flow channel 114*r* form a flow channel that bends in an L shape in a cross-sectional view. Further, the piston 128 and the cylinder 114*a* may be configured such that the top portion 114*k* and the lower surface portion 128*c* do not come in contact with each other and the first flow channel 114*o* of the flow channel with a relatively small gap is formed in the state where the piston 128 is at the first position H11.

The shape of the second discharge part 114*n* changes with the movement of the piston 128. Therefore, the total cross-sectional area value and the minimum cross-sectional area value of the flow channel in the second discharge part 114*n* change with the movement of the piston 128. The second discharge part 114*n* is formed such that as the piston 128 moves from the first position H11 to the second position H12, the total cross-sectional area value and the minimum cross-sectional area value of the second discharge passageway 172 in the second discharge part 114*n* are increased and pressure loss of the second discharge part 114*n* is reduced. For example, as the piston 128 moves from the first position H11 to the second position H12, the cross-sectional area of the minimum flow channel in the second discharge part 114*n* increases. For example, the cross-sectional area of the minimum flow channel is the minimum cross-sectional area value of the second discharge passageway 172 between the top portion 114*k* and the lower surface portion 128*c*, and the minimum cross-sectional area value of the flow channel of the second discharge passageway 172 increases as the piston 128 moves toward the side of the second position. As the piston 128 moves from the first position H11 to the second position H12, the minimum cross-sectional area value of the flow channel of the second discharge passageway 172 also increases.

When an outer diameter of the portion of the distal end side of the first rod 132 is formed smaller than an outer diameter of the portion of the proximal end side (piston connection side), the second discharge part 114*n* is formed such that as the piston 128 and the first rod 132 moves toward the side of the second position, the cross-sectional area of the second discharge passageway 172 between the first rod 132 and the inner wall of the first through-hole portion 114*f*, for example, the total cross-sectional area value and the minimum cross-sectional area value increase and the pressure loss of the second discharge part 114*n* is reduced. At this time, the minimum cross-sectional area value (a cross-sectional area of the second discharge passageway 172 of the second discharge part 114*n* corresponding to the discharge passageway of the second discharge part 14*n* between the first rod 32 and the inner wall of the first through-hole portion 14*f* as shown by the second discharge part 14*n* in FIG. 7) of the second discharge passageway 172 when the piston 128 is at the first position H11 is smaller than the minimum cross-sectional area value of the flow channel between the first rod 132 and the inner wall of the first through-hole portion 114*f* when the piston 128 is at the second position H12.

The cylinder 114*a* is a substantially tubular member, and is formed in a conical shape in which the inner diameter of the inner wall 114*i* of the cylinder 114*a* gradually becomes smaller downward. The cylinder 114*a* in the second embodiment has substantially the same structure as the cylinder 14*a* in the first embodiment except that the cylinder 114*a* is disposed sideways, and thus will not be described. For example, an inner diameter R1 (see FIG. 5) of the cylinder 114*a* at a portion corresponding to the first position H11 of the piston 128 is the minimum inner diameter of the cylinder. The inner diameter of the cylinder 114*a* is the same as that in the first embodiment, and thus will not be described.

The first rod 132 is a rod-shaped member connected to the surface on the inlet side of the piston 128. The first rod 132 extends toward a pressure chamber 114*g* in the side of the inlet 114*l* from the piston 128 and extends outward through the first through-hole portion 114*f* on the side wall in the inlet side. The first rod 132 extends into the drive part drain passage 134*b* extending from the first through-hole portion 114*f*. The proximal end of the first rod 132 is connected to the piston 128, and the distal end of the first rod 132 is located inside the drive part drain passage 134*b*. The first rod 132 is a rod extending toward an opposite side of a second rod 133, which is an operating rod for the clutch mechanism 130 extending from the piston 128 toward the clutch mechanism 130. The rod extending from the piston 128 through the through-hole portion formed in the cylinder 114*a* is not necessarily limited to distinguish the first rod 132 and the second rod 133 from each other, and the first rod 132 and the second rod 133 may be formed as a one rod.

The second rod 133 is a rod-shaped member connected to a surface of the piston 128 on a back portion 114*t*, and extends from the piston 128 to couple the piston 128 and the discharge valve 12. The second rod 133 extends from the piston 128 toward the side of the back portion 114*t* and extends laterally to protrude from the inside of the cylinder 114*a* by passing through the second through-hole portion 114*q* formed in a side wall on the back side. The proximal end of the second rod 133 is connected to the piston 128, and the distal end of the second rod 133 acts on the passive part 176 of the clutch mechanism 130.

Figure 16:
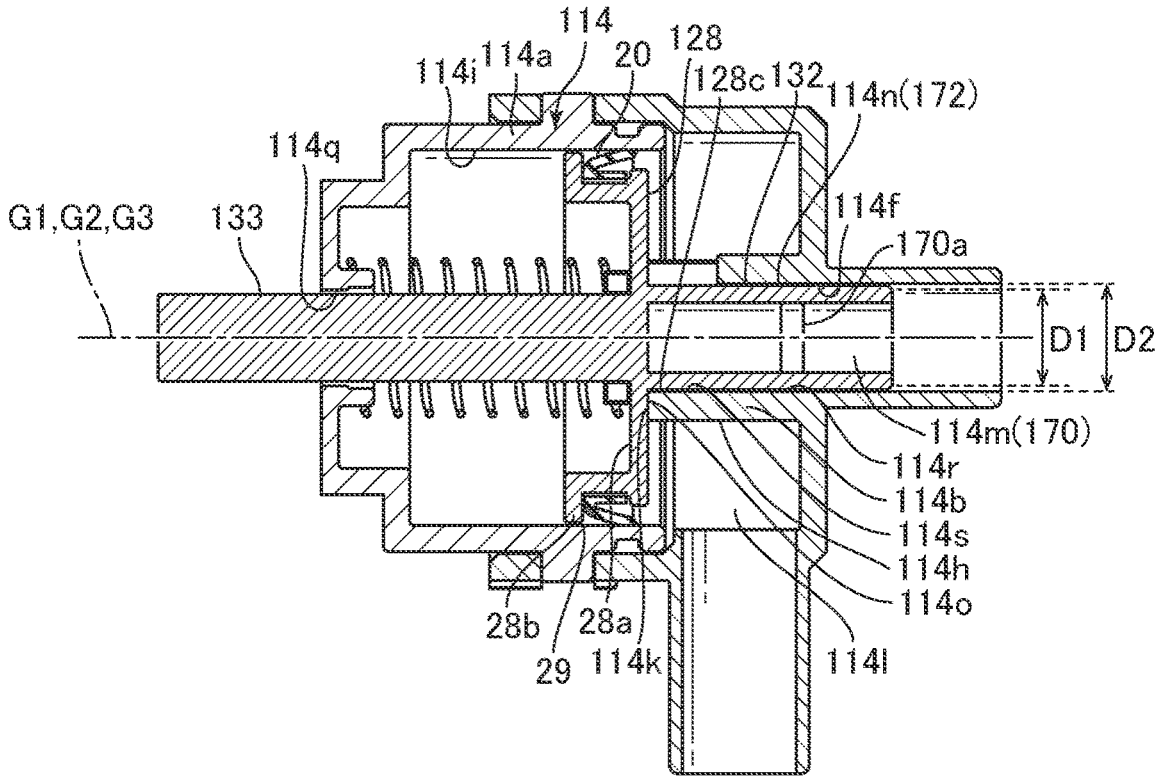
FIG. 16 is a cross-sectional view taken along a line XVI-XVI in FIG. 15.

As shown in FIG. 16, a center axis G1 of the first rod 132 and a center axis G2 of the first through-hole portion 114*f* are located on the same axis as a center axis G3 of the cylinder 114*a*. A maximum outer diameter D1 out of outer diameters of the entire first rod 132 is smaller than a minimum inner diameter D2 out of inner diameters of the entire first through-hole portion 114*f*. In the present embodiment, the outer diameter of the first rod 132 is formed to be substantially constant from the proximal end connected to the piston to the distal end. The outer diameter of the distal end of the first rod 132 may be formed smaller than the outer diameter of the proximal end of the first rod 132.

In the present embodiment, the piston 128 is configured to move laterally within the cylinder 114*a*. The piston 128 moves from the first position H11 (see FIG. 14) to the second position H12 (see FIG. 19) when the flush water flows into the cylinder 114*a*. The first position H11 of the piston 128 is located on the inlet 114*l*, and the second position H12 is located on the clutch mechanism 130 compared to the first position H11. The second position H12 is, for example, a position on the back side opposite to the inlet 114*l* of the cylinder 114*a*. The piston 128 includes a force receiving part 28*a* (see FIG. 16) that receives an urging force from the spring 48 and an upper outer circumference part 28*b* formed on the back side of the packing 20. The structure of the piston 128 in the second embodiment is almost the same as the structure of the piston 28 in the first embodiment, which will be referred to FIG. 6 and the related description, and thus the detailed description of the piston 128 will not be described.

Since the cylinder 114*a* is formed in the conical shape, the water passageway gap 29 gradually becomes smaller as the piston 128 moves from the second position to the first position of the cylinder 114*a*.

The packing 20 is attached to the piston 128 and has a function of ensuring watertightness of the seal between the inner wall surface of the cylinder 114*a* and the piston 128. The packing 20 is a so-called U packing having a U-shaped cross section. The packing 20 is an elastic member formed of rubber.

As shown in FIG. 14, the flush water tank apparatus 104 further includes a speed reduction part 174 that reduces a flow rate of the flush water drained from the second discharge part 114*n*. The speed reduction part 174 is configured to reduce the flow rate of the flush water drained from the second discharge part 114*n*. The speed reduction part 174 is, for example, the drive part drain passage 134*b* formed to cover the outside of the first rod 132. The drive part drain passage 134*b* extends along the outside of the first rod 132, and the flow rate of the flush water flowing out from the second discharge part 114*n* is reduced along the inner wall of the drive part drain passage 134*b*. The speed reduction part 174 may be another means for reducing the flow rate of the flush water drained from the second discharge part 114*n*. For example, a drain passage branch portion 134*c* is provided on the drive part drain passage 134*b*, and the flow rate of the flush water may be reduced by branching at the drain passage branch portion 134*c*.

The first control valve 16 will be described below.

The first control valve 16 is configured to control water supply to the discharge valve hydraulic drive portion 114 and to control to supply and stop the water supply to the reservoir tank 10 based on an operation of the electromagnetic valve 18. In addition, the vacuum breaker 36 (see FIG. 2) is provided in the drive part water supply passage 34*a* located between the first control valve 16 and the discharge valve hydraulic drive portion 114.

When the pilot valve 16*d* is opened by the electromagnetic valve 18, the main valve body 16*a* of the first control valve 16 is opened, and the tap water flowing in from the water supply pipe 38 is supplied to the discharge valve hydraulic drive portion 114.

In addition, the tap water supplied from the first control valve 16 to the discharge valve hydraulic drive portion 114 is supplied to the reservoir tank 10 or the overflow pipe 10*b* through the drive part drain passage 134*b* by the first discharge part 114*m* and/or the second discharge part 114*n*. The first control valve 16 is provided with the pilot valve 16*e*, and the pilot valve 16*e* is opened and closed by the float switch 42.

The float switch 42 is connected to the pilot valve 16*e*. The float switch 42 is configured to control the pilot valve 16*e* based on the water level in the reservoir tank 10 and to open and close a pilot valve port (not shown). In other words, the float switch 42 sends a signal to the pilot valve 16*e* to close the pilot valve port (not shown) when the water level in the reservoir tank 10 reaches a predetermined water level. In other words, the float switch 42 is configured to set the water storage level in the reservoir tank 10 to a predetermined full water level WL which is a stopped water level. The float switch 42 is disposed in the reservoir tank 10, and is configured to stop the water supply to the discharge valve hydraulic drive portion 114 from the first control valve 16 when the water level of the reservoir tank 10 rises to the full water level WL.

In addition, the drive part drain passage 134*b* extending from the discharge valve hydraulic drive portion 114 is provided with the drain passage branch portion 134*c*. One drive part drain passage 134*b* branched at the drain passage branch portion 134*c* allows the water to flow out into the reservoir tank 10, and the other drive part drain passage 134*b* allows the water to flow out into the overflow pipe 10*b*. Therefore, some of the flush water supplied from the discharge valve hydraulic drive portion 114 is drained to the flush toilet main body 2 through the overflow pipe 10*b*, and the remaining flush water is stored in the reservoir tank 10.

The controller 40 has a built-in CPU and a memory, and controls connected apparatus so as to execute a large washing mode and a small washing mode, which will be described below, based on a predetermined control program recorded in memory and the like. The controller 40 is electrically connected to the remote controller 6, the human sensor 8, and the electromagnetic valve 18.

The float apparatus 26 will be described below. The float apparatus 26 is configured such that the valve shaft frame body 12*a* is lifted by a predetermined distance and the valve shaft frame body 12*a* of the discharge valve 12 descends after the valve shaft frame body 12*a*, the couple member 188, and the clutch mechanism 130 are detached from the discharge valve hydraulic drive portion 114 to delay the closing of the water discharge opening 10*a*. Specifically, the float apparatus 26 includes a float part 26*a* and an engaging part 26*b* interlocking with the float part 26*a*. On the other hand, a holding claw 12*g* is formed at a proximal end of the valve shaft frame body 12*a* of the discharge valve 12 to engage with the engaging part 26*b*.

A description will be given below with reference to FIGS. 14 to 20 with respect to the flush water tank apparatus 104 according to the second embodiment of the present invention and a series washing operations of the flush toilet apparatus 101 including the flush water tank apparatus 104.

First, in the standby state of toilet washing shown in FIG. 14, the water level in the reservoir tank 10 is at a predetermined full water level WL, and in this state, the first control valve 16 is closed. Further, the float apparatus 26 is in a standby state. Next, when a user pushes a washing button of the remote controller 6, the remote controller 6 transmits an instruction signal for the toilet washing to the controller 40. In the flush toilet apparatus 101 of the present embodiment, even when a predetermined time elapses without the washing button of the remote controller 6 being pushed after the human sensor 8 detects that the user leaves from the toilet, the instruction signal for the toilet washing is transmitted to the controller 40.

The piston 128 of the discharge valve hydraulic drive portion 114 is at the first position H11 in the cylinder 114*a*. The first position H11 of the piston 128 is a position on the most inlet side in a movable range. The piston 128 is stopped in the cylinder 114*a*. At this time, the lower end 20*b* of the packing 20 is located above the full water level WL of the reservoir tank 10. Therefore, the packing 20 is disposed in a region to be directly supplied with the flush water from the tap water so as to be immersed in the flush water stored in the reservoir tank 10 in which what chemical for the toilet washing such as chlorine is charged by the user is unknown. Therefore, it is possible to restrain the packing 20 from being deteriorated by being immersed in such a chemical. Further, the packing 20 is immersed in the flush water directly supplied from the tap water, unlike the flush water stored in the reservoir tank 10 in which what washing agent for the toilet washing is charged by the user is unknown, thereby the deterioration of the packing 20 due to chlorine such as a toilet washing agent can also be restrained.

A deformation amount of the packing 20 in the state where the piston 128 is at the first position H11 is a maximum deformation amount among deformation amounts of the elastic member at respective positions while the piston 128 moves from the first position H11 to the second position H12. The deformation amount of the packing 20 is the same as that in the first embodiment, and thus will not be described.

In the standby state where the piston 128 is at the first position H11, the spring 48 is in the most extended state, and the lower surface portion 128*c* of the piston 128 is in contact with the top portion 114*k* of the bank portion 114*h*. The piston 128 is urged toward the side of the first position by the spring 48, and is stopped in a state of being in contact with the top portion 114*k*.

Figure 17:
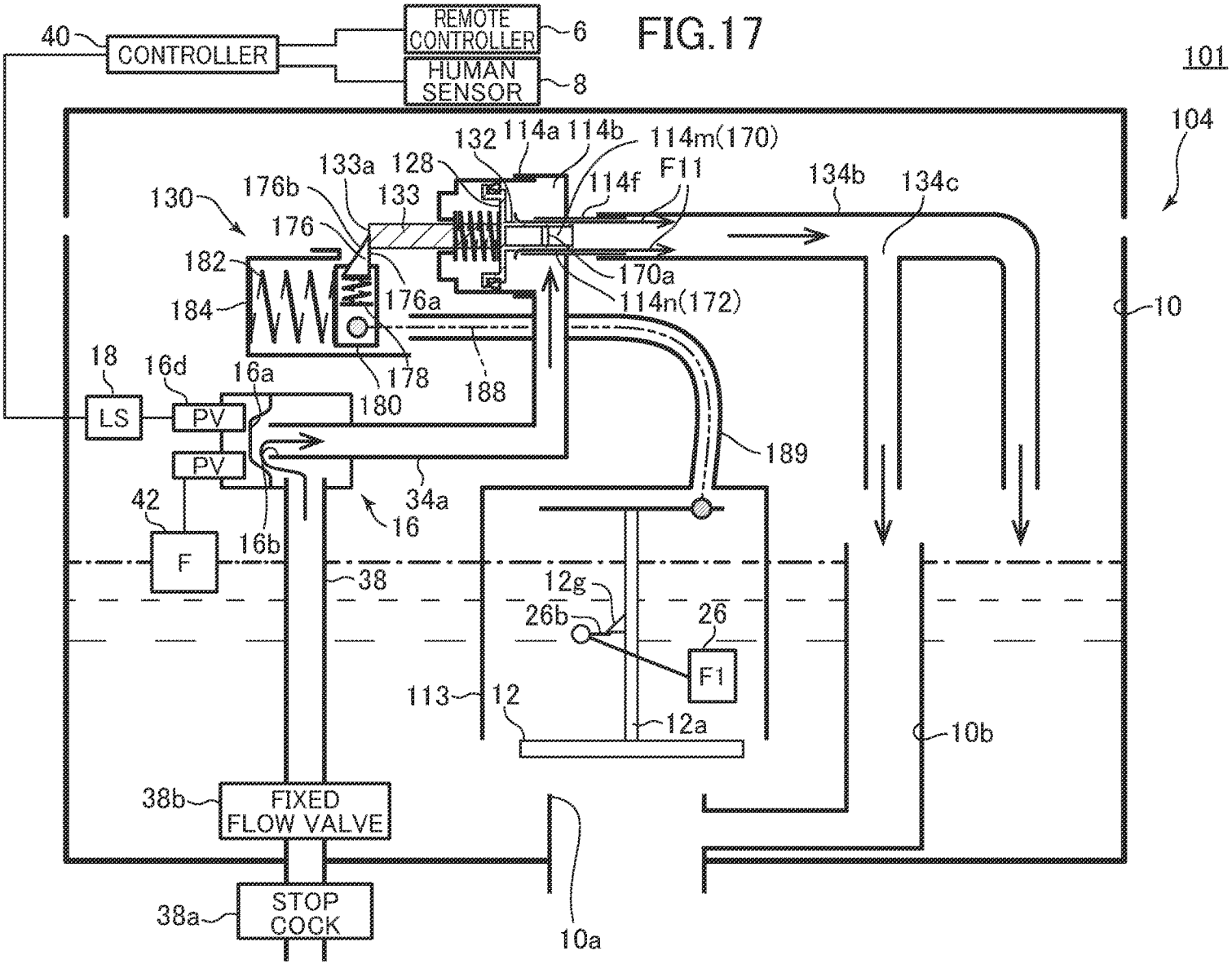
FIG. 17 is a view showing a state where a piston of the discharge valve hydraulic drive portion in the flush water tank apparatus shown in FIG. 14 is moving toward a second position.

When the piston 128 is located at the first position H11, the first discharge passageway inlet 170*a* of the first discharge passageway 170 of the first discharge part 114*m* is closed by the first rod 132 and the first through-hole portion 114*f*, and the first discharge passageway 170 is closed. When the piston 128 is located at the first position H11, the second discharge part 114*n* is formed between the first rod 132 and the first through-hole portion 114*f* and between the piston 128 and the first through-hole portion 114*f*. In other words, in the standby state, the second discharge passageway 172 formed between the first rod 132 and the first through-hole portion 114*f* is in an open state. Thus, as shown in FIG. 17, when the flush water flows into the cylinder 114*a*, some of the flush water flows out from the second discharge passageway 172 of the second discharge part 114*n* toward the side of the drive part drain passage 134*b* as indicated by an arrow F11.

In the standby state where the piston 128 is at the first position H11, the cross-sectional area of the flow channel in the second discharge part 114*n* is determined by the cross-sectional area of the flow channel between the first rod 132 and the first through-hole portion 114*f* and the cross-sectional area of the flow channel between the piston 128 and the first through-hole portion 114*f*. The cross-sectional area of the minimum flow channel in the second discharge part 114*n* is the cross-sectional area of the first flow channel 114*o*, and since the top portion 114*k* and the lower surface portion 128*c* are substantially in contact with each other, the pressure loss of the second discharge part 114*n* becomes larger.

Next, upon receiving the instruction signal for the toilet washing, the controller 40 allows the electromagnetic valve 18 (FIG. 14) provided in the first control valve 16 to operate, and allows the pilot valve 16*d* on the electromagnetic valve side to be separated from the pilot valve port. Thus, the pressure in the pressure chamber 16*c* drops, the main valve body 16*a* is separated from the main valve port 16*b*, and the main valve port 16*b* is opened. When the first control valve 16 is opened, the flush water flowing in from the water supply pipe 38 is supplied to the discharge valve hydraulic drive portion 114 via the first control valve 16. Thereby, the piston 128 of the discharge valve hydraulic drive portion 114 is pushed up, and the operating part 133*a* of the second rod 133 is advanced toward the passive part 176.

When the discharge valve 12 is pulled up, the holding claw 12*g* provided on the valve shaft frame body 12*a* of the discharge valve 12 pushes up and rotates the engaging part 26*b* of the float apparatus 26, and the holding claw 12*g* ascends beyond the engaging part 26*b*.

After the standby state of the piston 128, for example, when the piston 128 is advanced, the flush water flowing into the pressure chamber 114*b* of the cylinder 114*a* closer to the first position than the piston 128 is retained mainly in the pressure chamber 114*b* by the packing 20 having a sealing function to generate a force that moves the piston 128 toward the side of the second position.

As shown in FIG. 17, when the piston 128 and the second rod 133 moves toward the second position H12, the operating part 133*a* comes into contact with the first flat surface 176*a* of the passive part 176, and the passive part 176 and the first support body 180 are pushed laterally while contracting the elastic member 182 for the support body. Thereby, the couple member 188 connected to the first support body 180 is pulled up, and the discharge valve 12 is pulled up by the couple member 188. Therefore, when the discharge valve 12 is pulled up, the flush water in the reservoir tank 10 is drained from the water discharge opening 10*a* to the flush toilet main body 2.

Until the clutch mechanism 130 is disengaged while the piston 128 moves from the first position H11 to the second position H12, the second discharge passageway 172 formed between the first rod 132 and the first through-hole portion 114*f* is in an open state. Thereby, as indicated by an arrow F11, some of the flush water flowing into the cylinder 114*a* flows out from the second discharge passageway 172 of the second discharge part 114*n* toward the side of the drive part drain passage 134*b*. Since the outflow of the flush water from the second discharge passageway 172 is relatively small, the piston 128 is pushed toward the second position H12 as planned. On the other hand, the first discharge passageway inlet 170*a* of the first discharge passageway 170 is closed by the first rod 132 and the first through-hole portion 114*f*, and the first discharge passageway 170 of the first discharge part 114*m* is closed.

Figure 18:
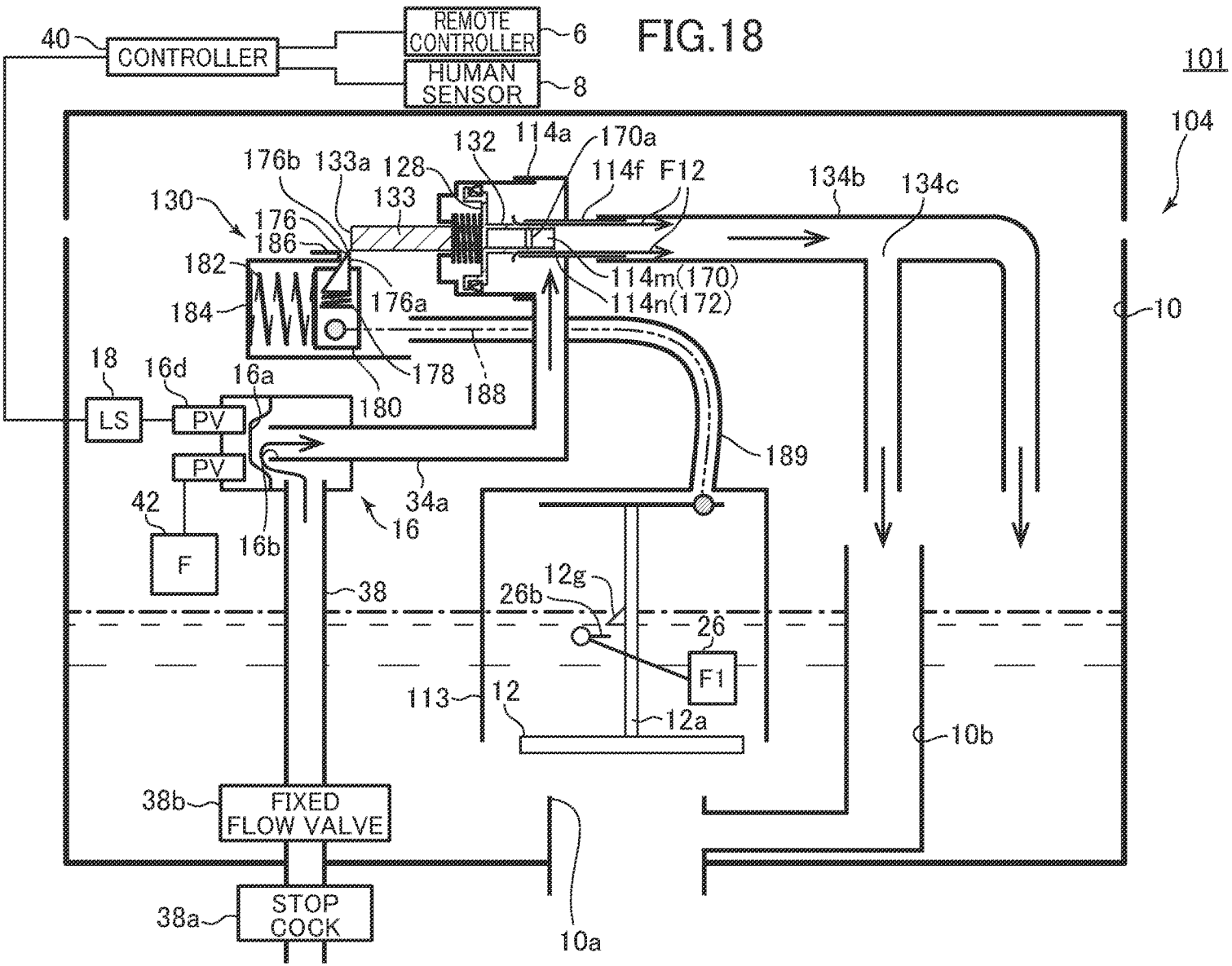
FIG. 18 is a view showing a state where a clutch mechanism in the flush water tank apparatus shown in FIG. 14 is disengaged.

Next, as shown in FIG. 18, when the passive part 176 is further advanced and pressed toward the side of the regulation part 186, the inclined surface 176*b* comes into contact with the regulation part 186, so that the inclined surface 176*b* is pressed to the elastic member 178 for the passive part, and the passive part 176 moves toward the side of the elastic member 178 for the passive part. Therefore, the contact between the second rod 133 and the passive part 176 is released, and the coupling of the clutch mechanism 130 is released. In other words, when the discharge valve 12 is pulled up to a predetermined height, the passive part 176 of the clutch mechanism 130 hits the regulation part 186, and the clutch mechanism 130 is disengaged. Even after the clutch mechanism 130 is disengaged, the first discharge passageway 170 of the first discharge part 114*m* is in a closed state until the first discharge passageway inlet 170*a* is opened, and as indicated by an arrow F12, some of the flush water flows out from the second discharge passageway 172 of the second discharge part 114*n* toward the side of the drive part drain passage 134*b*.

Next, when the clutch mechanism 130 is disengaged, the discharge valve 12 starts to descend toward the water discharge opening 10*a* due to its own weight. The holding claw 12*g* of the descending discharge valve 12 engages with the engaging part 26*b* of the float apparatus 26, and the discharge valve 12 is held at a predetermined height by the engaging part 26*b*. When the discharge valve 12 is held by the engaging part 26*b*, the water discharge opening 10*a* is maintained in an open state, and flush water in the reservoir tank 10 is maintained to be drained to the flush toilet main body 2. At this time, the pilot valve 16*d* is still in the open state, and the flush water flowing in from the water supply pipe 38 is supplied to the discharge valve hydraulic drive portion 114 via the first control valve 16.

Figure 19:
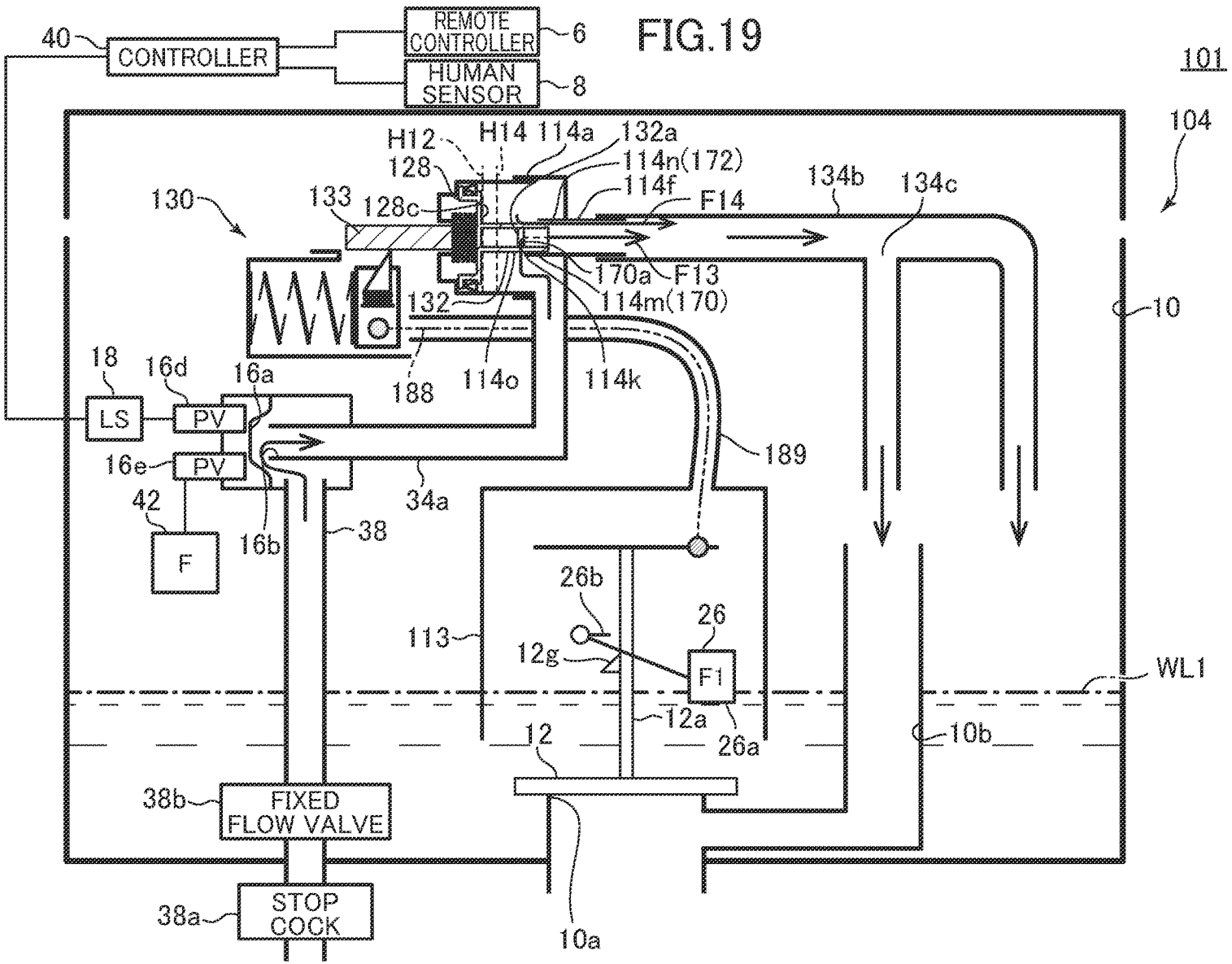
FIG. 19 is a view showing a state where the piston of the discharge valve hydraulic drive portion in the flush water tank apparatus shown in FIG. 14 is moved to the second position.

As shown in FIG. 19, the piston 128 and the first rod 132 are further pushed forward to reach the second position H12. In this process, when the piston 128 is advanced up to a communication position (a fourth position H14 of the piston 128 in which a communication flow channel is formed) of the piston 128, a first discharge passageway inlet 170*a* is opened from the first discharge passageway start position 132*a* of the first rod 132 appearing in the cylinder 114*a* so as to correspond to the communication position of the piston 128. The fourth position H14 is located at a position closer to the back side of the piston than the disengagement position where the clutch mechanism 130 is disengaged and at a position slightly closer to the inlet side (front side) than the second position H12. The distance from the connection portion of the first rod 132 with the piston 128 to the first discharge passageway start position 132*a*, that is, the distance from the first position H11 to the fourth position H14 is equal to or more than two-thirds of the movable distance of the piston 128 in the cylinder 114*a*. When the first discharge passageway inlet 170*a* of the first discharge passageway 170 is opened by the first rod 132 and the first through-hole portion 114*f*, the first discharge passageway 170 of the first discharge part 114*m* is opened. Thereby, as indicated by an arrow F13, the flush water is drained from the first discharge passageway 170 to the drive part drain passage 134*b*, and the flush water is discharged as main water supply from the discharge part at the downstream end of the drive part drain passage 134*b* into the reservoir tank 10. At this time, as indicated by an arrow F14, some of the flush water also flows out from the second discharge passageway 172 of the second discharge part 114*n* toward the side of the drive part drain passage 134*b*.

In the second discharge part 114*n* in the state where the piston 128 is at the second position H12, the top portion 114*k* and the lower surface portion 128*c* are separated from each other, the minimum cross-sectional area value of the flow channel of the first flow channel 114*o* increases. On the other hand, the minimum cross-sectional area value of the flow channel of the third flow channel 114*r* remains constant. In this way, as the piston 128 moves toward the second position H12, the top portion 114*k* and the lower surface portion 128*c* are separated from each other, the cross-sectional area of the flow channel of the first flow channel 114*o* increases, the total cross-sectional area value and the minimum cross-sectional area value of the flow channel in the second discharge part 114*n* increase, and the pressure loss of the second discharge part 114*n* is reduced. In the state where the piston 128 is heading for the second position H12, the clutch mechanism 130 is disengaged. When the clutch mechanism 130 is disengaged as described above, the minimum cross-sectional area value of the flow channel of the second discharge part 114*n* is a maximum cross-sectional area value of the flow channel within the range of change from the first position H11 to the second position H12 of the piston 128. Therefore, when the clutch mechanism 130 is disengaged, the pressure loss of the second discharge part 114*n* is a minimum pressure loss in the range of change in corresponding pressure loss from the first position H11 to the second position H12 of the piston 128.

Next, when the water level in the reservoir tank 10 drops, the float switch 42 for detecting the water level in the reservoir tank 10 is turned off. When the float switch 42 is turned off, the pilot valve 16*e* is opened. Therefore, the flush water is supplied from the first control valve 16 into the reservoir tank 10 via the drive part water supply passage 34*a* and the drive part drain passage 134*b*. The controller 40 allows the electromagnetic valve 18 to be closed when a predetermined time has elapsed from the opening of the electromagnetic valve 18, and allows the pilot valve 16*d* on the electromagnetic valve side to be closed. On the other hand, since the pilot valve 16*e* is opened, the open state of the first control valve 16 is maintained and the water supply to the reservoir tank 10 is continued.

In addition, when the water level in the reservoir tank 10 drops up to the predetermined water level WL1, the float part 26*a* of the float apparatus 26 descends, which moves the engaging part 26*b*. Thus, the engagement between the valve shaft frame body 12*a* and the engaging part 26*b* is released, and the valve shaft frame body 12*a* and the discharge valve 12 start to descend again.

Thereby, the discharge valve 12 is seated on the water discharge opening 10*a*, and the water discharge opening 10*a* is closed. Since the float switch 42 is still in the off state, the open state of the first control valve 16 is maintained, and the water supply to the reservoir tank 10 is continued. The flush water supplied through the drive part drain passage 134*b* reaches the drain passage branch portion 134*c*, some of the flush water branched at the drain passage branch portion 134*c* flows into the overflow pipe 10*b*, and the remaining flush water is stored in the reservoir tank 10. The flush water flowing into the overflow pipe 10*b* flows into the flush toilet main body 2, and is used to refill the bowl 2*a*. On the other hand, the water level in the reservoir tank 10 rises due to the flush water flowing into the reservoir tank 10 in the state where the discharge valve 12 is closed.

Figure 20:
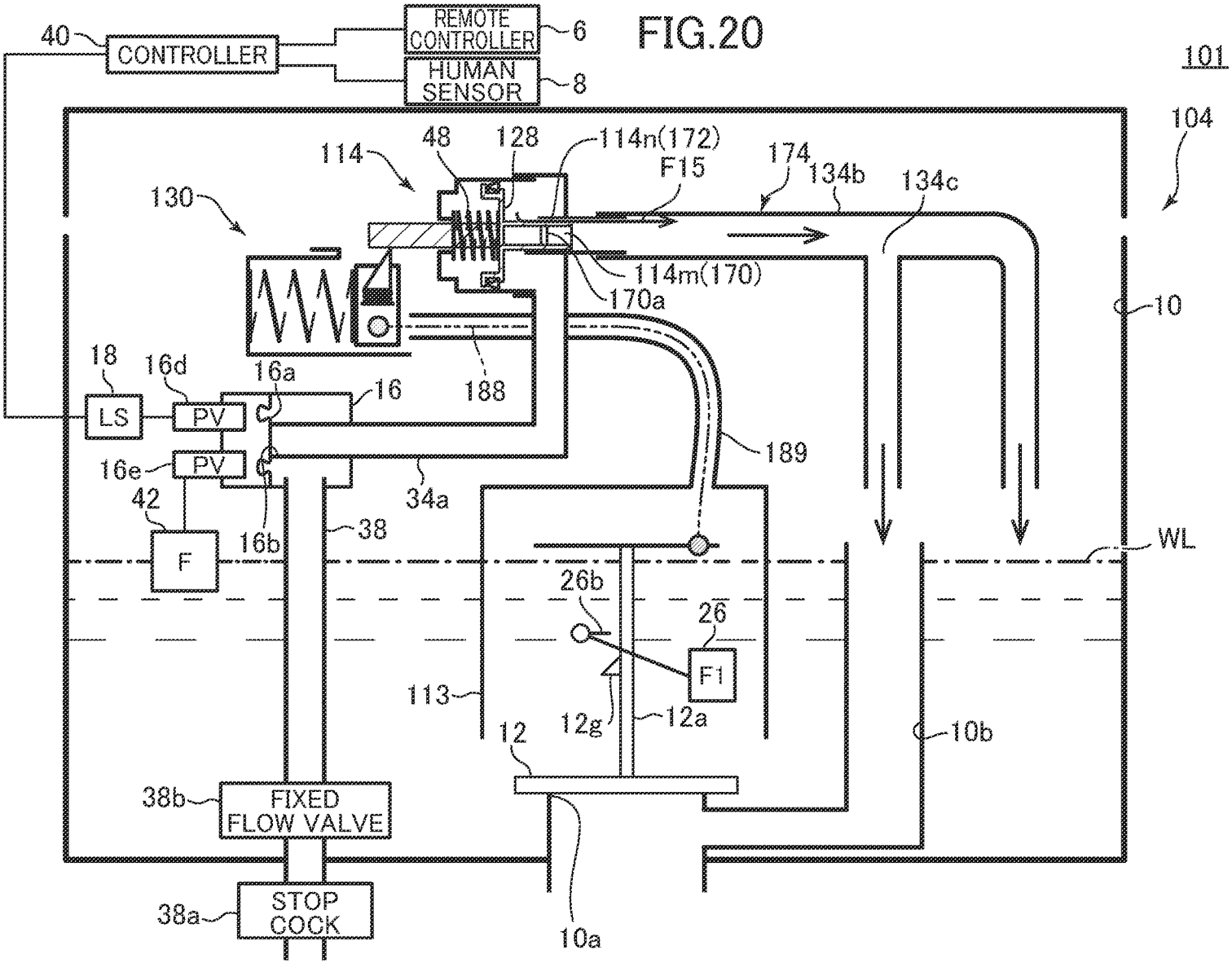
FIG. 20 is a view showing a state where a discharge valve in the flush water tank apparatus shown in FIG. 14 descends and a water discharge opening is closed.

As shown in FIG. 20, when the water level in the reservoir tank 10 rises to the predetermined full water level WL, the float switch 42 is turned on. When the float switch 42 is turned on, the pilot valve 16*e* on the float switch side is closed. Thereby, since the pilot valve 16*e* is closed, the first control valve 16 is closed and the water supply is stopped. After the first control valve 16 is closed and the water supply to the discharge valve hydraulic drive portion 114 is stopped, the flush water in the cylinder 114*a* of the discharge valve hydraulic drive portion 114 gradually flows out from the first discharge part 114*m* and the second discharge part 114*n*, and the piston 128 is pushed down by the urging force of the spring 48 and returns to the first position H11. After the first discharge passageway inlet 170*a* is closed along with the return of the piston 128 to the first position H11, as indicated by an arrow F15, the flush water in the cylinder flows out from the second discharge passageway 172 toward the side of the drive part drain passage 134*b*. Therefore, as shown in FIG. 14, the apparatus in the reservoir tank 10 returns to the standby state.

According to the flush water tank apparatus 104 of the second embodiment of the present invention described above, the discharge valve hydraulic drive portion 114 includes the inlet 114*l* that is formed in the cylinder 114*a* and into which the flush water flows, the first discharge part 114*m* provided separately from the inlet 114*l* to cause the flush water to drain from the inside of the cylinder 114*a*, and the second discharge part 114*n* provided separately from the first discharge part 114*m* and formed between the first rod 132 and the first through-hole portion 114*f*. Thereby, when the water supply pressure of the flush water to the cylinder 114*a* suddenly fluctuates, for example, suddenly rises in the state where the flow channel is not communicated or is communicated from the inlet 114*l* to the first discharge part 114*m* in the cylinder 114*a*, the second discharge part 114*n* can soften the impact of the sudden fluctuation in the pressure of the flush water, the piston 128 can buffer the impact applied from the flush water, and the unstable operation of the piston 128 can be restrained.

According to the flush water tank apparatus 104 of the second embodiment of the present invention described above, the first discharge part 114*m* is configured such that when the piston 128 is located at the first position H11, the first discharge passageway inlet 170*a* is closed by the first rod 132 and the first through-hole portion 114*f*, and is further configured such that when the piston 128 reaches the communication position between the first position H11 and the second position H12, the first discharge passageway inlet 170*a* is opened by the first rod 132 and the first through-hole portion 114*f*. With such a relatively simple configuration, when the piston 128 is located at the first position, the water supply pressure of the flush water does not escape toward the side of the first discharge passageway 170, and the water supply pressure of the flush water is effectively used for the movement of the piston 128. When the piston 128 is located at the communication position between the first position H11 and the second position H12, the first discharge passageway 170 is opened, the flush water is drained from the inside of the cylinder 114*a* to the outside of the cylinder 114*a* through the first discharge passageway 170, and the piston 128 can easily return to the first position H11 from the second position H12 or the communication position.

According to the flush water tank apparatus 104 of the second embodiment of the present invention described above, since the first discharge passageway 170 of the first discharge part 114*m* is formed from the passage extending inside of the first rod 132, when the first discharge passageway is opened compared with the case where the passageway is formed on the outer surface portion of the first rod 132, the variation in the flow rate of the flush water flowing through the passage inside the first rod 132 can be easily restrained. At the same time, when the piston 128 is at the first position H11, the water supply pressure of the flush water does not escape toward the side of the first discharge passageway 170, and the water supply pressure of the flush water is effectively used for the movement of the piston 128. When the piston 128 is located at the communication position, the first discharge passageway 170 is opened, the flush water is drained from the inside of the cylinder 114*a* to the outside of the cylinder 114*a* through the first discharge passageway 170, and the piston 128 can easily return to the first position H11 from the second position H12 or a predetermined position.

According to the flush water tank apparatus 104 of the second embodiment of the present invention described above, the flush water tank apparatus 104 further includes the speed reduction part 174 that reduces the flow rate of the flush water drained from the second discharge part 114*n*. Thereby, the flow rate of the flush water drained from the second discharge part 114*n* can be reduced. For example, even when the flush water drained from the second discharge part 114*n* is drained into the reservoir tank 10 from the position higher than the water level in the reservoir tank 10, scattering of the flush water can be restrained.

A flush toilet apparatus according to a third embodiment of the present invention will be described below with reference to FIGS. 21 to 28.

Since a flush toilet apparatus 201 according to the third embodiment has substantially the same structure as the flush toilet apparatus according to the second embodiment described above, differences between the third embodiment and the second embodiment of the present invention will be mainly described, and similar parts will be described using the same reference numerals in the drawings or the specification, or will not be described.

Figure 21:
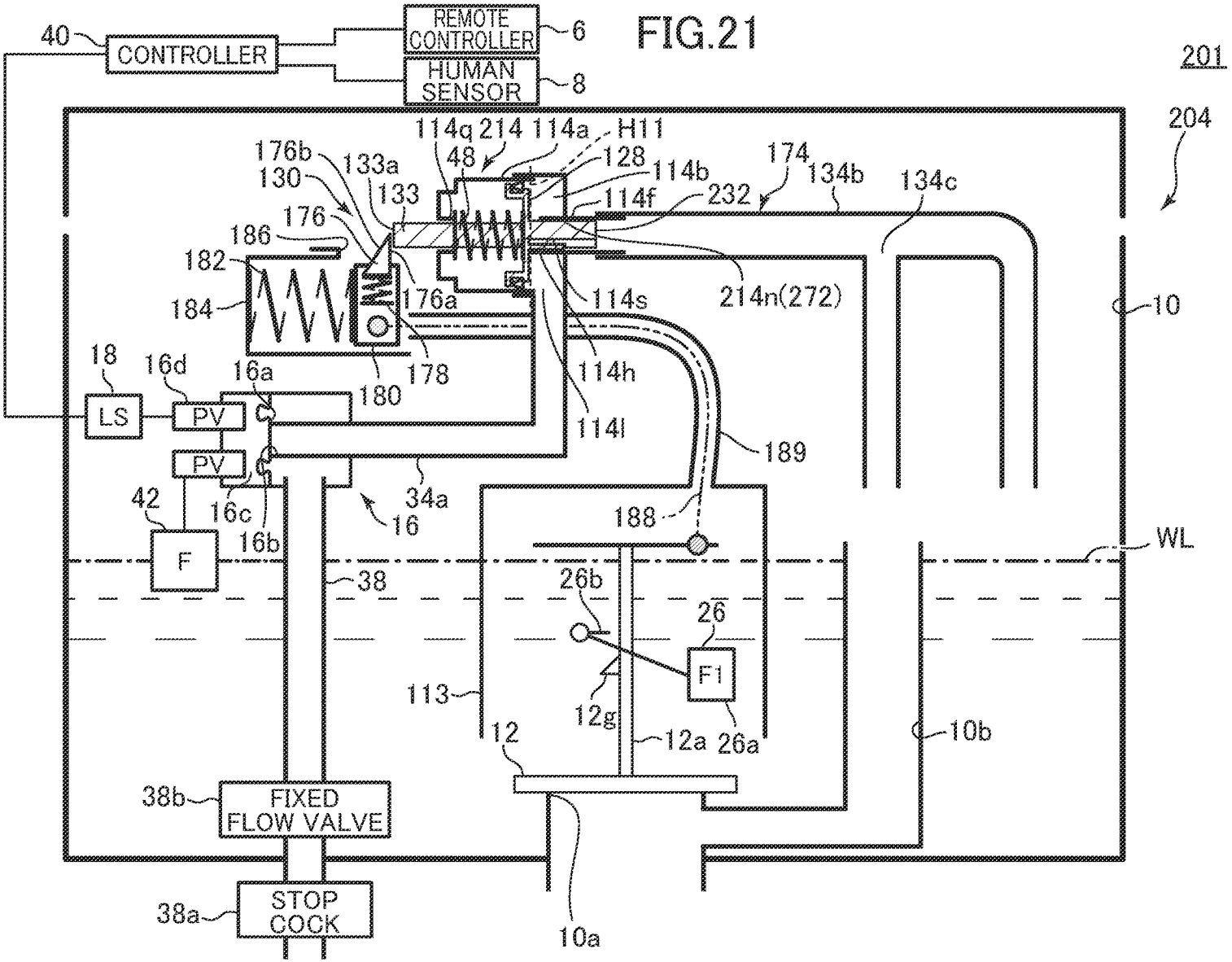
FIG. 21 is a cross-sectional view showing a schematic configuration of a flush water tank apparatus according to a third embodiment of the present invention.

As shown in FIG. 21, the flush toilet apparatus 201 according to the third embodiment of the present invention includes a flush water tank apparatus 204, which is mounted on the rear portion of the flush toilet main body 2, according to the third embodiment of the present invention. The flush water tank apparatus 204 according to the present embodiment is configured to drain flush water stored therein to the flush toilet main body 2 based on an instruction signal from the remote controller 6 or the human sensor 8 and to wash the bowl 2*a* with the flush water.

The flush water tank apparatus 204 includes a discharge valve hydraulic drive portion 214 that is a discharge valve pull-up part configured to pull up the discharge valve 12. Further, the flush water tank apparatus 204 includes therein a first control valve 16 that is a water supply controller configured to control water supply to the discharge valve hydraulic drive portion 214 from tap water.

The flush water tank apparatus 204 further includes a clutch mechanism 130 that connects the discharge valve 12 and discharge valve hydraulic drive portion 214 to pull up the discharge valve 12 using the discharge valve hydraulic drive portion 214 and is disengaged at a predetermined timing so that the discharge valve 12 descends. The clutch mechanism 130 of the third embodiment is the same as the clutch mechanism 130 of the second embodiment, and thus will not be described.

The discharge valve 12 is pulled up by a driving force of the discharge valve hydraulic drive portion 214, the clutch mechanism 130 is disengaged at a predetermined timing when the discharge valve 12 is pulled up to a predetermined height, and the discharge valve 12 descends by its own weight. When the discharge valve 12 descends, the discharge valve 12 is held by the float apparatus 26 for a predetermined time, and a time until the discharge valve 12 is seated on the water discharge opening 10*a* is adjusted.

The discharge valve hydraulic drive portion 214 will be described below with reference to FIGS. 21 to 28.

As shown in FIG. 21 and the like, the discharge valve hydraulic drive portion 214 is configured to drive the discharge valve 12 using a water supply pressure of the flush water supplied from the tap water. The structure of the discharge valve hydraulic drive portion 214 of the third embodiment is basically the same as the structure of the discharge valve hydraulic drive portion 114 of the second embodiment except the first rod 132, and thus the same portions are denoted by the same reference numerals in the drawings and will not be described.

The discharge valve hydraulic drive portion 214 includes a first rod 232 extending through a first through-hole portion 114*f*, which is formed in the cylinder 114*a*, from the piston 128. The cylinder 114*a* in the third embodiment has substantially the same structure as the cylinder 114*a* in the second embodiment, and thus will not be described.

The first rod 232 is a rod-shaped member connected to the surface on the inlet side of the piston 128. The first rod 232 extends toward a pressure chamber 114*b* on the inlet 114*l* from the piston 128 and extends outward through the first through-hole portion 114*f* on the side wall on the inlet side. The first rod 232 extends into the drive part drain passage 134*b* extending from the first through-hole portion 114*f*. The proximal end of the first rod 232 is connected to the piston 128, and the distal end of the first rod 232 is located inside the drive part drain passage 134*b*. The first rod 232 is a rod extending toward an opposite side of a second rod 133, which is an operating rod for the clutch mechanism 130 extending from the piston 128 toward the clutch mechanism 130. The rod extending from the piston 128 through the through-hole portion formed in the cylinder 114*a* is not necessarily limited to distinguish the first rod 232 and the second rod 133 from each other, and the first rod 232 and the second rod 133 may be formed as a one rod.

Figure 22:
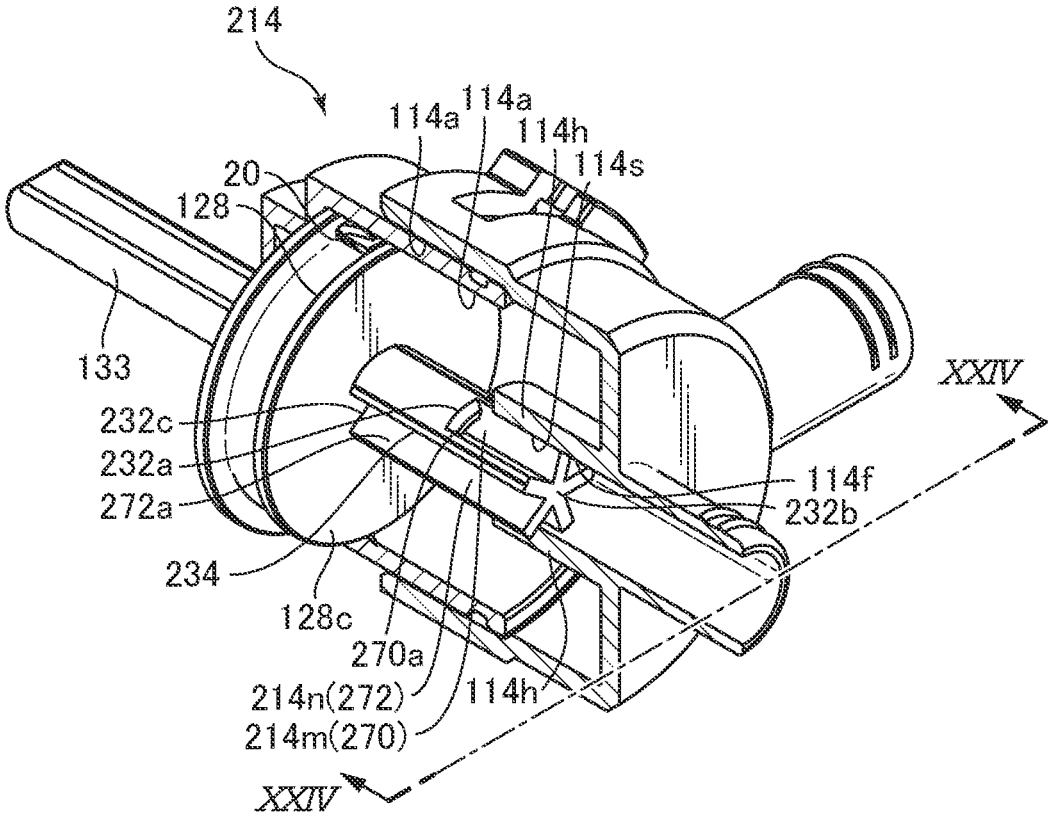
FIG. 22 is a partially enlarged perspective view of a discharge valve hydraulic drive portion of the flush water tank apparatus shown in FIG. 21.

As shown in FIG. 22, the discharge valve hydraulic drive portion 214 includes a first discharge part 214*m* provided separately from the inlet 114*l* to cause the flush water to drain from the inside of the cylinder 114*a*, and a second discharge part 214*n* provided separately from the first discharge part 214*m* and formed between the first rod 232 and the first through-hole portion 114*f* and between the piston 128 and the first through-hole portion 114*f*.

Figure 24:
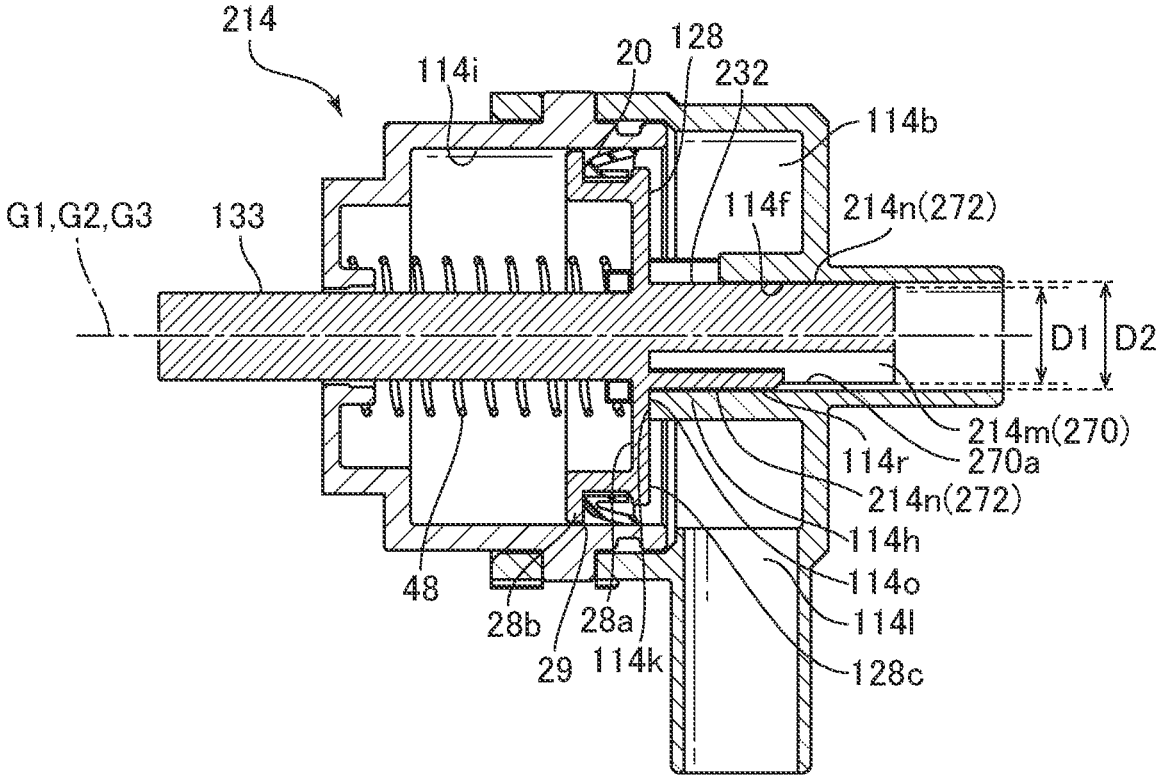
FIG. 24 is a partially enlarged cross-sectional view showing a central cross section of the discharge valve hydraulic drive portion of the flush water tank apparatus shown in FIG. 21.

The first discharge part 214*m* extends into the drive part drain passage 134*b*. A distal end of the first discharge part 214*m* forms an outflow hole to the drive part drain passage 134*b*. The first discharge part 214*m* is formed to open and close a first discharge passageway inlet 270*a* of a first discharge passageway 270 through which the flush water is drained from the inside of the cylinder 114*a* to the outside of the cylinder 114*a* by the first rod 232 and the first through-hole portion 114*f*. As shown in FIGS. 21 and 24, the first discharge part 214*m* is configured such that when the piston 128 is located at the first position H11, the first discharge passageway inlet 270*a* of the first discharge passageway 270 is closed by the first rod 232 and the first through-hole portion 114*f* and the first discharge passageway 270 is closed. As shown in FIG. 22, the first discharge part 114*m* is configured such that when piston 128 reaches a communication position (for example, a predetermined position on a further back side from a disengagement position of the clutch mechanism) between the first position H11 to a second position H12 and is located on a further back side after reaching, the first discharge passageway inlet 270*a* of the first discharge passageway 270 is opened by the first rod 232 and the first through-hole portion 114*f* and the first discharge passageway 270 is in an open state. The first discharge part 214*m* has a switching function such as a switching valve between a closed state and an open state of the first discharge passageway 270. The first discharge part 214*m* has a function of forming a main discharge passageway of the flush water from the cylinder 114*a*. In addition, the first discharge part 214*m* has a function of forming a main water supply passageway of the flush water to the reservoir tank 10.

Figure 23:
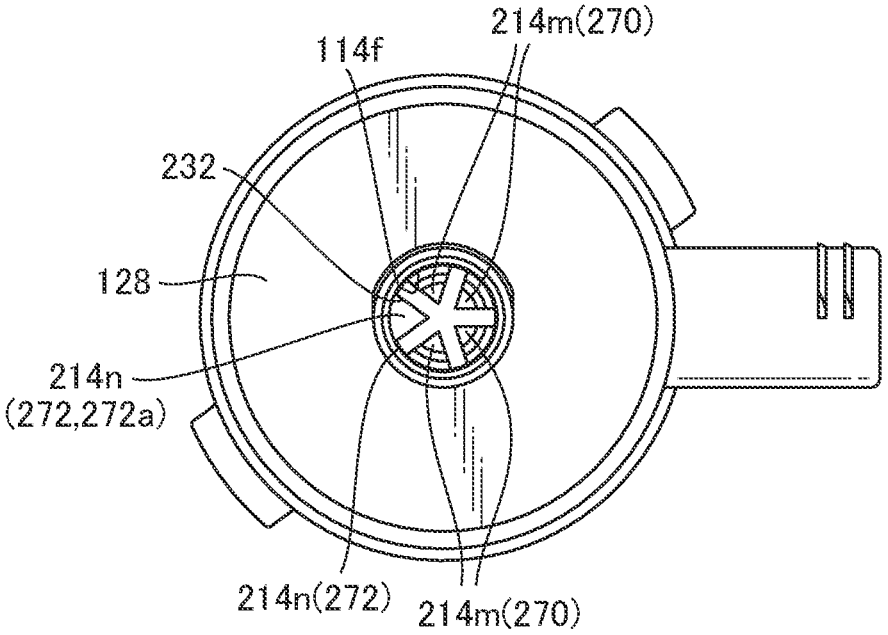
FIG. 23 is a front view of the discharge valve hydraulic drive portion shown in FIG. 22 as viewed from a drive part drain passage in an axial direction of a first rod.

As shown in FIG. 22, the first discharge passageway 270 of the first discharge part 214*m* is formed such that a groove formed so as to cut out inward the side portion of the first rod 232 extends from a first discharge passageway start position 232*a* to a distal end 232*b* of the first rod 232 at the outer surface portion of the first rod 232. The first discharge passageway start position 232*a* is located at a position away from the proximal end on the piston side. The first discharge passageway start position 232*a* is the first discharge passageway start position of the first rod 232 that appears in the cylinder 114*a* so as to correspond to a communication position (a fourth position H14 where the communication flow channel is formed) of the piston 128. The first discharge passageway 270 forms a flow channel having a fan-shaped cross section. The first discharge passageway 270 is formed on the outer surface portion of the first rod 232 and also forms a flow channel between the first rod 232 and the first through-hole portion 114*f*. The first discharge passageway inlet 270*a* of the first discharge passageway 270 is formed in such a manner that when the groove of the first discharge passageway 270 is located closer to the inside of the cylinder than the first through-hole portion 114*f* as the first rod 232 moves, the groove of the first discharge passageway 270 is opened laterally inside the cylinder rather than the first through-hole portion 114*f*. As shown in FIG. 23, the first discharge passageways 270 are formed at four locations along the outer periphery of the first rod 232 in a front view seen from the drive part drain passage 134*b* in an axial direction of the first rod 232. A central angle of the fan shape in the cross section of the second discharge passageway 272 is about 72 degrees. The four first discharge passageways 270 are similarly formed from the first discharge passageway start position 232*a* to the distal end. The distance from the connection portion of the first rod 132 with the piston 128 to the first discharge passageway start position 232*a*, that is, the distance from the first position H11 to the fourth position H14 is more than two-thirds of the movable distance of the piston 128 in the cylinder 114*a*.

The second discharge part 214*n* is formed between the first rod 232 and the first through-hole portion 114*f* and between the piston 128 and the first through-hole portion 114*f*. The second discharge part 214*n* communicates a pressure chamber 114*b* on the inlet side of the discharge valve hydraulic drive portion 214 with a space inside the reservoir tank 10. The second discharge part 214*n* forms a second discharge passageway 272 from the cylinder 114*a*. The second discharge passageway 272 is formed from, for example, a slight gap between an outer surface of the first rod 232 and the first through-hole portion 114*f*. The second discharge passageway 272 may further include, for example, a groove 272*a* in which the side portion of the first rod 232 is cut out inward from a proximal end 232*c* to a distal end 232*b* of the first rod 232. The groove 272*a* of the second discharge passageway 272 forms a flow channel having a fan-shaped cross section. Therefore, when the piston 128 is located at the first position H11, the second discharge passageway 272 of the second discharge part 214*n* is in an open state. The second discharge passageway 272 is always in an open state regardless of the position of the piston 128. Some of the flush water flowing into the cylinder 114*a* flows out from the second discharge part 214*n* in the gap between the first rod 232 and the first through-hole portion 114*f*. The flush water flowing out from the second discharge part 214*n* flows into the reservoir tank 10. Since the second discharge part 214*n* is relatively narrow and has a large flow channel resistance, even when the flush water flows out from the second discharge part 214*n*, the pressure in the cylinder 114*a* rises due to the flush water flowing into the cylinder 114*a* from the drive part water supply passage 34*a*, and the piston 128 is pushed up against the urging force of the spring 48.

A minimum cross-sectional area value of the second discharge passageway 272 of the second discharge part 214*n* is smaller than that of the first discharge passageway 270 of the first discharge part 214*m*. The minimum cross-sectional area value of the second discharge passageway 272 of the second discharge part 214*n* is equal to or less than half of the minimum cross-sectional area value of the first discharge passageway 270 of the first discharge part 214*m*, and the second discharge part 214*n* forms an auxiliary drain flow channel relative to the first discharge part 214*m*.

As shown in FIG. 23, the second discharge passageway 272 is formed at one location along the outer periphery of the first rod 232 in a front view seen from the drive part drain passage 134*b* in an axial direction of the first rod 232. A central angle of the fan shape in the cross section of the second discharge passageway 272 is about 72 degrees.

As shown in FIG. 22, a bank portion 114*h* extends to the first position H11 in a portion corresponding to the second discharge passageway 272, but is formed to have a shorter length in a portion corresponding to the first discharge passageway 270. Even with the bank portion 114*h* and first rod 232, the second discharge passageway 272 of the second discharge part 214*n* includes a first flow channel 114*o* extending laterally with respect to a lower surface portion 128*c* between the top portion 114*k* of the bank portion 114*h* and a lower surface portion 128*c* in the state where the piston 128 is at the first position H11, and a third flow channel 114*r* extending laterally between the first rod 232 and the inner wall of the first through-hole portion 114*f* in the state where the piston 128 is at the first position H11. The third flow channel 114*r* forms a flow channel between an outer surface of the portion other than the groove 272*a* of the first rod 232 and the inner wall of the first through-hole portion 114*f*. The third flow channel 114*r* may include the groove 272*a* or the flow channel between the groove 272*a* and the inner wall of the first through-hole portion 114*f*.

The shape of the second discharge part 214*n* changes with the movement of the piston 128. Therefore, the total cross-sectional area value and the minimum cross-sectional area value of the flow channel in the second discharge part 214*n* change with the movement of the piston 128. The second discharge part 214*n* is formed such that as the piston 128 moves from the first position H11 to the second position H12, the total cross-sectional area value and the minimum cross-sectional area value of the second discharge passageway 272 in the second discharge part 214*n* are increased and pressure loss of the second discharge part 214*n* is reduced. For example, as the piston 128 moves from the first position H11 to the second position H12, the cross-sectional area of the minimum flow channel in the second discharge part 214*n* increases. For example, the cross-sectional area of the minimum flow channel is the minimum cross-sectional area value of the second discharge passageway 272 between the top portion 114*k* of the bank portion 114*h* and the lower surface portion 128*c* of the piston 128. As the piston 128 moves from the first position H11 to the second position H12, the minimum cross-sectional area value of the flow channel of the second discharge passageway 272 also increases.

When an outer diameter of the portion of the distal end side of the first rod 232 is formed smaller than an outer diameter of the portion of the proximal end side, the second discharge part 214*n* is formed such that as the piston 128 and the first rod 232 move toward the side of the second position, the cross-sectional area of the second discharge passageway 272 between the first rod 232 and the inner wall of the first through-hole portion 114*f*, for example, the total cross-sectional area value and the minimum cross-sectional area value increase and the pressure loss of the second discharge part 214*n* is reduced. At this time, the minimum cross-sectional area value (a cross-sectional area of the second discharge passageway 272 of the second discharge part 214*n* corresponding to the discharge passageway of the second discharge part 14*n* between the first rod 32 and the inner wall of the first through-hole portion 14*f* as shown by the second discharge part 14*n* in FIG. 7) of the second discharge passageway 272 when the piston 128 is at the first position H11 is smaller than the minimum cross-sectional area value of the flow channel between the first rod 232 and the inner wall of the first through-hole portion 114*f* when the piston 128 is at the second position H12.

A description will be given below with reference to FIGS. 21 to 28 with respect to the flush water tank apparatus 204 according to the third embodiment of the present invention and a series washing operations of the flush toilet apparatus 201 including the flush water tank apparatus 204. Since the washing operation of the flush water tank apparatus 204 in the third embodiment is substantially the same as the washing operation of the flush water tank apparatus 104 in the second embodiment, the first discharge part 214*m* and the second discharge part 214*n* will be mainly described, and the repeated portions will be referred to the description of the second embodiment and will not be described.

As shown in FIGS. 21 and 24, when the piston 128 is located at the first position H11, the first discharge passageway inlet 270*a* of the first discharge passageway 270 of the first discharge part 214*m* is closed by the first rod 232 and the first through-hole portion 114*f*, and the first discharge passageway 270 is closed. When the piston 128 is located at the first position H11, the first discharge passageway inlet 270*a* of the first discharge passageway 270 of the first rod 232 is located closer to the drive part drain passage 134*b* than the top portion 114*k* of the bank portion 114*h*. When the piston 128 is located at the first position H11, the second discharge part 214*n* is formed between the first rod 232 and the first through-hole portion 114*f* and between the piston 128 and the first through-hole portion 114*f*. In other words, in the standby state, the second discharge passageway 272 formed between the first rod 232 and the first through-hole portion 114*f* is in an open state. Thus, as shown in FIG. 25, when the flush water flows into the cylinder 114*a*, some of the flush water flows out from the second discharge passageway 272 of the second discharge part 214*n* toward the side of the drive part drain passage 134*b* as indicated by an arrow F21.

Next, when the instruction signal for the toilet washing is received and the first control valve 16 is open, the flush water flowing from the water supply pipe 38 is supplied to the discharge valve hydraulic drive portion 214 through the first control valve 16. Thereby, the piston 128 of the discharge valve hydraulic drive portion 214 is pushed up, and the operating part 133*a* of the second rod 133 is advanced toward the passive part 176.

Figure 25:
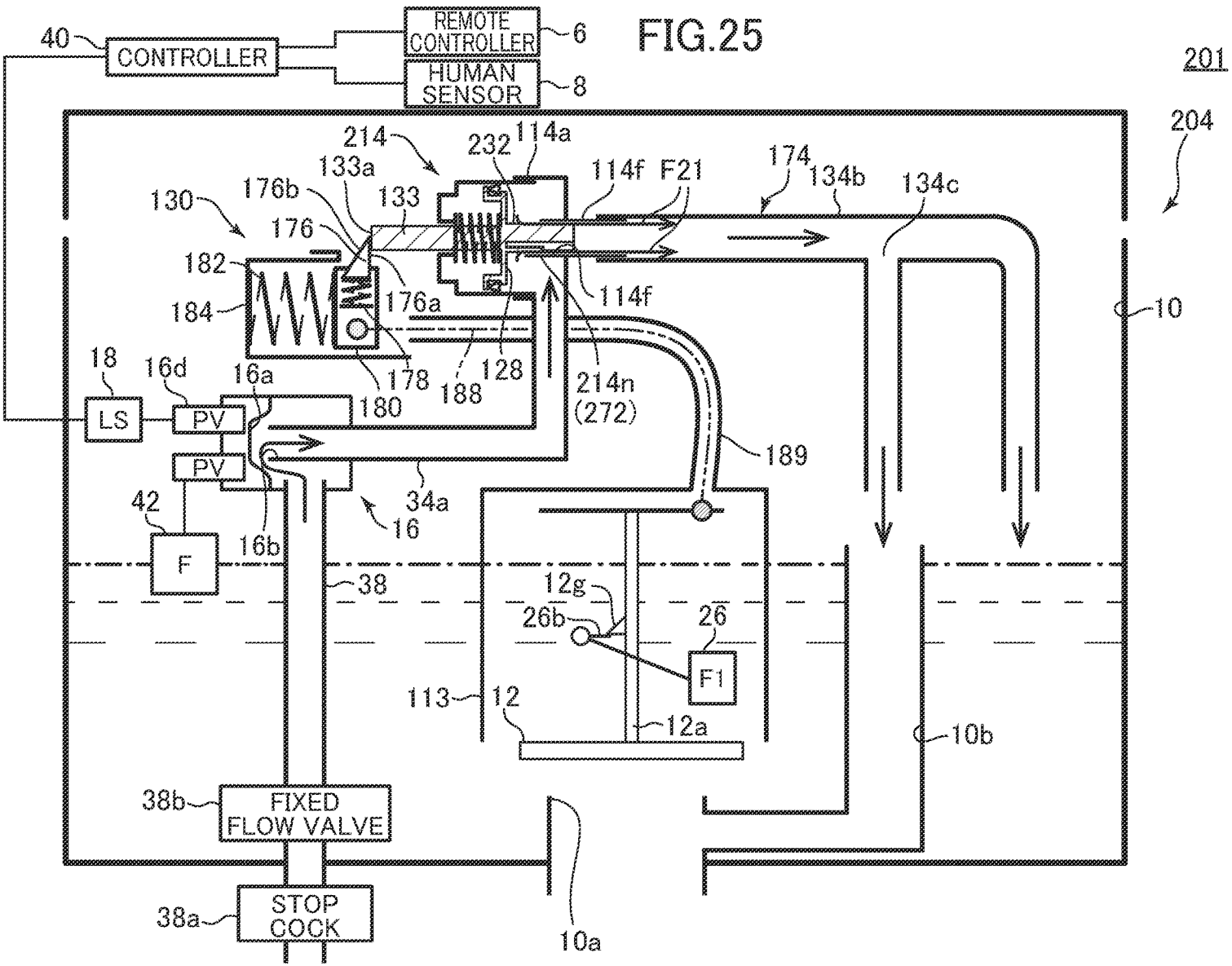
FIG. 25 is a view showing a state where a piston of the discharge valve hydraulic drive portion in the flush water tank apparatus shown in FIG. 21 is moving toward a second position.

As shown in FIG. 25, when the piston 128 and the second rod 133 moves toward the second position H12, the operating part 133*a* comes into contact with the first flat surface 176*a* of the passive part 176, and the passive part 176 and the first support body 180 are pushed while contracting the elastic member 182 for the support body. Thereby, the couple member 188 connected to the first support body 180 is pulled up, and the discharge valve 12 is pulled up by the couple member 188. Therefore, when the discharge valve 12 is pulled up, the flush water in the reservoir tank 10 is drained from the water discharge opening 10*a* to the flush toilet main body 2.

Until the clutch mechanism 130 is disengaged while the piston 128 moves from the first position H11 to the second position H12, the second discharge passageway 272 formed between the first rod 232 and the first through-hole portion 114*f* is an open state. Thereby, as indicated by an arrow F21, some of the flush water flowing into the cylinder 114*a* flows out from the second discharge passageway 272 of the second discharge part 214*n* toward the side of the drive part drain passage 134*b*. Since the outflow of the flush water from the second discharge passageway 272 is relatively small, the piston 128 is pushed toward the second position H12 as planned. On the other hand, the first discharge passageway inlet 270*a* of the first discharge passageway 270 is closed by the first rod 232 and the first through-hole portion 114*f*, and the first discharge passageway 270 of the first discharge part 214*m* is closed.

Figure 26:
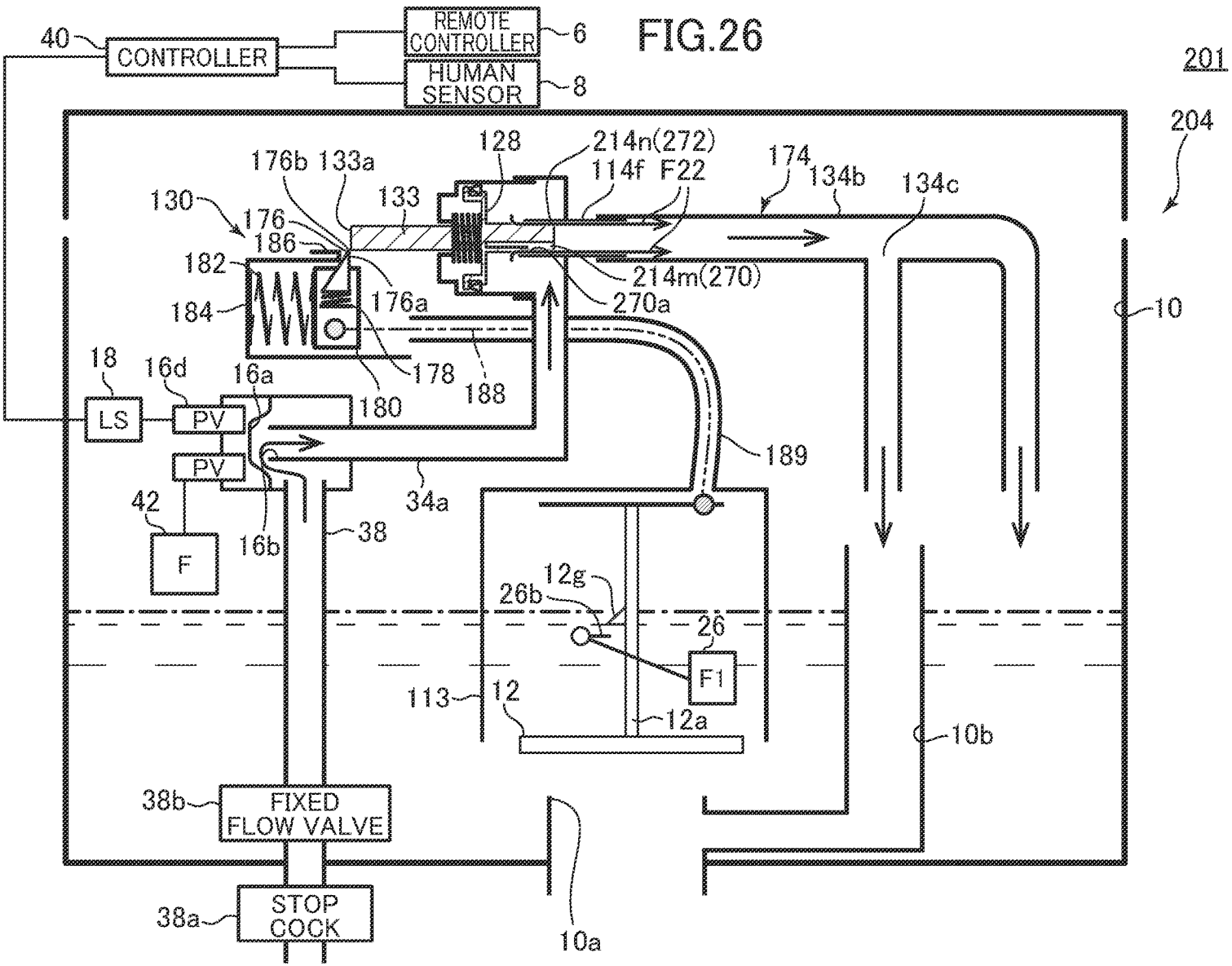
FIG. 26 is a view showing a state where a clutch mechanism in the flush water tank apparatus shown in FIG. 21 is disengaged.

Next, as shown in FIG. 26, when the passive part 176 is further advanced and pressed toward the regulation part 186, the contact between the second rod 133 and the passive part 176 is released, and the coupling of the clutch mechanism 130 is released. In other words, when the discharge valve 12 reaches a predetermined height, the passive part 176 of the clutch mechanism 130 hits the regulation part 186, and the clutch mechanism 130 is disengaged. Even after the clutch mechanism 130 is disengaged, the first discharge passageway 270 of the first discharge part 214*m* is in a closed state until the first discharge passageway inlet 270*a* is opened, and as indicated by an arrow F22, some of the flush water flows out from the second discharge passageway 272 of the second discharge part 214*n* toward the side of the drive part drain passage 134*b*.

Figure 27:
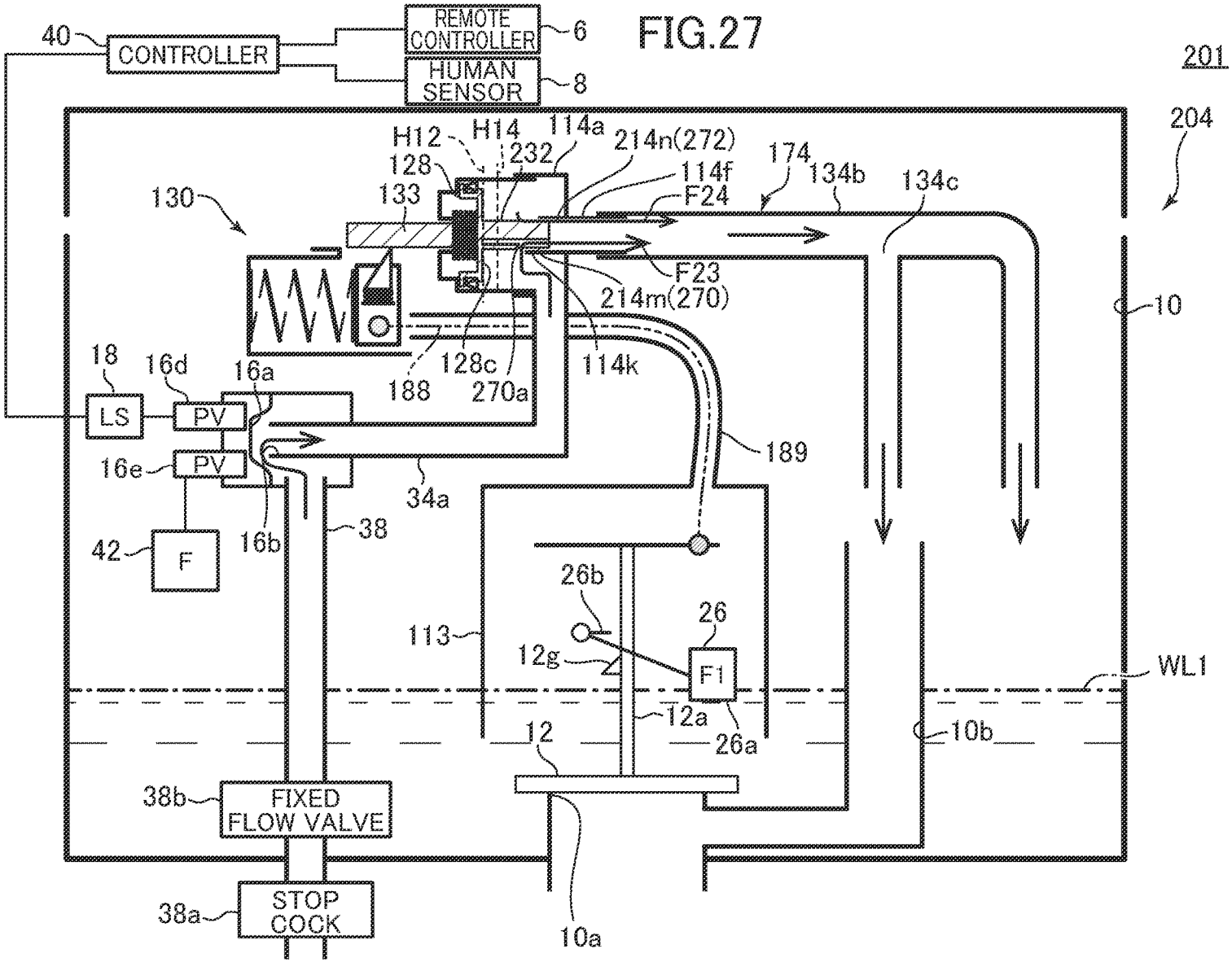
FIG. 27 is a view showing a state where the piston of the discharge valve hydraulic drive portion in the flush water tank apparatus shown in FIG. 21 is moved to the second position.

As shown in FIG. 27, the piston 128 and the first rod 232 are further pushed forward to reach the second position H12. In this process, when the piston 128 is advanced up to a communication position (a fourth position H14 of the piston 128 in which a communication flow channel is formed) of the piston 128, a first discharge passageway inlet 270*a* is opened from the first discharge passageway start position 232*a* of the first rod 232 appearing in the cylinder 114*a* so as to correspond to the communication position of the piston 128. The fourth position H14 is located at a position closer to the back side of the piston than the disengagement position where the clutch mechanism 130 is disengaged and at a position slightly closer to the inlet side (front side) than the second position H12. When the first discharge passageway inlet 270*a* of the first discharge passageway 270 is opened by the first rod 232 and the first through-hole portion 114*f*, the first discharge passageway 270 of the first discharge part 214*m* is opened. Thereby, as indicated by an arrow F23, the flush water is drained from the first discharge passageway 270 to the drive part drain passage 134*b*, and the flush water is discharged as main water supply from the discharge part at the downstream end of the drive part drain passage 134*b* into the reservoir tank 10. At this time, as indicated by an arrow F24, some of the flush water also flows out from the second discharge passageway 272 of the second discharge part 214*n* toward the side of the drive part drain passage 134*b*.

On the other hand, since the pilot valve 16*e* is opened, the open state of the first control valve 16 is maintained and the water supply to the reservoir tank 10 is continued. In addition, when the water level in the reservoir tank 10 drops up to the predetermined water level WL1, the float part 26*a* of the float apparatus 26 descends, which moves the engaging part 26*b*. Thus, the engagement between the valve shaft frame body 12*a* and the engaging part 26*b* is released, and the valve shaft frame body 12*a* and the discharge valve 12 start to descend again.

Thereby, the discharge valve 12 is seated on the water discharge opening 10*a*, and the water discharge opening 10*a* is closed. Since the float switch 42 is still in the off state, the open state of the first control valve 16 is maintained, and the water supply to the reservoir tank 10 is continued. The flush water supplied through the drive part drain passage 134*b* reaches the drain passage branch portion 134*c*, some of the flush water branched at the drain passage branch portion 134*c* flows into the overflow pipe 10*b*, and the remaining flush water is stored in the reservoir tank 10. The flush water flowing into the overflow pipe 10*b* flows into the flush toilet main body 2, and is used to refill the bowl 2*a*. On the other hand, the water level in the reservoir tank 10 rises due to the flush water flowing into the reservoir tank 10 in the state where the discharge valve 12 is closed.

Figure 28:
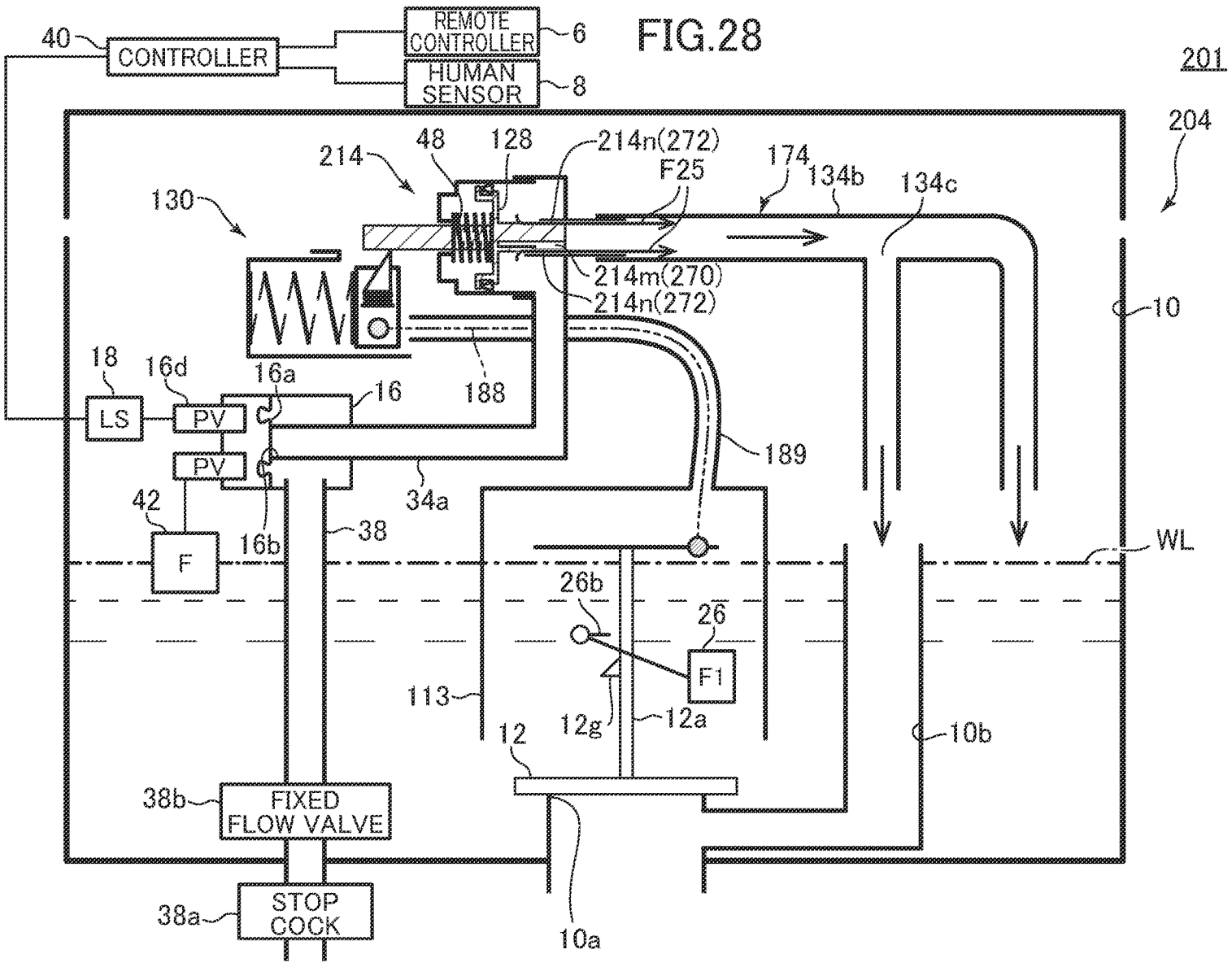
FIG. 28 is a view showing a state where a discharge valve in the flush water tank apparatus shown in FIG. 21 descends and a water discharge opening is closed.

As shown in FIG. 28, after the first control valve 16 is closed and the water supply to the discharge valve hydraulic drive portion 214 is stopped, the flush water in the cylinder 114*a* of the discharge valve hydraulic drive portion 214 gradually flows out from the first discharge part 214*m* and the second discharge part 214*n*, and the piston 128 is pushed down by the urging force of the spring 48 and returns to the first position H11. After the first discharge passageway inlet 270*a* is closed along with the return of the piston 128 to the first position H11, as indicated by an arrow F25, the flush water in the cylinder flows out from the second discharge passageway 272 toward the side of the drive part drain passage 134*b*. Therefore, as shown in FIG. 21, the apparatus in the reservoir tank 10 returns to the standby state.

According to the flush water tank apparatus 204 of the third embodiment of the present invention described above, the discharge valve hydraulic drive portion 114 includes the inlet 114*l* that is formed in the cylinder 114*a* and into which the flush water flows, the first discharge part 214*m* provided separately from the inlet 114*l* to cause the flush water to drain from the inside of the cylinder 114*a*, and the second discharge part 214*n* provided separately from the first discharge part 214*m* and formed between the first rod 232 and the first through-hole portion 114*f*. Thereby, when the water supply pressure of the flush water to the cylinder 114*a* suddenly fluctuates, for example, suddenly rises in the state where the flow channel is not communicated or is communicated from the inlet 114*l* to the first discharge part 214*m* in the cylinder 114*a*, the second discharge part 214*n* can soften the impact of the sudden fluctuation in the pressure of the flush water, the piston 128 can buffer the impact applied from the flush water, and the unstable operation of the piston 128 can be restrained.

According to the flush water tank apparatus 204 of the third embodiment of the present invention described above, the first discharge passageway 270 of the first discharge part 214*m* can be relatively easily formed from the groove formed on the outer surface portion of the first rod 232. Therefore, when the piston 128 is located at the first position H11, the water supply pressure of the flush water does not escape toward the side of the first discharge passageway 270, and the water supply pressure of the flush water is effectively used for the movement of the piston 128. When the piston 128 is located at the communication position, the first discharge passageway 270 is opened, the flush water is drained from the inside of the cylinder 114*a* to the outside of the cylinder 114*a* through the first discharge passageway 270, and the piston 128 can easily return to the first position H11 from the second position H12 or the predetermined position.

Figure 29:
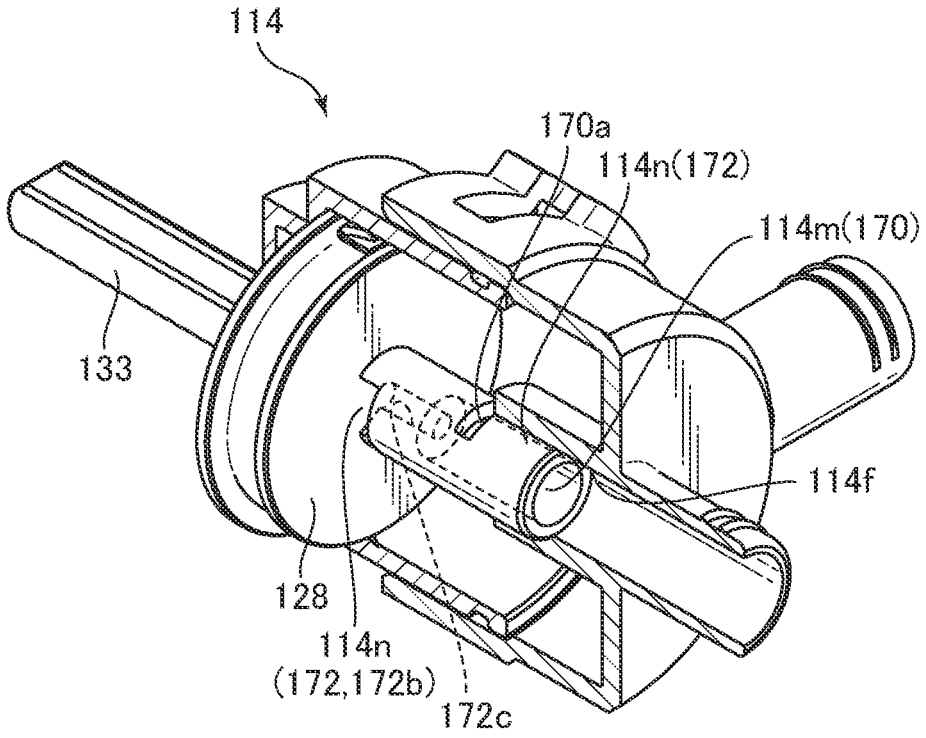
FIG. 29 is a partially enlarged perspective view showing a modification of the discharge valve hydraulic drive portion of the flush water tank apparatus according to the second embodiment of the present invention.

In the discharge valve hydraulic drive portion 214 according to the second embodiment of the present invention described above, as an example, the second discharge passageway 172 is formed from the slight gap between the outer surface of the first rod 132 and the first through-hole portion 114*f*. However, as a modification without being limited to such a form, as shown in FIG. 29, the second discharge passageway 172 of the second discharge part 114*n* may further include an internal passage 172*c* extending into the first rod 132 from the second discharge passageway inlet 172*b* that opens on the side surface of the first rod 132. By the second discharge passageway 172 including the internal passage 172*c*, the amount to be drained can be more stabilized. Such an internal passage 172*c* may be connected to the first discharge passageway 170 in the second embodiment. The minimum cross-sectional area value of the flow channel at the second discharge passageway inlet 172*b* and the internal passage 172*c* is made smaller than the minimum cross-sectional area value of the flow channel at the internal passage of the first discharge passageway inlet 170*a* and the first discharge passageway 170.

What is claimed is:

1. A flush water tank apparatus configured to supply flush water to a flush toilet, the flush water tank apparatus comprising:

a reservoir tank configured to store flush water to be supplied to the flush toilet and includes a water discharge opening formed thereon, the water discharge opening being for draining stored the flush water to the flush toilet;

a discharge valve configured to open and close the water discharge opening to supply the flush water to the flush toilet and to stop a supply of the flush water to the flush toilet; and a discharge valve hydraulic drive portion configured to drive the discharge valve using a water supply pressure of tap water being supplied, the discharge valve hydraulic drive portion including:

a cylinder to which the tap water is supplied as the flush water;

a piston that is slidably disposed in the cylinder and moves from a first position to a second position by the flush water flowing into the cylinder;

a rod that extends from the piston through a through-hole portion formed in the cylinder;

an elastic member that is provided on the piston and has a sealing function between the piston and an inner wall of the cylinder;

an inlet that is formed in the cylinder and into which the flush water flows;

a first discharge part that is provided separately from the inlet to discharge the flush water from an inside of the cylinder; and a second discharge part that is provided separately from the first discharge part and is formed between the rod and the through-hole portion and between the piston and the through-hole portion.

2. The flush water tank apparatus according to claim 1, wherein the first discharge part is formed in the cylinder.

3. The flush water tank apparatus according to claim 1, wherein the first discharge part is formed such that an inlet of a first discharge passageway, through which the flush water is discharged from the inside of the cylinder to an outside of the cylinder, is opened and closed by the rod and the through-hole portion, and the first discharge part is configured such that when the piston is located at the first position, the inlet of the first discharge passageway is closed by the rod and the through-hole portion and the first discharge passageway is closed, and is further configured such that when the piston reaches a communication position among from the first position to the second position, the inlet of the first discharge passageway is opened by the rod and the through-hole portion and the first discharge passageway is opened.

4. The flush water tank apparatus according to claim 3, wherein the first discharge passageway of the first discharge part is formed by a passage extending in an inside of the rod from a first discharge passageway start position of the rod appearing in the cylinder so as to correspond to the communication position of the piston, to a distal end of the rod.

5. The flush water tank apparatus according to claim 3, wherein the first discharge passageway of the first discharge part is formed by a groove formed on an outer surface portion of the rod from a first discharge passageway start position of the rod appearing in the cylinder so as to correspond to the communication position of the piston, to a distal end of the rod.

6. The flush water tank apparatus according to claim 1, wherein a deformation amount of the elastic member in a state where the piston is at the first position is a maximum deformation amount among deformation amounts of the elastic member at respective positions while the piston moves from the first position to the second position.

7. The flush water tank apparatus according to claim 6, wherein an inner diameter of the cylinder at a portion corresponding to the first position of the piston is a minimum inner diameter among inner diameters of the cylinder.

8. The flush water tank apparatus according to claim 6, wherein the discharge valve hydraulic drive portion further includes an urging member that is provided in the cylinder to urge the piston toward a side of the first position.

9. The flush water tank apparatus according to claim 1, wherein the second discharge part is formed such that as the piston moves from the first position to the second position, a cross-sectional area of a flow channel in the second discharge part is increased and a pressure loss of the second discharge part is reduced.

10. The flush water tank apparatus according to claim 9, wherein the second discharge part is formed such that as the piston moves from the first position to the second position, a cross-sectional area of a flow channel of the second discharge part between the rod and an inner wall of the through-hole portion is increased and the pressure loss of the second discharge part is reduced.

11. The flush water tank apparatus according to claim 9, wherein the through-hole portion of the cylinder includes a bank portion that rises from a peripheral portion of a through hole at a bottom portion of the cylinder toward the inside of the cylinder, and the second discharge part includes a first flow channel extending between a top portion of the bank portion and the piston in a state where the piston is at the first position.

12. The flush water tank apparatus according to claim 9, further comprising:

a clutch mechanism that couples the discharge valve and the discharge valve hydraulic drive portion to pull up the discharge valve by the discharge valve hydraulic drive portion and is disengaged at a predetermined timing to allow the discharge valve to descend, wherein the cross-sectional area of the flow channel of the second discharge part when the clutch mechanism is disengaged is a maximum cross-sectional area of the flow channel among cross-sectional areas of the flow channel of the second discharge part at respective positions while the piston moves from the first position to the second position.

13. The flush water tank apparatus according to claim 1, wherein a center axis of the rod and a center axis of the through-hole portion are located on the same axis as a center axis of the cylinder.

14. The flush water tank apparatus according to claim 1, wherein the through-hole portion further includes a flow straightening portion that is formed such that a diameter of an inner wall at a top portion thereof is constant in a moving direction of the rod.

15. The flush water tank apparatus according to claim 1, wherein a maximum outer diameter of the rod is smaller than a minimum inner diameter of the through-hole portion.

16. The flush water tank apparatus according to claim 1, wherein the flush water tank apparatus further includes a speed reduction part that reduces a flow rate of the flush water discharged from the second discharge part.

17. The flush water tank apparatus according to claim 1, wherein when the piston is at the first position, a lower end of the elastic member is located above a stopped water level of the reservoir tank.

18. The flush water tank apparatus according to claim 17, wherein the cylinder of the discharge valve hydraulic drive portion is configured such that the elastic member is immersed in flush water remaining in the cylinder in the state where the piston is located at the first position.

19. The flush water tank apparatus according to claim 18, wherein the piston of the discharge valve hydraulic drive portion is configured to move up and down in the cylinder, the first position is located to be lower than the second position, the cylinder includes a bank portion that rises upward from a peripheral portion of a through hole at a bottom portion thereof and a water storage part capable of storing flush water remaining between the bank portion and the inner wall of the cylinder, and an upper end of the elastic member is located at a position lower than the top portion of the bank portion such that the elastic member is located in the water storage part in the state where the piston is located at the first position.

20. The flush water tank apparatus according to claim 19, wherein the top portion of the bank portion is in contact with a lower surface portion of the piston in the state where the piston is located at the first position.

21. The flush water tank apparatus according to claim 20, wherein the rod extends downward from the piston, and the bank portion of the cylinder is formed in an annular shape around the rod in a top view.

22. The flush water tank apparatus according to claim 20, wherein the discharge valve hydraulic drive portion further includes an urging member that is provided in the cylinder and urges the piston toward a side of the first position, the piston includes a force receiving part that receives an urging force from the urging member, and the force receiving part is formed outside the bank portion in a top view.

23. The flush water tank apparatus according to claim 22, wherein the force receiving part of the piston in the discharge valve hydraulic drive portion is located below the top portion of the bank portion in the state where the piston is at the first position.

24. The flush water tank apparatus according to claim 19, wherein the piston of the discharge valve hydraulic drive portion further includes an upper outer circumference part that is formed on an upper side of the elastic member, and a water passageway gap is formed between the upper outer circumference part and the inner wall of the cylinder, the flush water passing through the water passageway gap.

25. The flush water tank apparatus according to claim 24, wherein the water passageway gap is formed between the upper outer circumference part and the inner wall of the cylinder to be gradually smaller from an upper side to a lower side of the cylinder.

26. A flush toilet apparatus comprising:

the flush water tank apparatus according to claim 1; and a flush toilet that is washed with the flush water to be supplied from the flush water tank apparatus.

* * * * *